US007632221B1

(12) United States Patent
Kolander

(10) Patent No.: US 7,632,221 B1
(45) Date of Patent: Dec. 15, 2009

(54) CABLE CROSS TRAINER APPARATUS

(76) Inventor: Scott Kolander, 629 Bay Blossom Dr., Wilmington, NC (US) 28411-7769

( * ) Notice: Subject to any disclaimer, the term of this patent is extended or adjusted under 35 U.S.C. 154(b) by 419 days.

(21) Appl. No.: 11/585,310

(22) Filed: Oct. 23, 2006

(51) Int. Cl.
*A63B 21/06* (2006.01)
*A63B 21/00* (2006.01)

(52) U.S. Cl. ..... 482/94; 482/102; 482/138

(58) Field of Classification Search ..... 482/92–94, 482/97–103, 133–139
See application file for complete search history.

(56) References Cited

U.S. PATENT DOCUMENTS 2,977,120 A 3/1961 Morris
3,640,528 A 2/1972 Proctor
4,390,179 A 6/1983 Szkalak
4,549,733 A 10/1985 Salyer
4,627,615 A * 12/1986 Nurkowski ..... 482/98
4,632,388 A 12/1986 Schleffendorf
4,697,809 A 10/1987 Rockwell
4,712,793 A * 12/1987 Harwick et al. ..... 482/99
4,744,559 A 5/1988 Mahnke et al.
4,775,146 A 10/1988 Stankovic
4,898,381 A 2/1990 Gordon
4,900,018 A 2/1990 Ish, III
4,953,855 A * 9/1990 Shields ..... 482/99
4,973,050 A * 11/1990 Santoro et al. ..... 482/102
5,298,004 A * 3/1994 Davis ..... 482/99
5,328,428 A * 7/1994 Huang ..... 482/98
5,356,360 A * 10/1994 Johns ..... 482/99
5,514,060 A 5/1996 Hu
5,518,477 A 5/1996 Simonson
5,549,530 A 8/1996 Fulks
5,779,601 A 7/1998 Ish, III
5,795,272 A * 8/1998 Brenke ..... 482/103
5,842,961 A * 12/1998 Davis ..... 482/139
6,183,401 B1 * 2/2001 Krull ..... 482/98
6,217,493 B1 * 4/2001 Spletzer ..... 482/103
6,238,323 B1 5/2001 Simonson
6,551,223 B2 * 4/2003 Cheng ..... 482/99
6,565,490 B2 * 5/2003 O'Hearn ..... 482/102
6,575,882 B2 * 6/2003 Chen ..... 482/98
6,579,214 B2 * 6/2003 Crump ..... 482/103
6,719,672 B1 * 4/2004 Ellis et al. ..... 482/99
6,719,673 B1 * 4/2004 LaPlaca ..... 482/99
6,976,941 B2 * 12/2005 Britt ..... 482/94
7,044,897 B2 * 5/2006 Myers et al. ..... 482/99
7,070,546 B1 * 7/2006 Grasso ..... 482/103
7,101,326 B2 * 9/2006 Gerschefske et al. ..... 482/129
7,169,093 B2 * 1/2007 Simonson et al. ..... 482/103
7,172,537 B2 * 2/2007 Eisa ..... 482/138
2002/0094918 A1 * 7/2002 Gerschefske et al. ..... 482/92
2002/0193215 A1 * 12/2002 Cheng ..... 482/99
2003/0004039 A1 * 1/2003 Deola ..... 482/92

(Continued)

FOREIGN PATENT DOCUMENTS

WO WO 2005009547 A1 * 2/2005

*Primary Examiner*—Loan H Thanh
*Assistant Examiner*—Daniel F. Roland
(74) *Attorney, Agent, or Firm*—Michael I Kroll

(57) ABSTRACT

A weight-training device having a plurality of stations that enable the user to perform a vast array of exercises targeting different muscle groups. Variable resistance is provided by a pair of weight stacks having cables leading to the various stations and through the use of barbells at the barbell station.

39 Claims, 46 Drawing Sheets

U.S. PATENT DOCUMENTS

Figure 1:
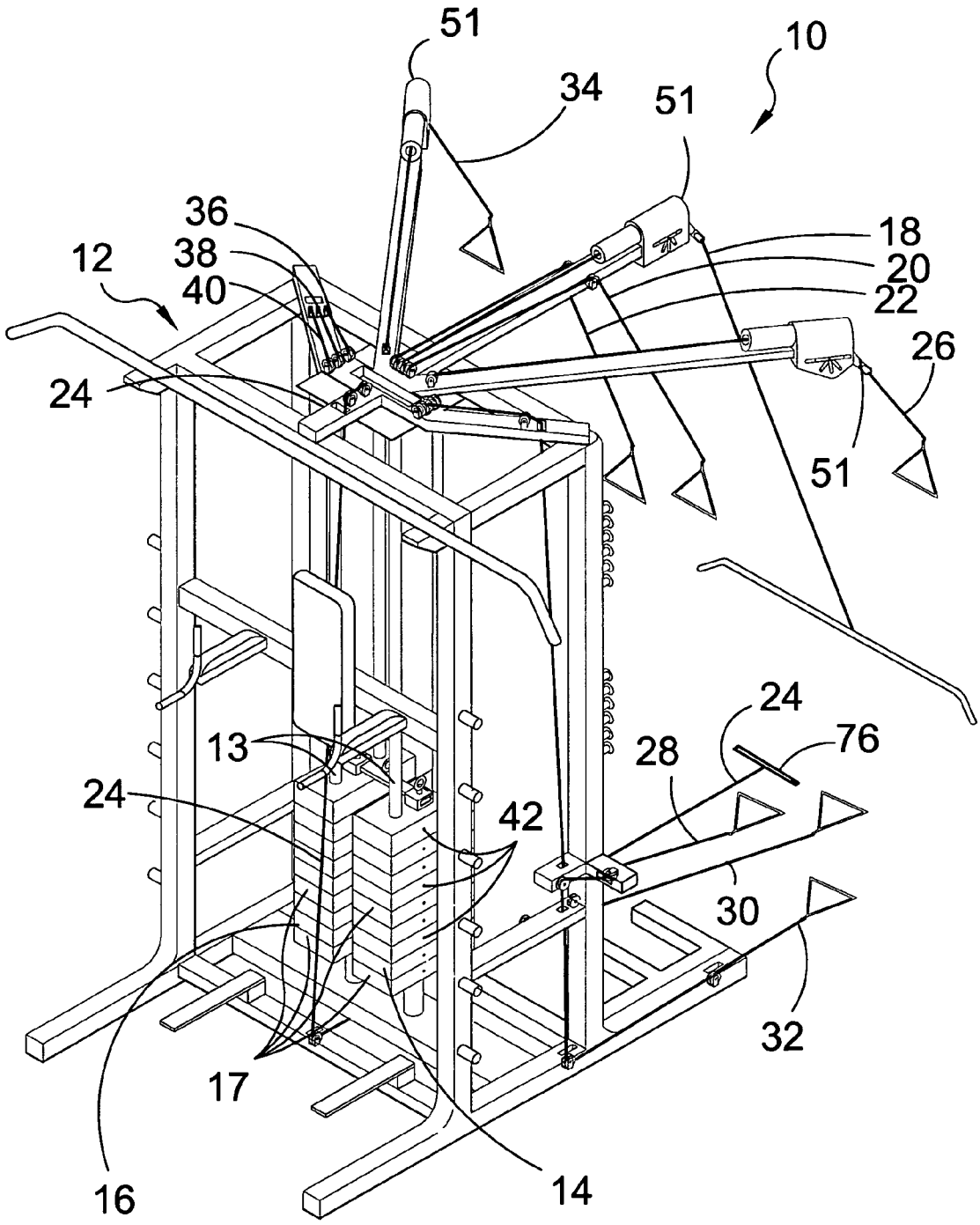

2003/0027696 A1* 2/2003 Baumler et al. ..... 482/99
2003/0096681 A1* 5/2003 Myers et al. ..... 482/94
2003/0176261 A1* 9/2003 Simonson et al. ..... 482/103
2004/0072659 A1* 4/2004 Alessandri et al. ..... 482/99
2004/0082443 A1* 4/2004 Britt ..... 482/94
2004/0198565 A1* 10/2004 Lines et al. ..... 482/99
2005/0130813 A1* 6/2005 Piane ..... 482/99
2005/0143228 A1* 6/2005 Lee ..... 482/94
2005/0164851 A1* 7/2005 Eisa ..... 482/94
2005/0164852 A1* 7/2005 Vandyke ..... 482/99
2005/0272573 A1* 12/2005 Carter ..... 482/99
2006/0019804 A1* 1/2006 Young ..... 482/93
2006/0019807 A1* 1/2006 Husted et al. ..... 482/128
2006/0040801 A1* 2/2006 Piane ..... 482/94
2006/0105888 A1* 5/2006 Piane ..... 482/94
2006/0111221 A1* 5/2006 Williams ..... 482/139
2006/0116253 A1* 6/2006 Nizam ..... 482/94
2006/0240956 A1* 10/2006 Piane ..... 482/94
2006/0287170 A1* 12/2006 Gerschefske et al. ..... 482/94
2007/0004569 A1* 1/2007 Cao ..... 482/94
2007/0054786 A1* 3/2007 Piane ..... 482/94
2007/0072748 A1* 3/2007 Lee ..... 482/93
2007/0087920 A1* 4/2007 Dachraoui et al. ..... 482/123
2007/0149366 A1* 6/2007 Kuo ..... 482/98
2007/0203001 A1* 8/2007 Krull ..... 482/94
2008/0051266 A1* 2/2008 Ish et al. ..... 482/99
2008/0096735 A1* 4/2008 Grider ..... 482/99
2008/0287270 A1* 11/2008 Carter ..... 482/99
2009/0023562 A1* 1/2009 LaMarque ..... 482/99

* cited by examiner

CABLE CROSS TRAINER APPARATUS

BACKGROUND OF THE INVENTION

1. Field of the Invention

The present invention relates generally to exercise devices and, more specifically, to a weight training device having a plurality of stations that enable the user to perform a vast array of exercises targeting different muscle groups. Variable resistance is provided by a pair of weight stacks having cables leading to the various stations and through the use of barbells at the barbell station.

2. Description of the Prior Art

There are other exercise apparatus devices. Typical of these is U.S. Pat. No. 4,390,179 issued to K. Z. Szkalak on Jun. 28, 1983.

Another patent was issued to A. Salyer on Oct. 29, 1985 as U.S. Pat. No. 4,549,733. Yet another U.S. Pat. No. 4,632,388 was issued to J. J. Schleffendorf on Dec. 30, 1986 and still yet another was issued on Oct. 6, 1987 to G. L. Rockwell as U.S. Pat. No. 4,697,809.

Another patent was issued to P. E. Mahnke on May 17, 1988 as U.S. Pat. No. 4,744,559. Yet another U.S. Pat. No. 4,775,146 was issued to G. Stankovic on Feb. 6, 1990. Another was issued to A. B. Ish, III et al. on Feb. 13, 1990 as U.S. Pat. No. 4,900,018 and still yet another was issued on May 7, 1996 to C. S. Hu as U.S. Pat. No. 5,514,060.

Another patent was issued to R. R. Simonson on May 21, 1996 as U.S. Pat. No. 5,518,477 and U.S. Pat. No. 5,549,530 was issued to K. Fulks on Aug. 27, 1996. Another was issued to A. B. Ish, III on Jul. 14, 1998 as U.S. Pat. No. 5,779,601.

U.S. Pat. No. 4,390,179

Inventor: Kalman Z. Szkalak

Issued: Jun. 28, 1983

Exercising apparatus includes a structural framework having a number of positions for the stationing of different types of exercising machines. Each of the machines is of the type which employs a pulley system to lift a variable weight. All of the pulley systems share a common central pulley which is pivotally attached to the framework. A single rope or cable is attached to the variable weight, passes through the central pulley, and is removably attachable to the appropriate component of each of the exercise machines. The pivoting central pulley thus allows the weight to be selectively attached to the desired machine by means of the cable.

U.S. Pat. No. 4,549,733

Inventor: Alan Salyer

Issued: Oct. 29, 1985

A cable exercise machine has the capability for allowing a user to perform various exercises by the lifting and lowering of weights by means of a cable. The cable is tethered at opposite ends on the frame of the machine and it passes through a sheave assembly and a sheave block assembly. The user pulls on the sheave block assembly to lift the weights. The sheave assembly is adjustably positionable on the frame of the machine to different positions and is operatively related with the cable and the sheave block assembly such that the sheave block assembly hangs free from the sheave assembly substantially the same amount for all adjustment positions of the sheave block assembly on the frame so that the user can remain in the same position relative to the machine for all adjustment positions of the sheave assembly. Additional exercise stations are provided, a seat and bench station, and a leg exercise station. These have adjustment capabilities and may be used in conjunction with the cable-operated weights.

U.S. Pat. No. 4,632,388

Inventor: John J. Schleffendorf

Issued: Dec. 30, 1986

An exercise device comprises weights, cables and pulleys, which allows for the exercising of a wide range of muscle groups by the rearrangement of the cables on a single weight machine. A cable carrying the weights passes over a first pulley and has a second pulley attached to its free end. A second cable passes through the second pulley and is anchored at one end and has a handle on its free end. When the handle is pulled during an exercise, the second pulley and first cable are moved, thus lifting the weights.

U.S. Pat. No. 4,697,809

Inventor: Gary L. Rockwell

Issued: Oct. 6, 1987

A cable-operated exercising apparatus having at least two mechanisms for lifting a downwardly biased, vertically guided carriage. At least one of the lifting mechanisms is a cable which is maintained taut when the carriage is lifted by the other lifting mechanism so as not to become entangled with the apparatus.

U.S. Pat. No. 4,744,559

Inventor: Parker E: Mahnke et al.

Issued: May 17, 1988

A free-standing multi-station progressive resistance exercise apparatus which is small, light weight, highly versatile and easy to use. The apparatus includes a main frame comprising a central guide column, a carriage movable upwardly and downwardly along the central guide column, a stack of weights disposed below the carriage, a selector bar extending between the weights and the carriage for interconnecting a selected number of weights with the carriage, a body engaging handlebar connected to the carriage for vertical movement of the carriage relative to the guide column; a second frame including back to back guide tracks for guiding the vertical travel of first and second sheaves and first and second cable systems operably connected to a plurality of remote body engaging members for use in performing a wide variety of arm and leg exercises, the cable systems interconnecting the body engaging members with the weights via the sheaves and the carriage.

U.S. Pat. No. 4,775,146

Inventor: Gus Stankovic

Issued: Oct. 4, 1988

A multifunction physical fitness machine has two similar generally rectangular frames standing upright in laterally spaced apart relation to define the narrow ends of a rectangular floor area for usually one but possibly three exercising persons. Each frame contains a stack of weights which are constrained to move vertically only and there is a pulley and cable system for an exerciser to lift the weights. A third rectangular frame stands upright on a laterally and vertically extending plane that is coincident with the long rear side of said rectangular area. The third frame is fixed midway between the two end frames and these frames have stacks of weights and pulley and cable systems for an exerciser to lift the weights. Structural members tie all three frames together at their upper ends.

U.S. Pat. No. 4,898,381

Inventor: Joel D. Gordon

Issued: Feb. 6, 1990

A home gym system (100) is provided for performing weight lifting exercises with a load resistance (160, 164) coupled to a cable (132). The home gym system (100) includes a main frame (110) to which is pivotedly coupled at least one extension frame (120). A guide arm assembly (130) is slidingly coupled to frame extension (120) and vertically displaceable thereon. Vertical displacement of guide arm assembly (130) is made substantially effortless by a counter weight system (140) coupled to guide arm assembly (130) by a flexible member (141). Counter weight system (140) includes a floating pulley system (145) to compensate for changes in cable path length which result from the vertical displacement of guide arm assembly (130). Additionally, guide arm assembly (130) includes a system for increasing the load resistance by varying the mechanical advantage of the cable system. The change in mechanical advantage is accomplished by coupling the releasable coupling (192) at the exit end of cable (132) to the pivotable arm member (172) allowing the cable to be withdrawn from guide arm assembly (130) by displacement of both the exit end of cable (132) and a portion of cable (132) from a position intermediate a first pulley assembly (134) by a second pulley assembly (136), when pivotal arm member (172) is displaced.

U.S. Pat. No. 4,900,018

Inventor: Arthur B. Ish, III

Issued: Feb. 13, 1990

An exercise machine has multiple stations at each of which two or more exercises are performed in opposition to a selected amount of weight in a weight stack. A cable and pulley system connects the exercise apparatus at the exercise stations with the weight stack in such a manner that only one pull cable in the system is connected to the weight stack.

U.S. Pat. No. 5,514,060

Inventor: Chang-Sung Hu

Issued: May 7, 1996

A multi-station exercise machine frame structure comprising a base support assembly which supports a number of columns for accommodating individual exercise units or stations. The base support assembly is constructed of cross beams connected between bottom parts of associated columns. Expansion of the machine to include one or more additional exercise units or stations is accomplished by adding corresponding columns and connecting additional cross beams of similar construction. In another aspect, a module for a butterfly unit is provided which comprises tilted inlet and outlet pulleys to facilitate a smooth operation of pivoting rods in performing a butterfly exercise.

U.S. Pat. No. 5,518,477

Inventor: Roy R. Simonson

Issued: May 21, 1996

A cable and pulley system for a multi-station exercise machine involving a tensioned cable led over a series of pulleys, at least one of which is a cradled pulley normally nested in a cradle and radially held in the cradle by the force of the tension on the tensioned cable and radially movable out of the cradle by a greater force applied to the cradled pulley by a second pull cable mechanically connected to the cradled pulley and functioning to move the cradled pulley radially out of its cradle when sufficient tensional force is applied to the second cable to overcome the tension applied to the cradled pulley by the tensioned cable. Additional exercise stations can be added to operate with additional cables and cradled pulleys without changing the manner of operation of other cables and exercise stations.

U.S. Pat. No. 5,549,530

Inventor: Kent Fulks

Issued: Aug. 27, 1996

A compact weight lifting machine includes a lift bar assembly including a lift cable and a lift bar which operates through the lift cable to lift selected weights from a weight stack responsive to either upward or downward movement of the lift bar. A seat assembly is positioned beneath the lift bar and includes first and second sections selectively positionable to support a user to perform a variety of exercises. A leg extension/leg curl mechanism located at one end of the seat assembly and a butterfly mechanism located at the opposite end of the seat assembly also operate through the lift cable to lift selected weights from the weight stack.

U.S. Pat. No. 5,779,601

Inventor: A. Buell Ish, III

Issued: Jul. 14, 1998

A multi-station exercise machine in which each of the exercise stations is interconnected with a weight stack using a reeving system having corner frame with right and left wings at right angles to one another. High and low pull cables in the reeving system extend from the corner frame. The wings have butterfly and press stations at their outer end. The press station connects to the reeving system via a horizontal extension member which turns responsive to swinging of a press arm. An adjustment linkage permits the starting position of the press arm to be varied by operation of a lever at the press station. An adjustable bench with a leg exercising mechanism is optionally used at the press station as only a bench, or is used in a diagonal position at which the leg exercising mechanism is connected to the low pull cable.

U.S. Pat. No. 6,238,323

Inventor: Roy R. Simonson

Issued: May 29, 2001

A highly versatile exercise apparatuses is disclosed. More particularly, the invention relates to a cable crossover exercise apparatus including a central weight stack and opposed extension arms. The invention also relates to a functional lift exercise apparatus including a central weight stack and substantially parallel extension arms. The invention further relates to a cable type exercise apparatus employing a pulley assembly with a 4:1 load ratio.

While these exercise devices may be suitable for the purposes for which they were designed, they would not be as suitable for the purposes of the present invention, as hereinafter described.

SUMMARY OF THE PRESENT INVENTION

A primary object of the present invention is to provide a weight training device having a plurality of stations that enable the user to perform a vast array of exercises.

Another object of the present invention is to provide a weight training device having a plurality of stations that enable the user to perform a vast array of exercises targeting different muscle groups.

Yet another object of the present invention is to provide variable resistance by a pair of weight stacks having cables leading to the various stations and through the use of barbells at the barbell station.

Additional objects of the present invention will appear as the description proceeds.

The present invention overcomes the shortcomings of the prior art by providing a weight-training device having a plurality of stations that enable the user to perform a vast array of exercises targeting different muscle groups. Variable resistance is provided by a pair of weight stacks having cables leading to the various stations and through the use of barbells at the barbell station.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

Figure 1A:
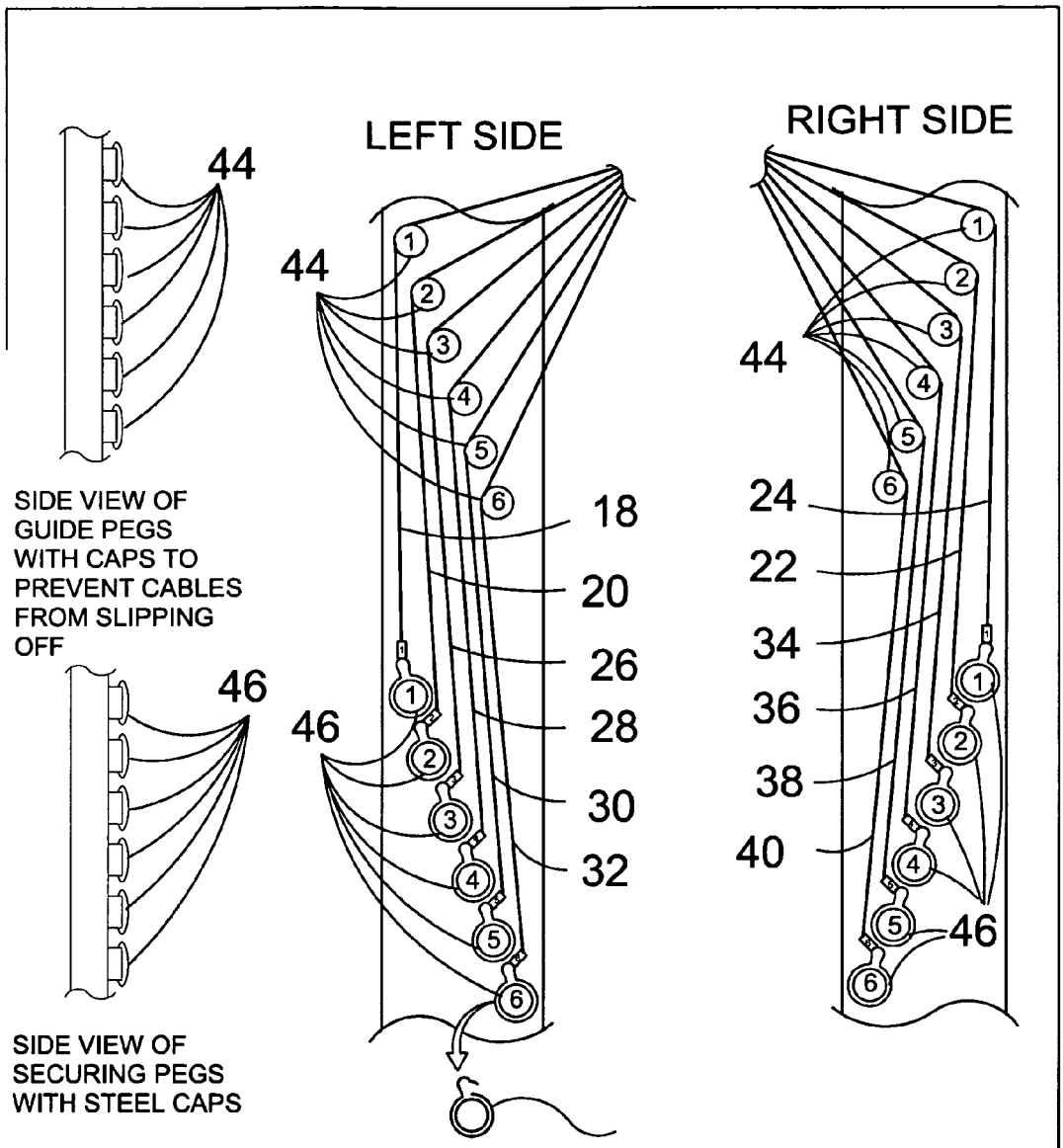
Figure 1B:
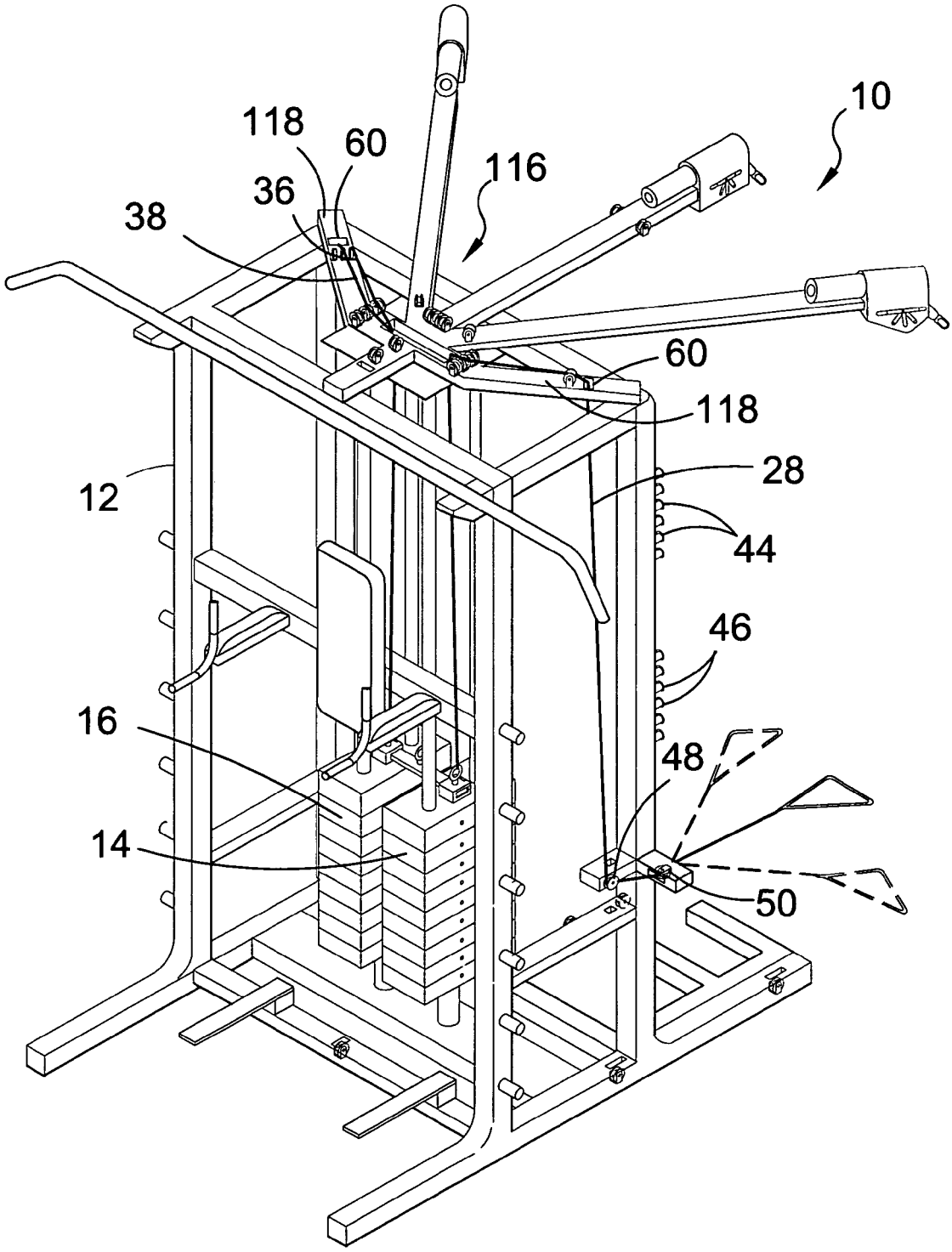
Figure 1C:
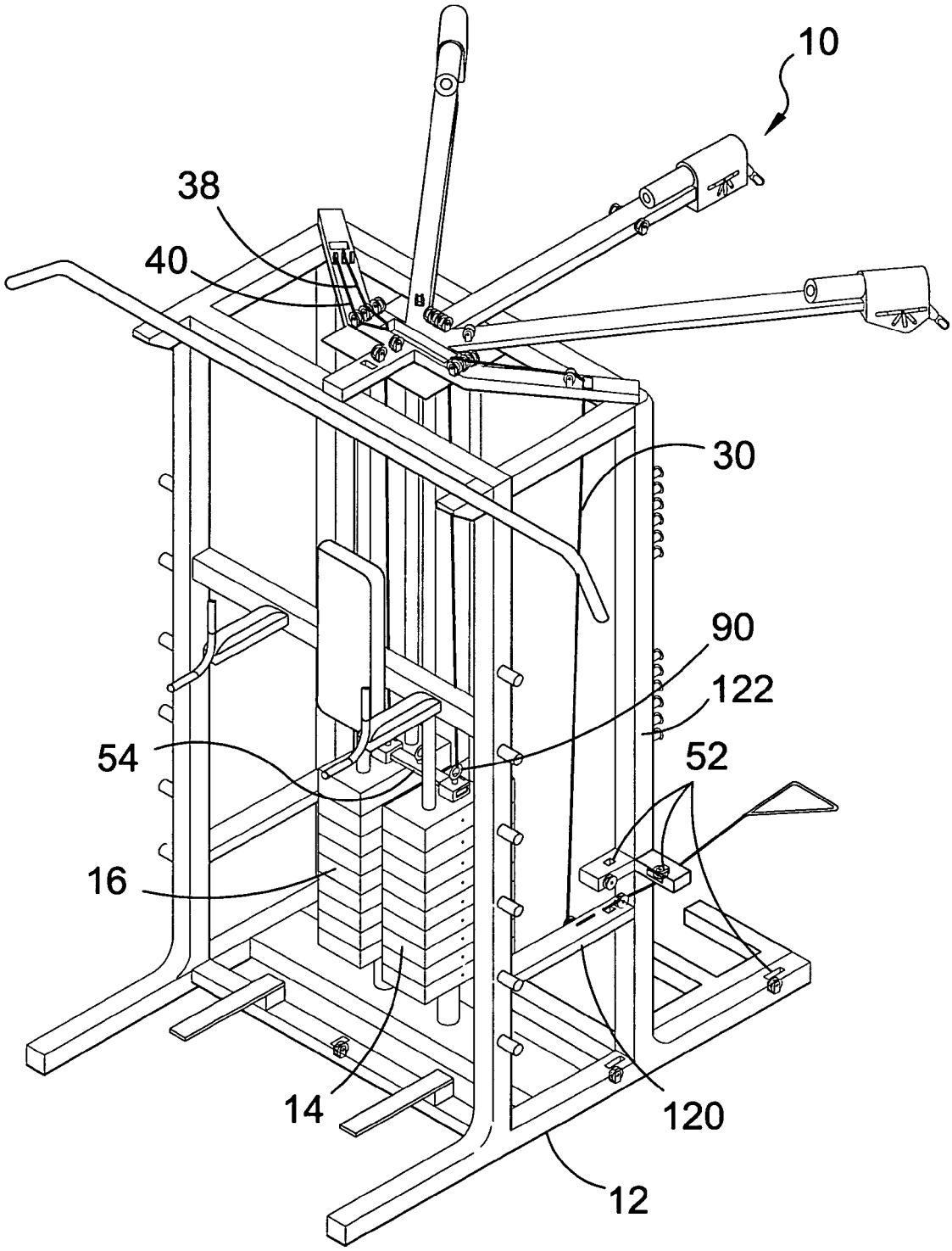
Figure 1D:
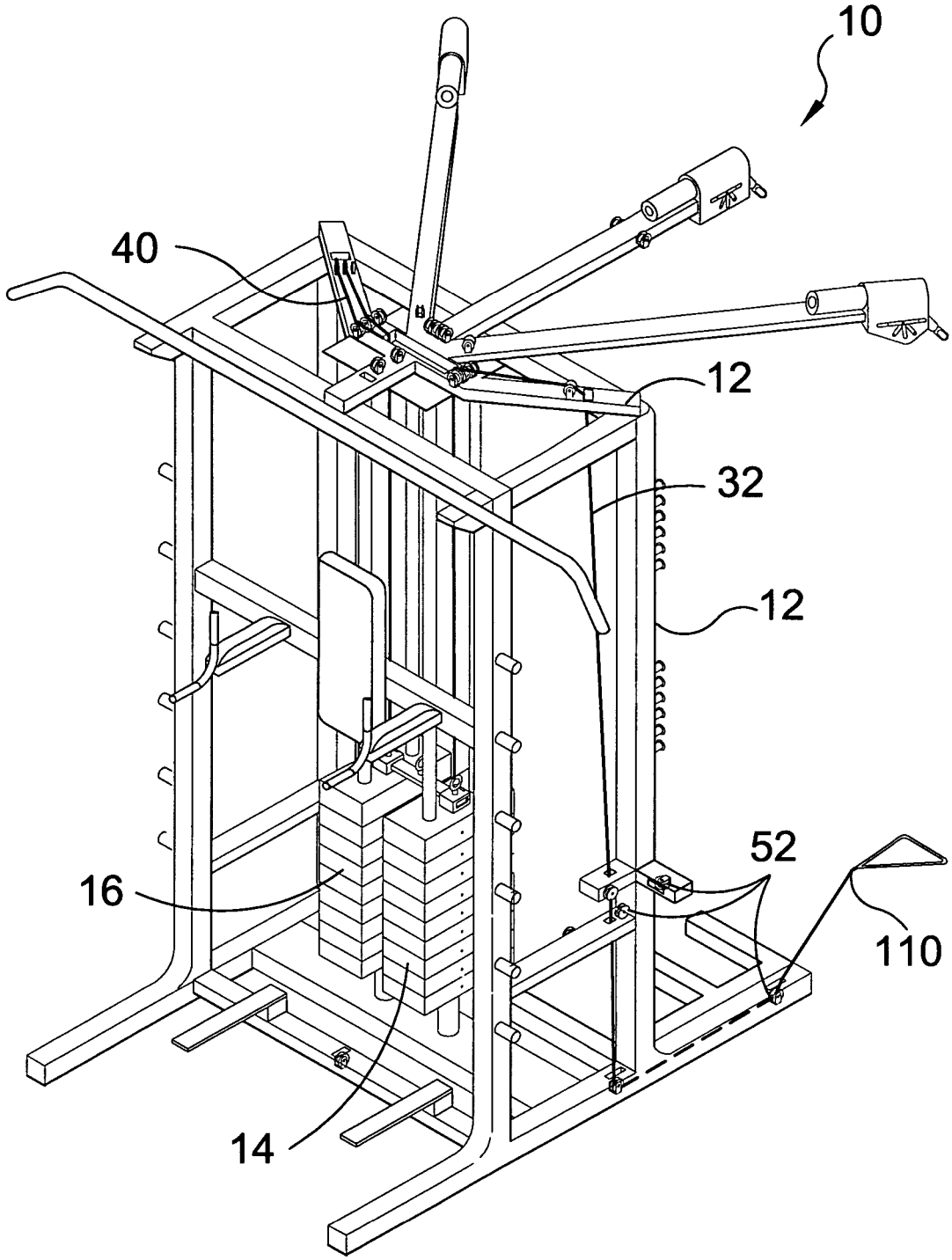
Figure 1E:
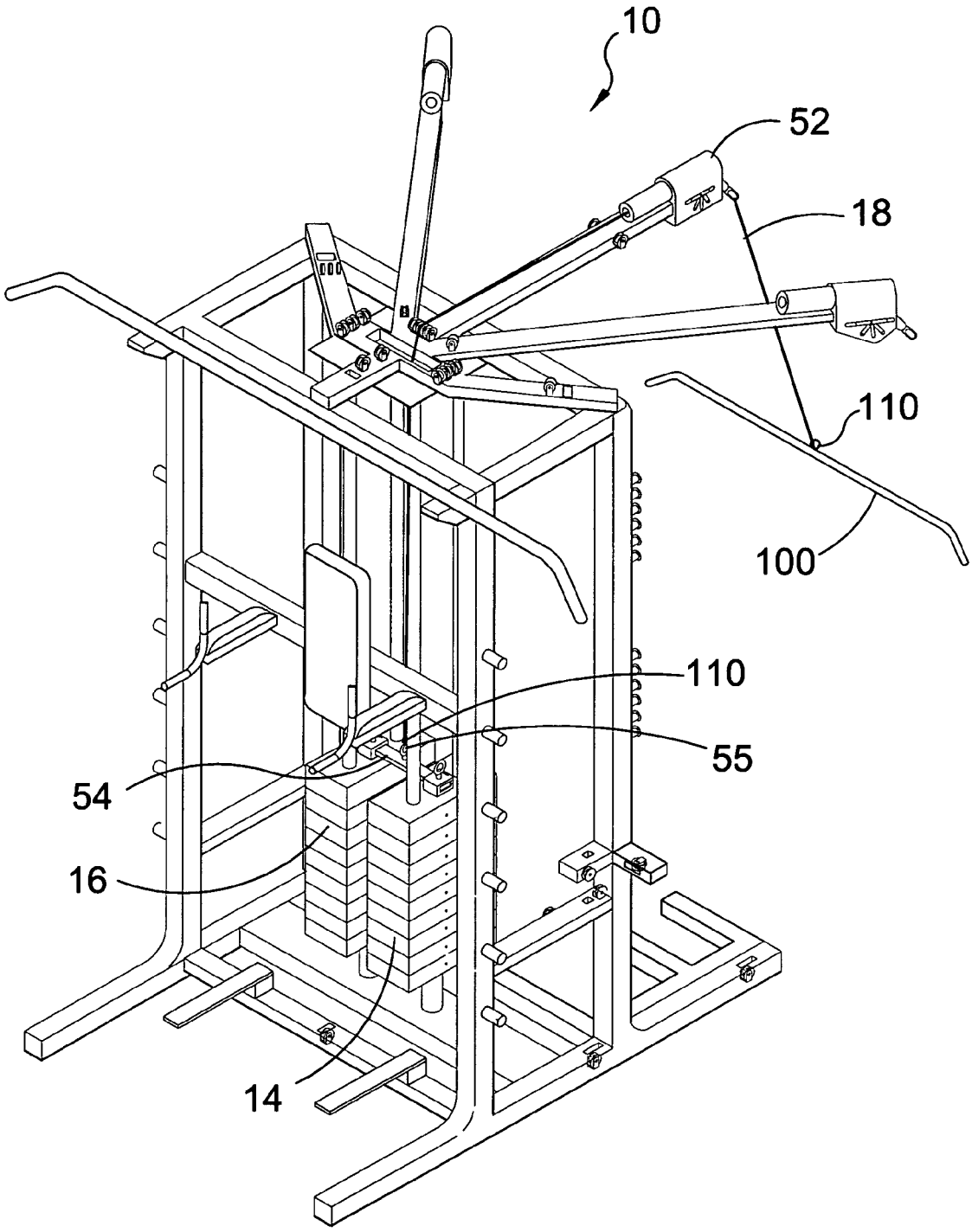
Figure 1F:
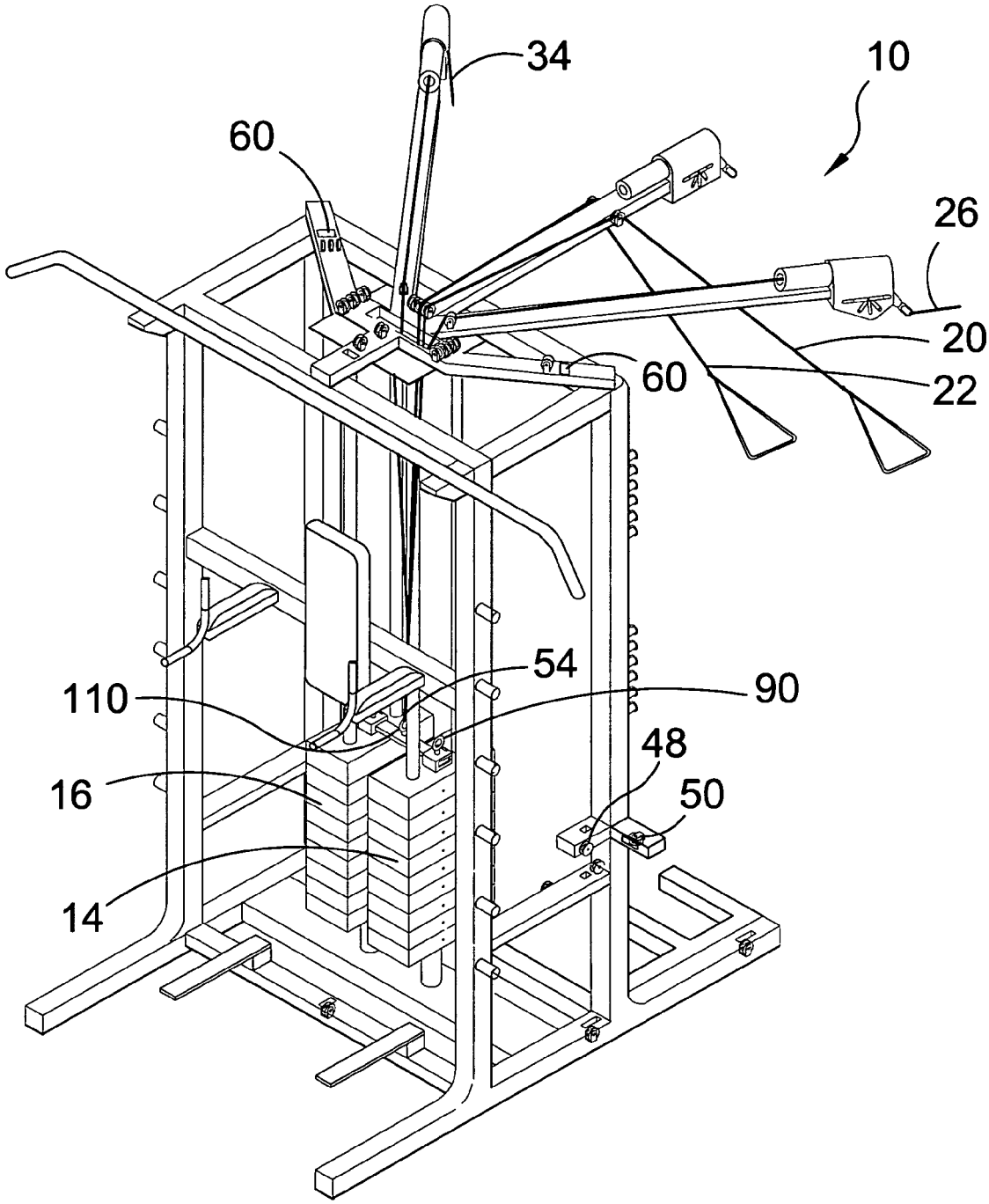
Figure 1G:
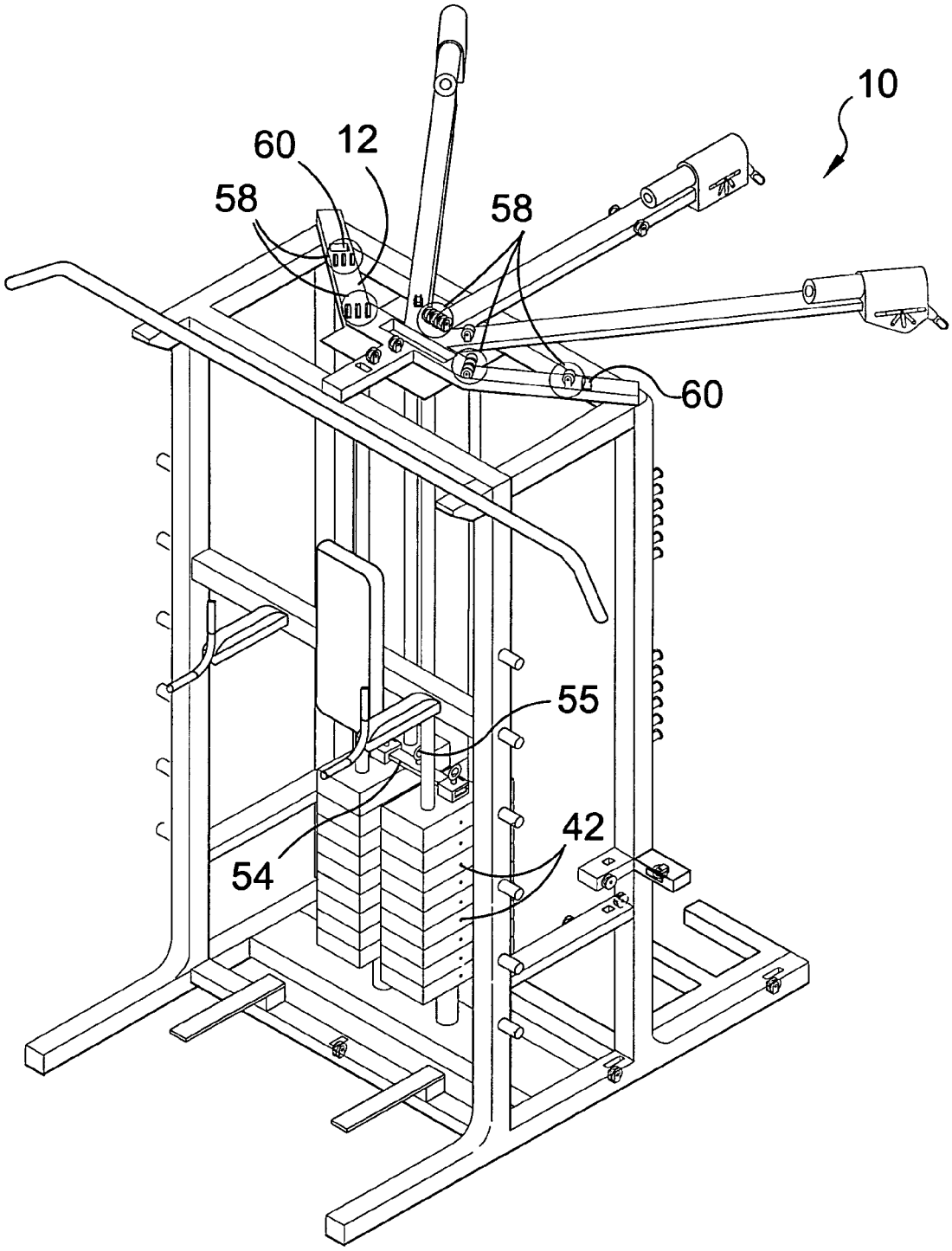
Figure 1H:
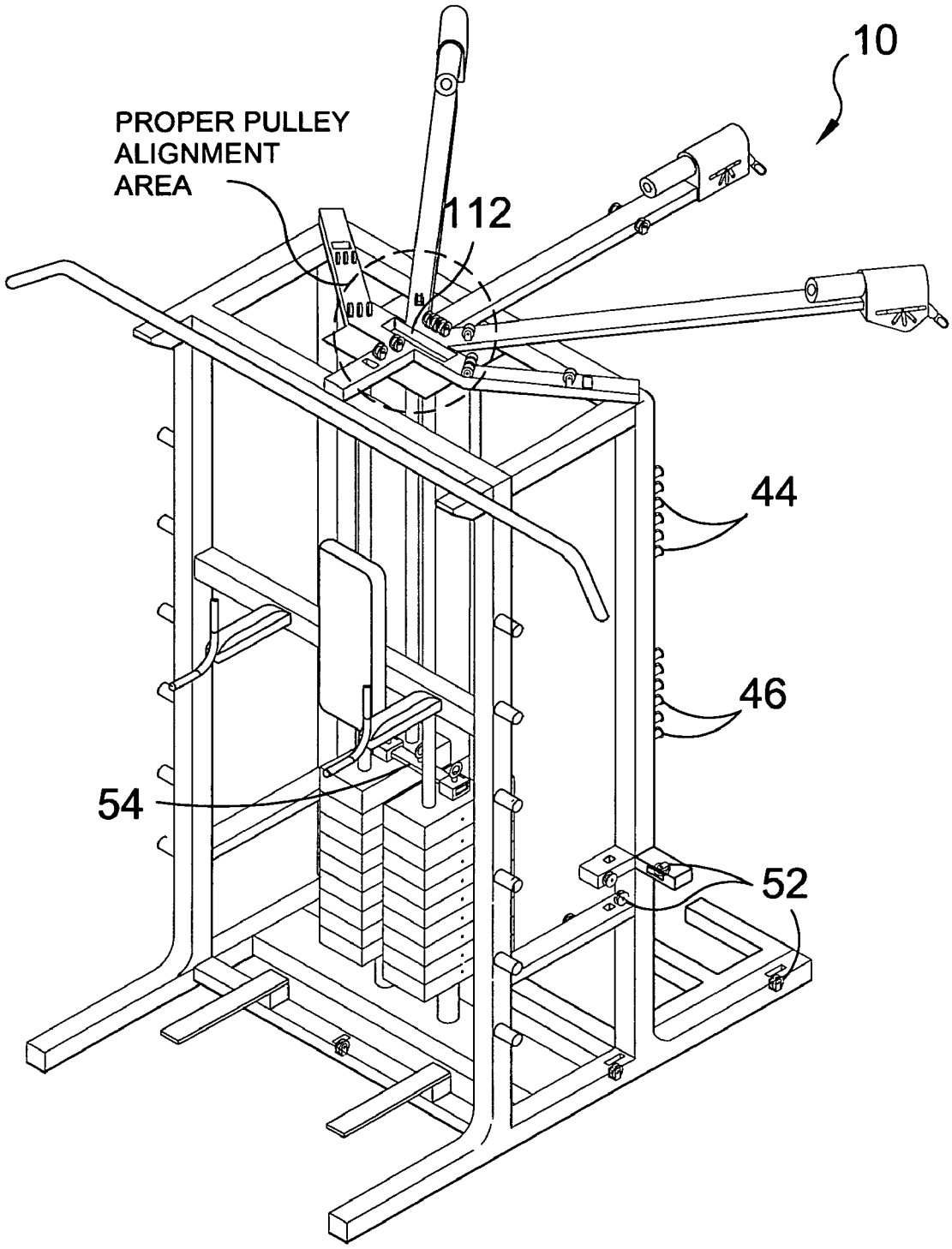
Figure 11:
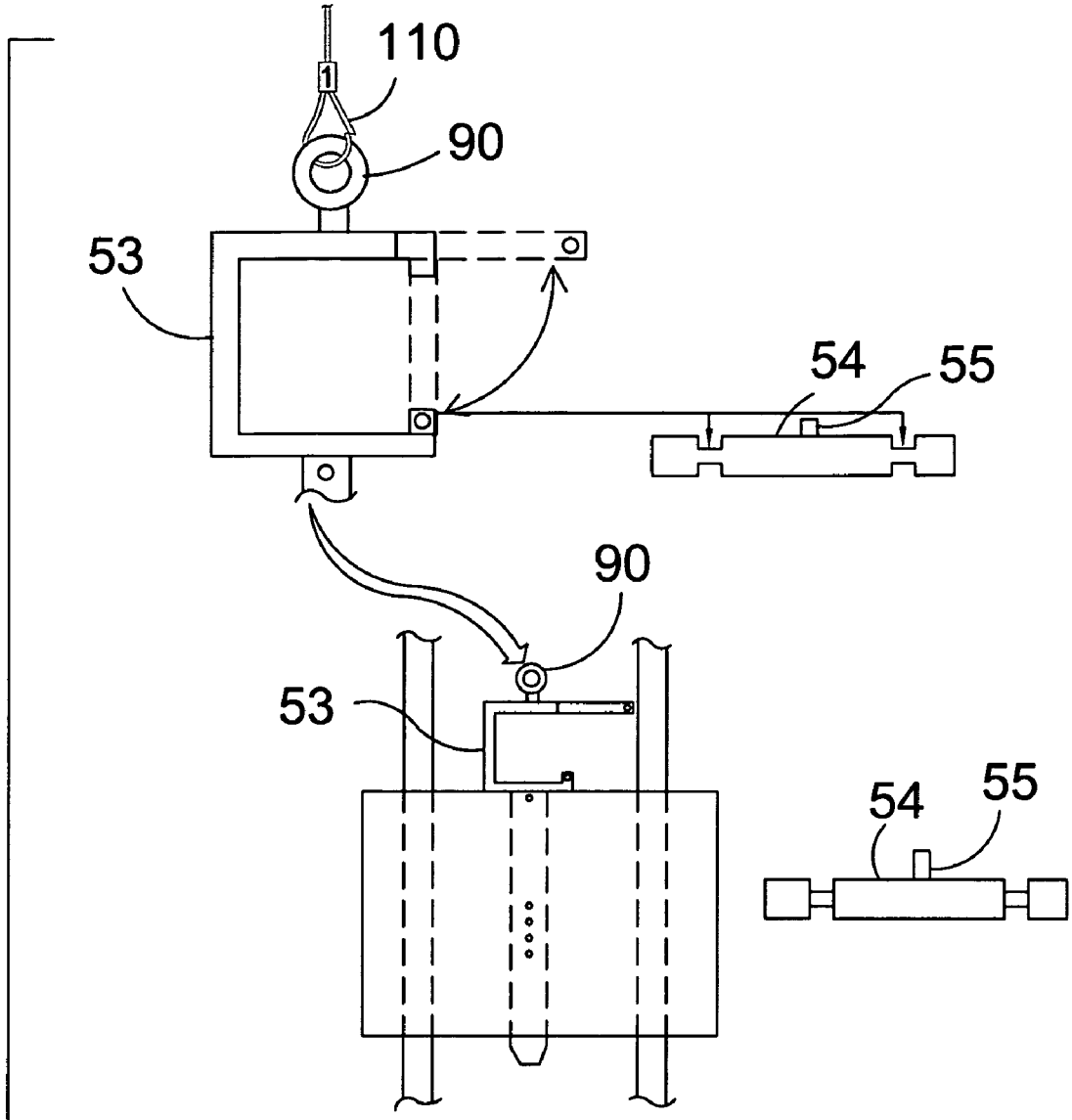
Figure 2:
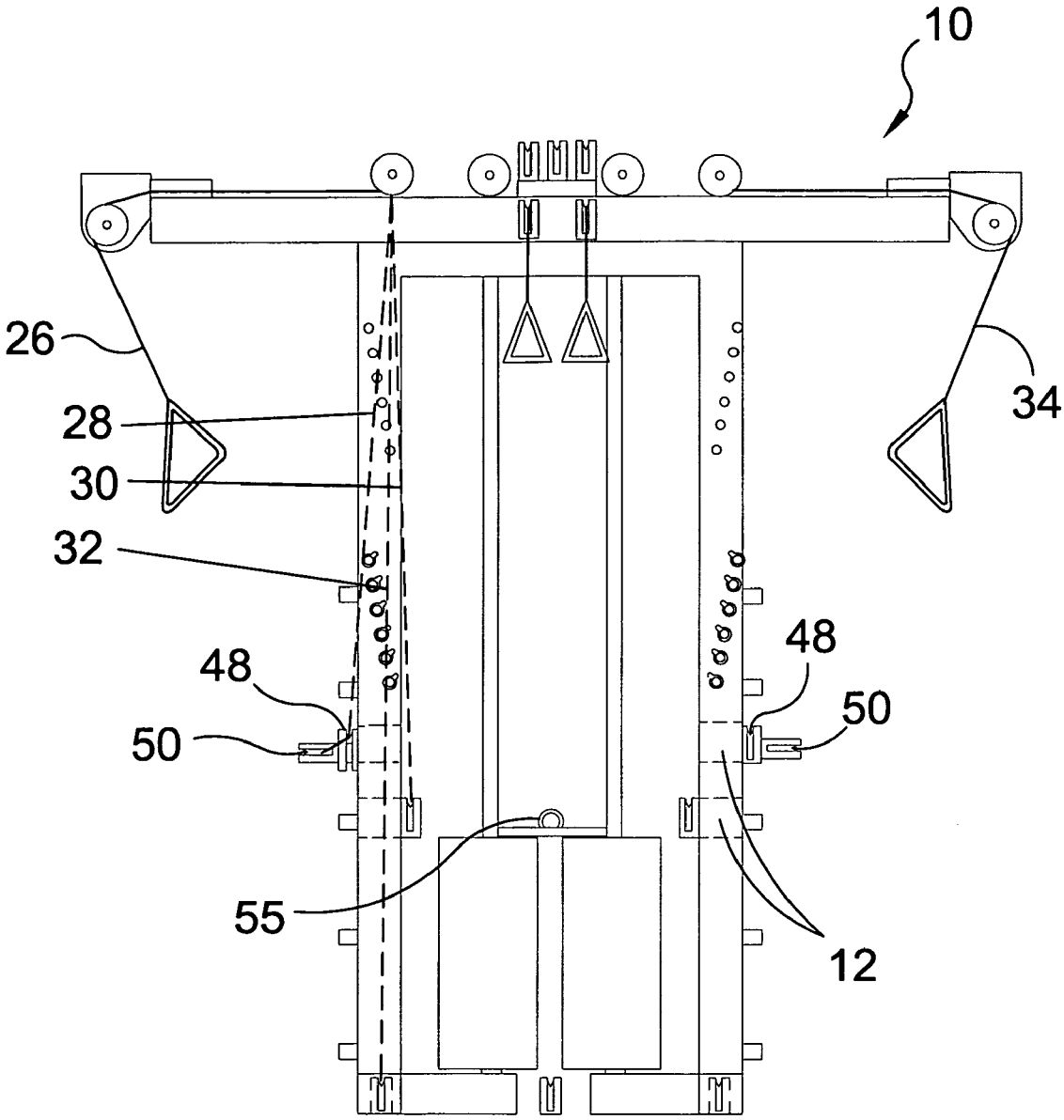
Figure 3A:
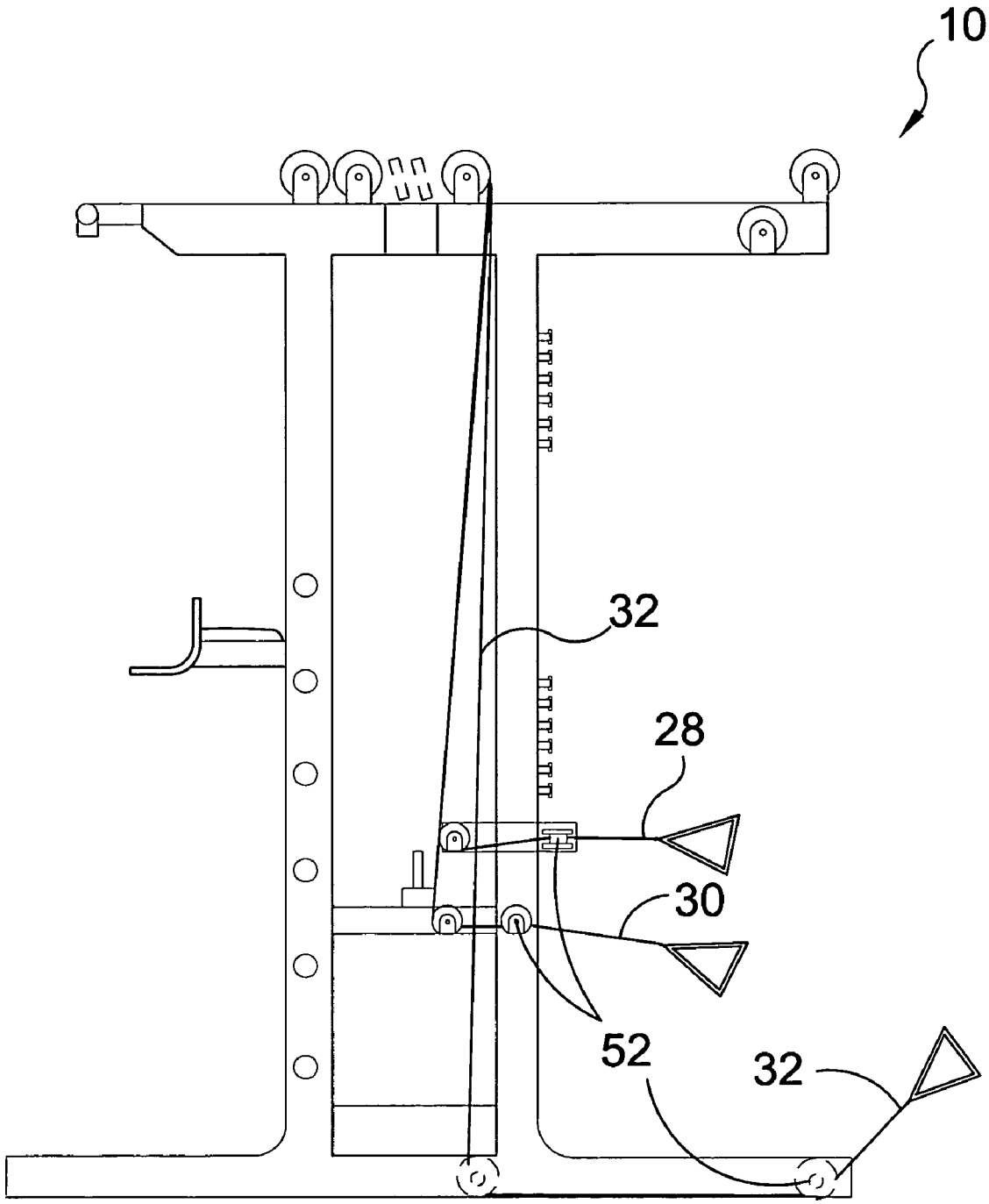
Figure 3B:
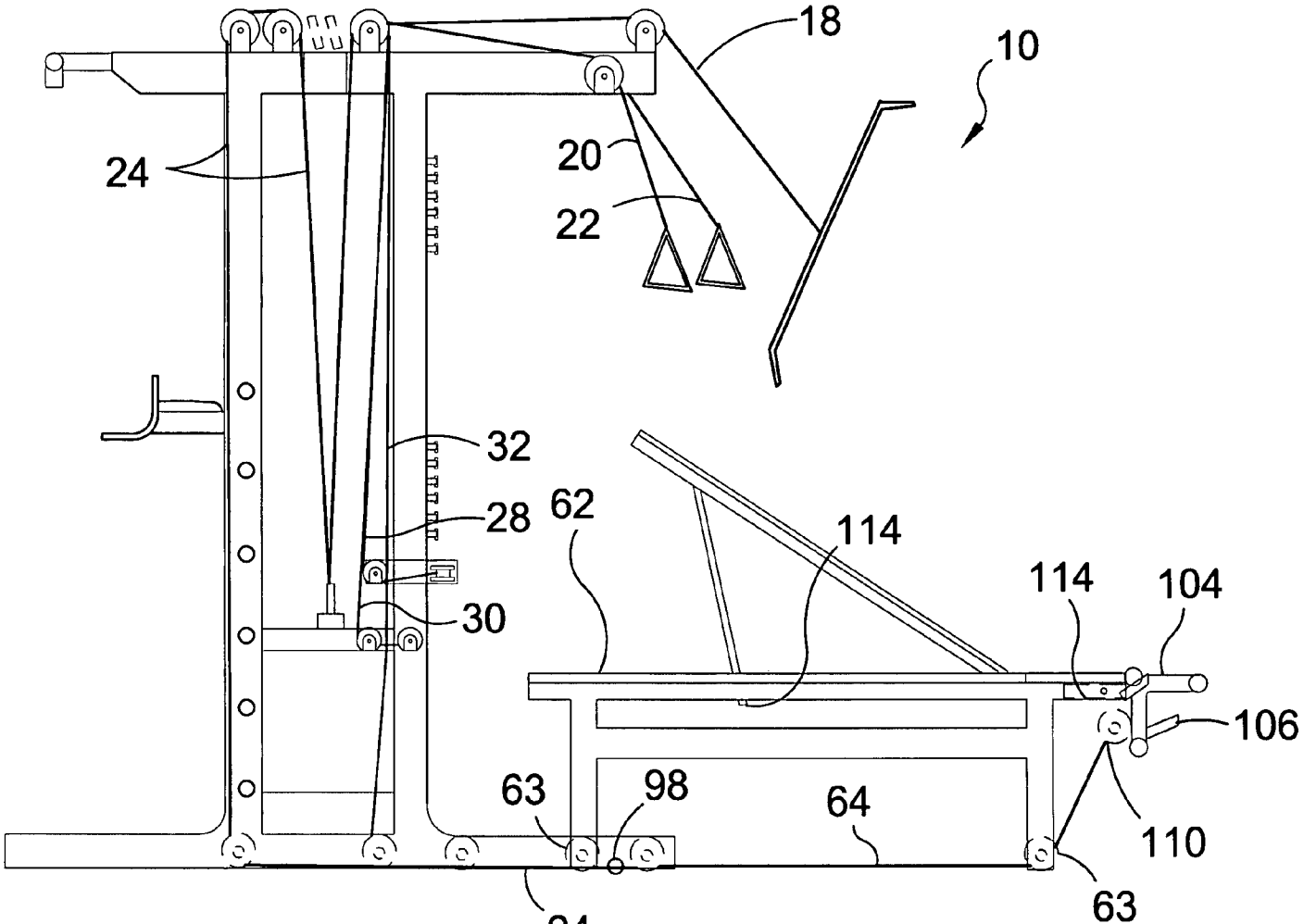
Figure 3C:
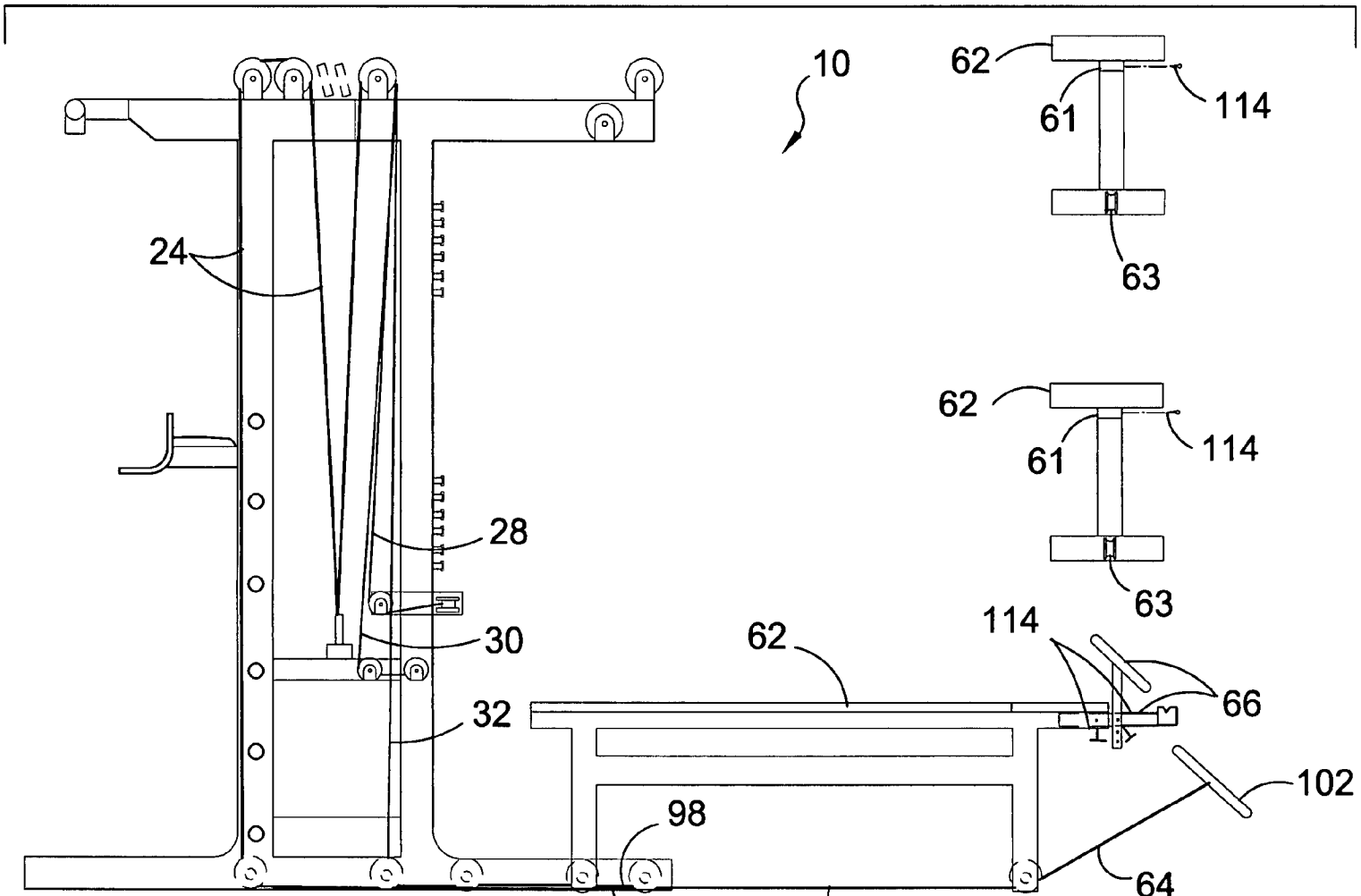
Figure 3D:
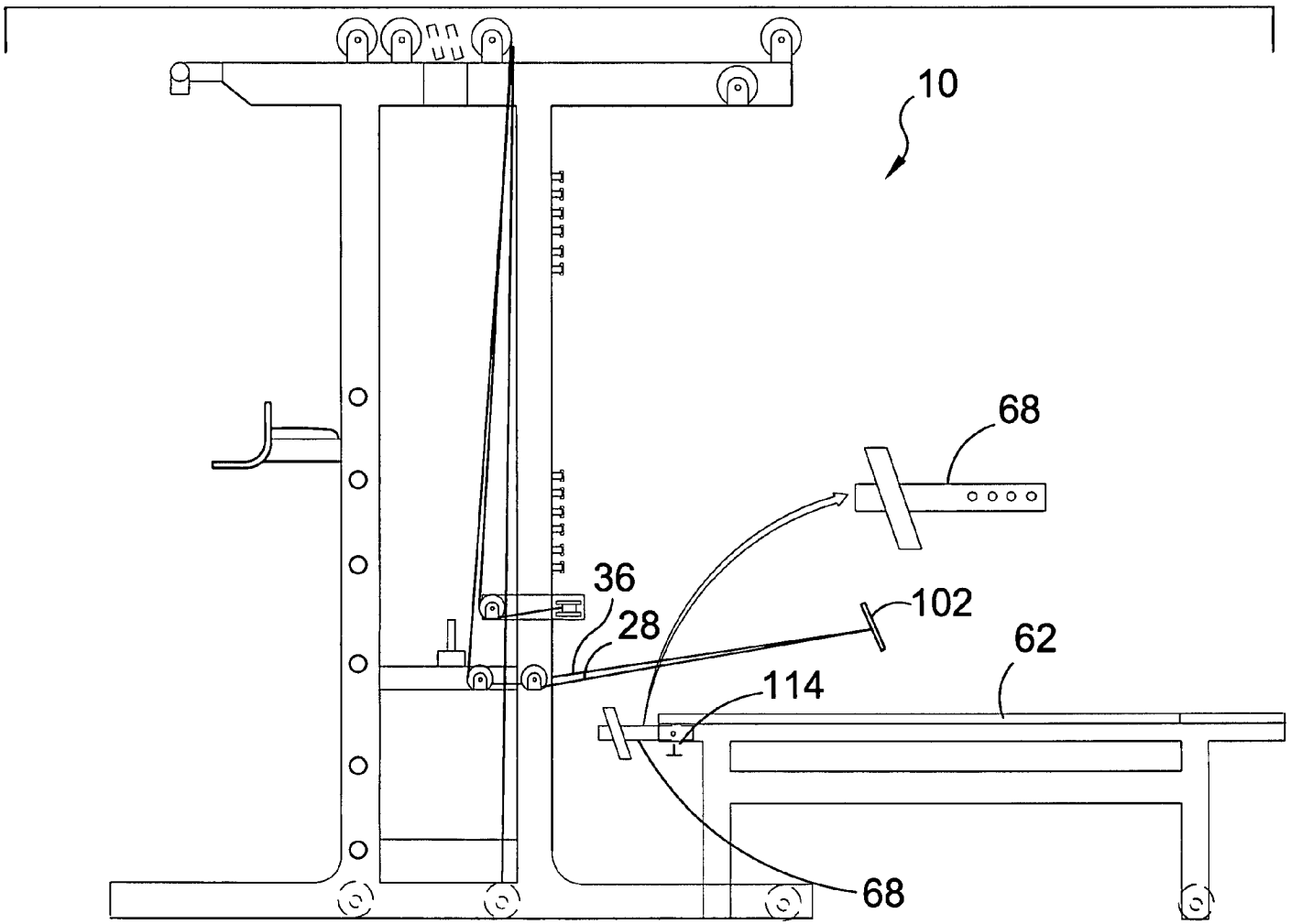
Figure 3E:
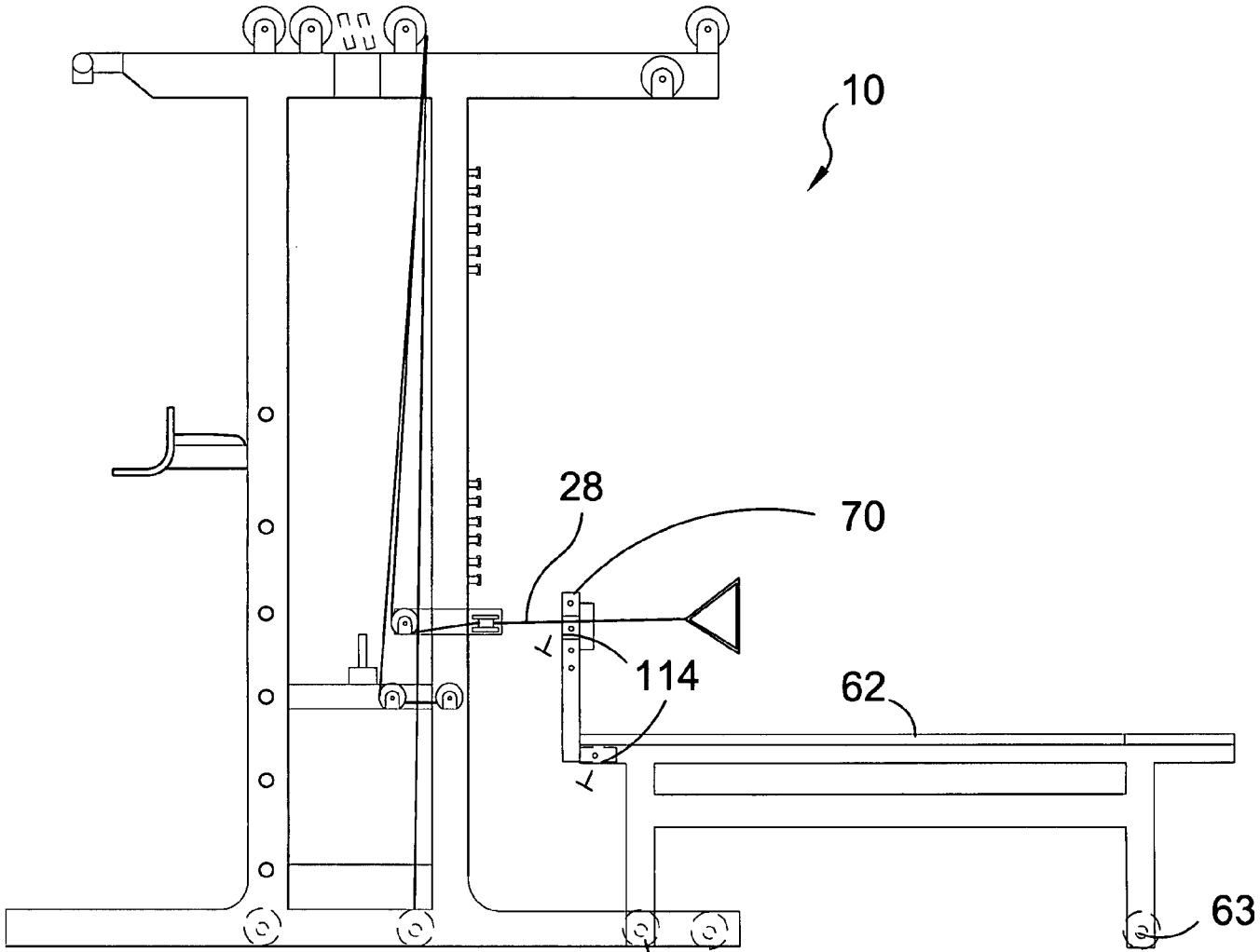
Figure 3F:
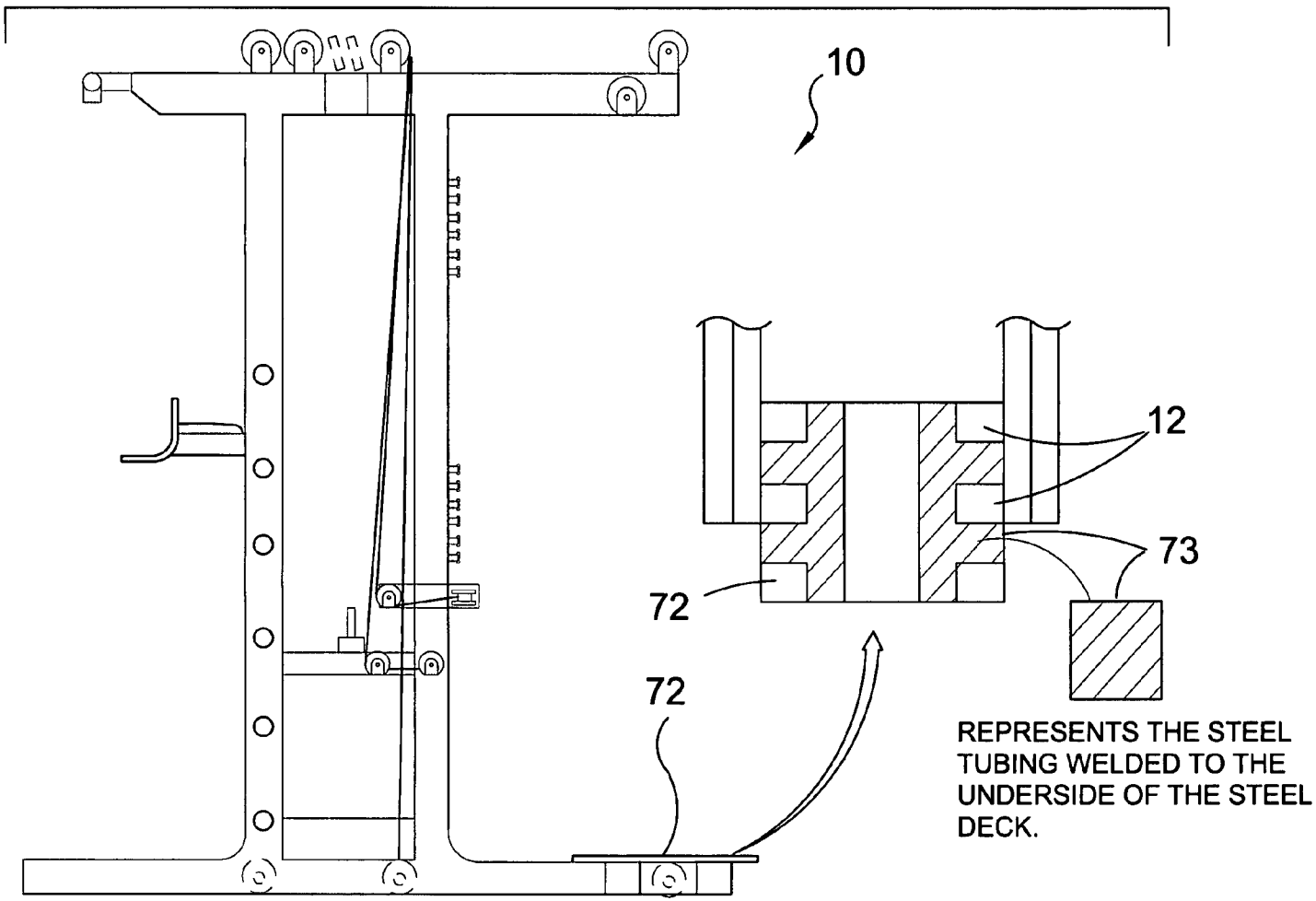
Figure 3G:
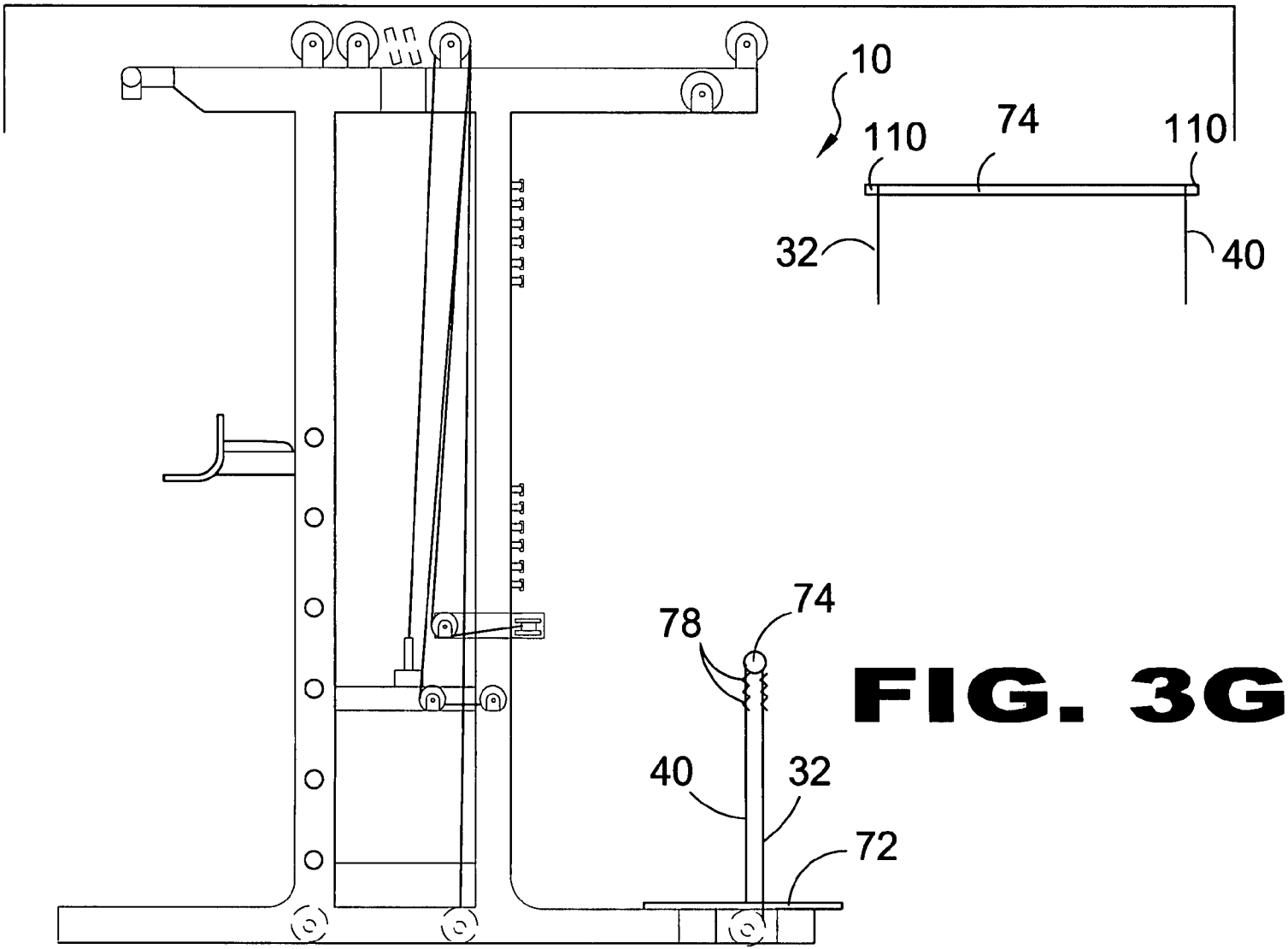
Figure 3H:
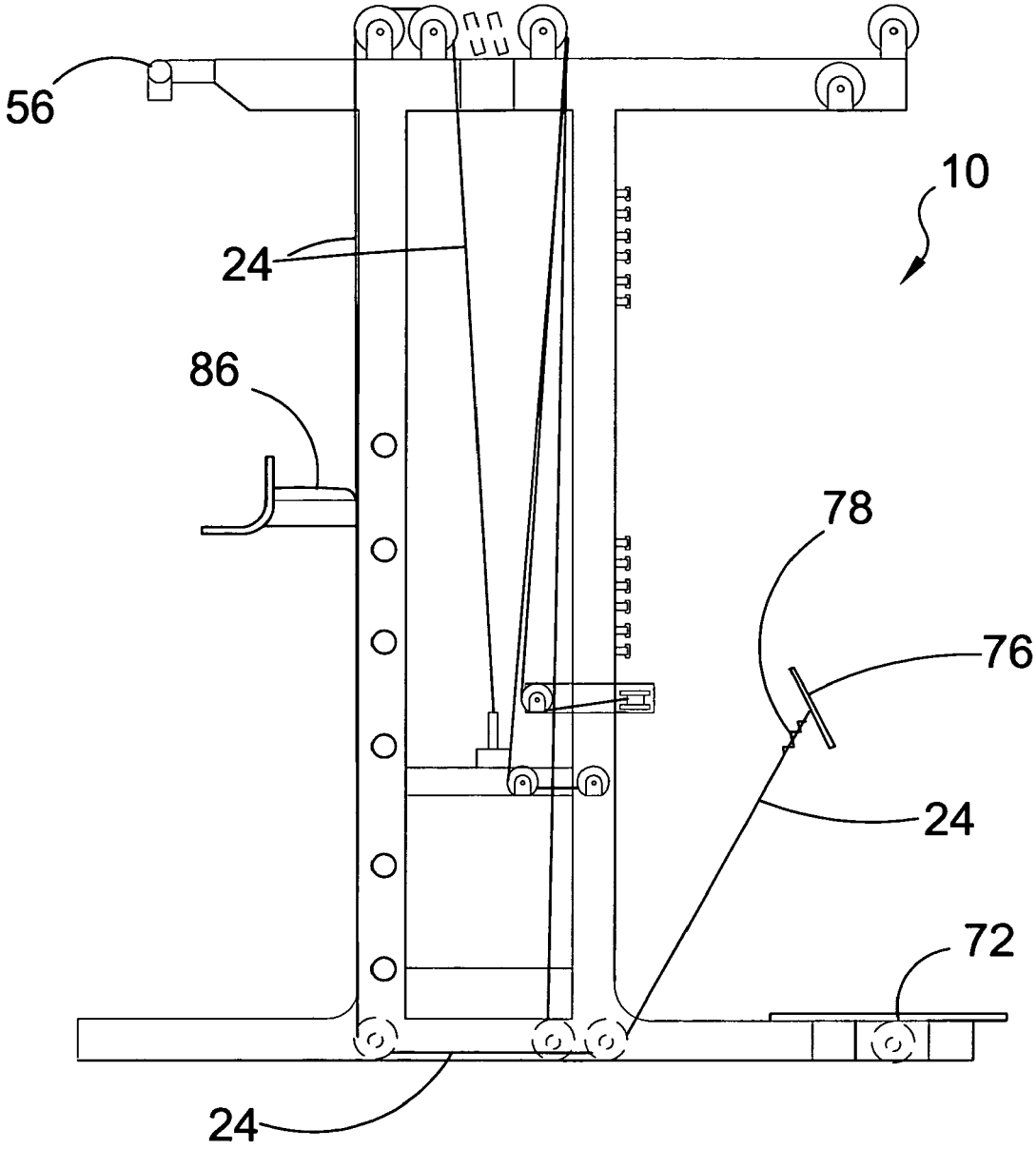
Figure 31:
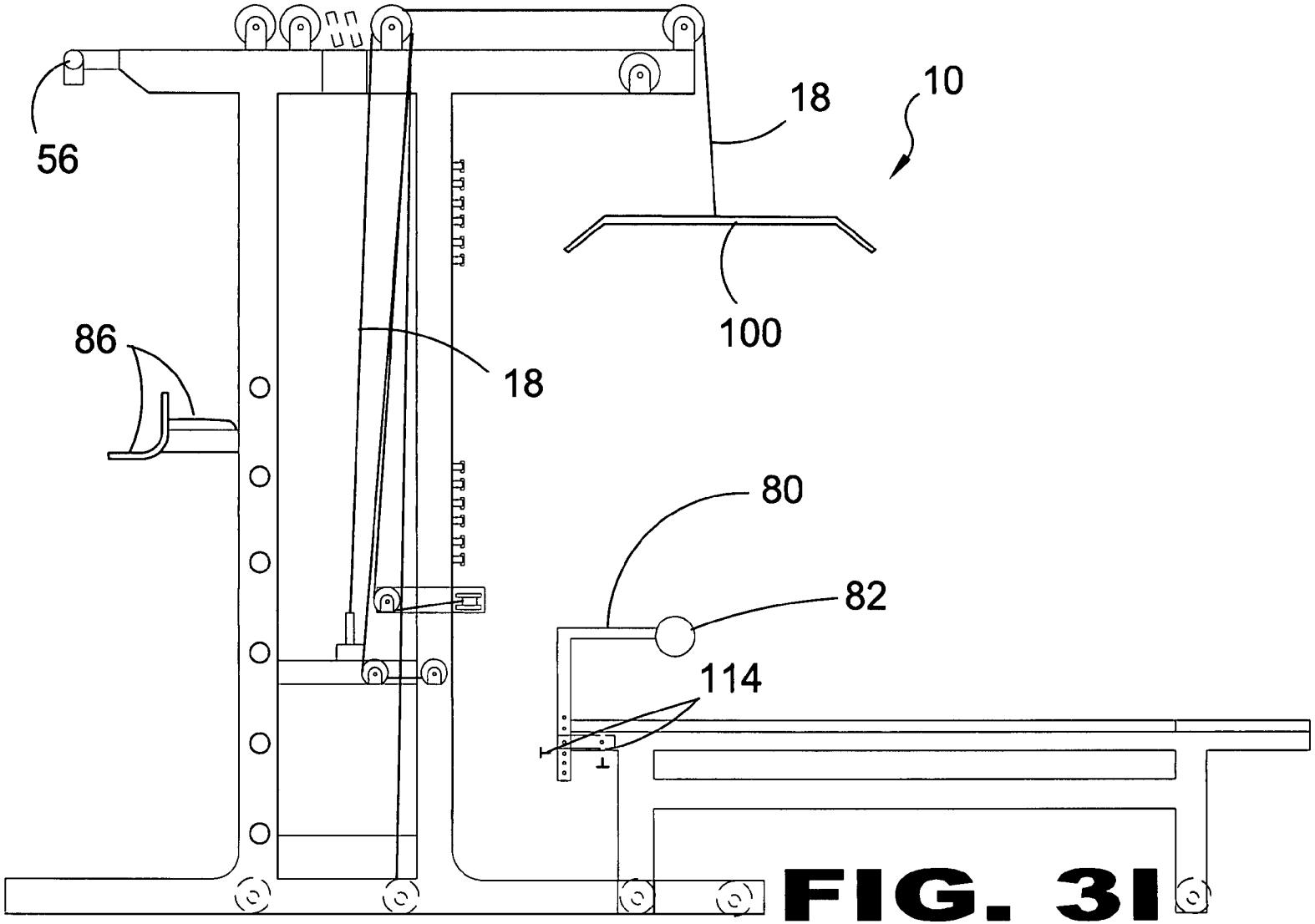
Figure 4A:
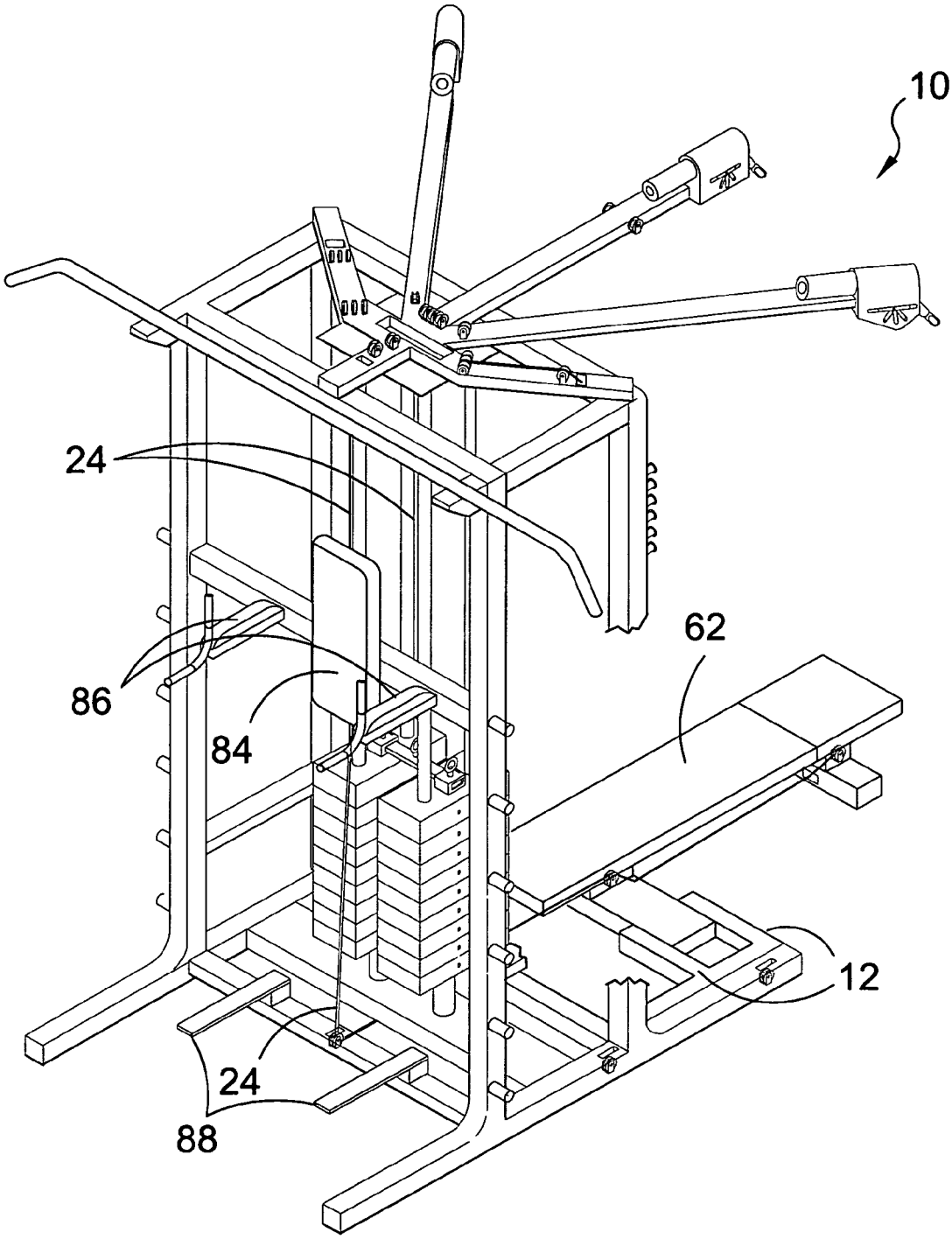
Figure 4B:
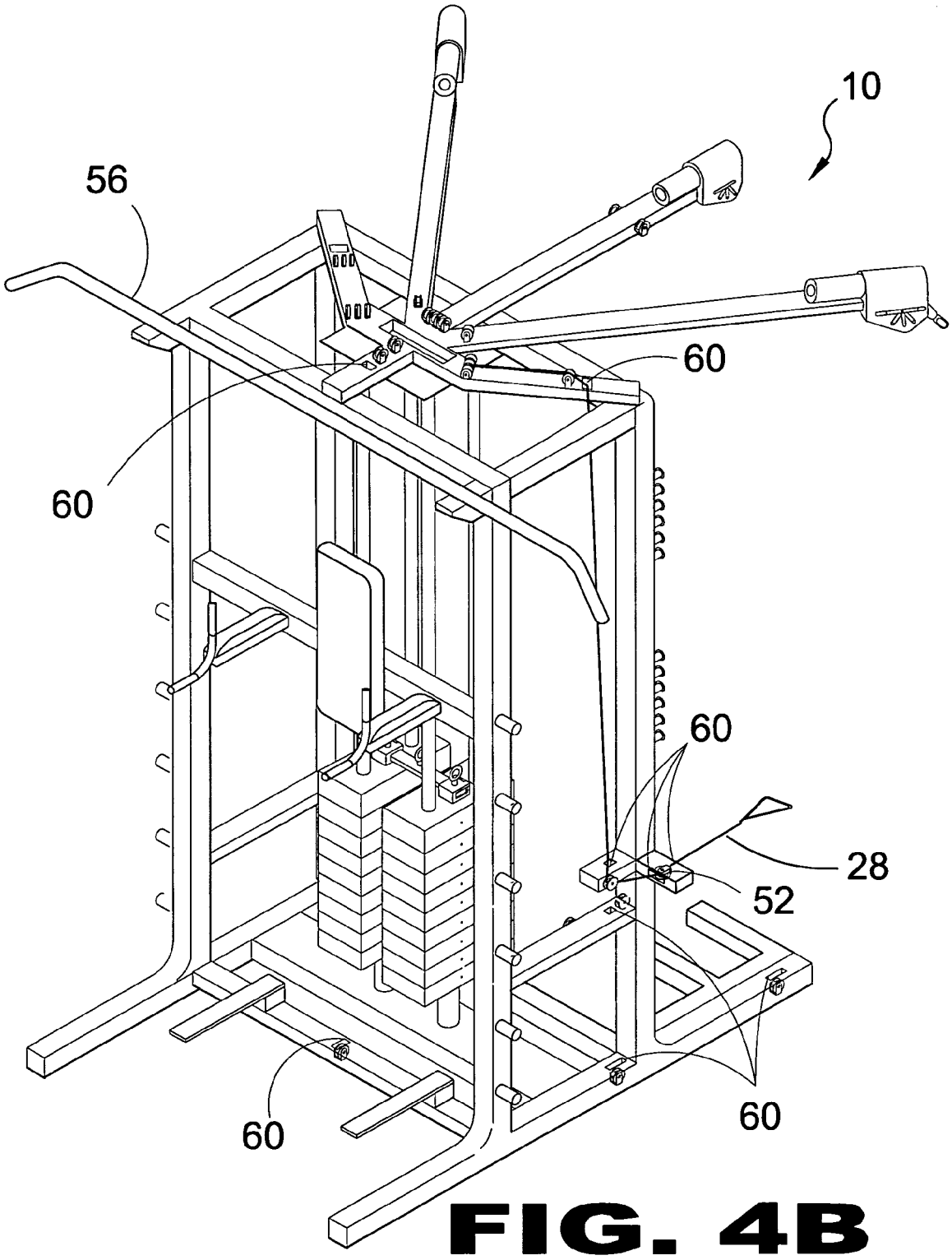
Figure 5:
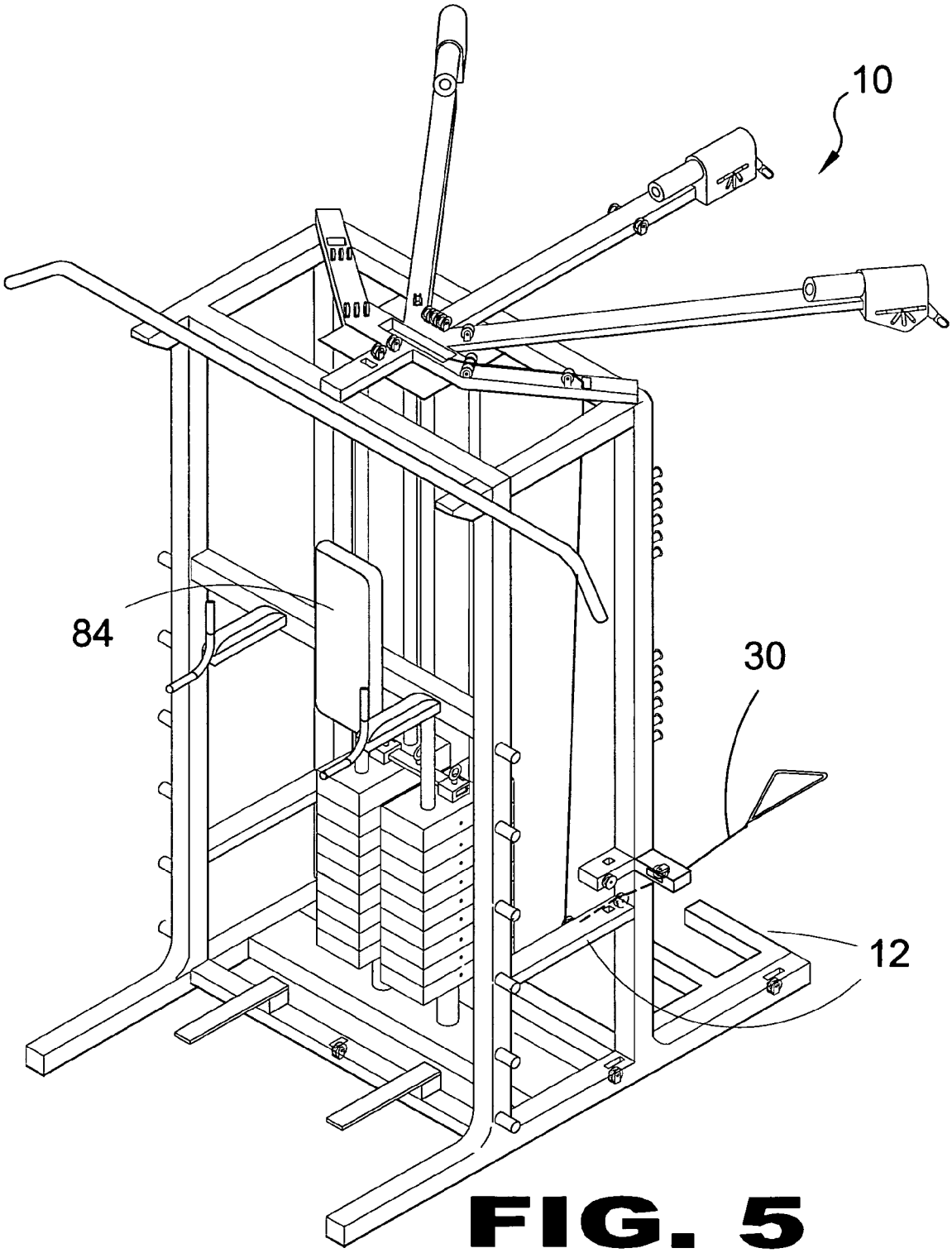
Figure 6A:
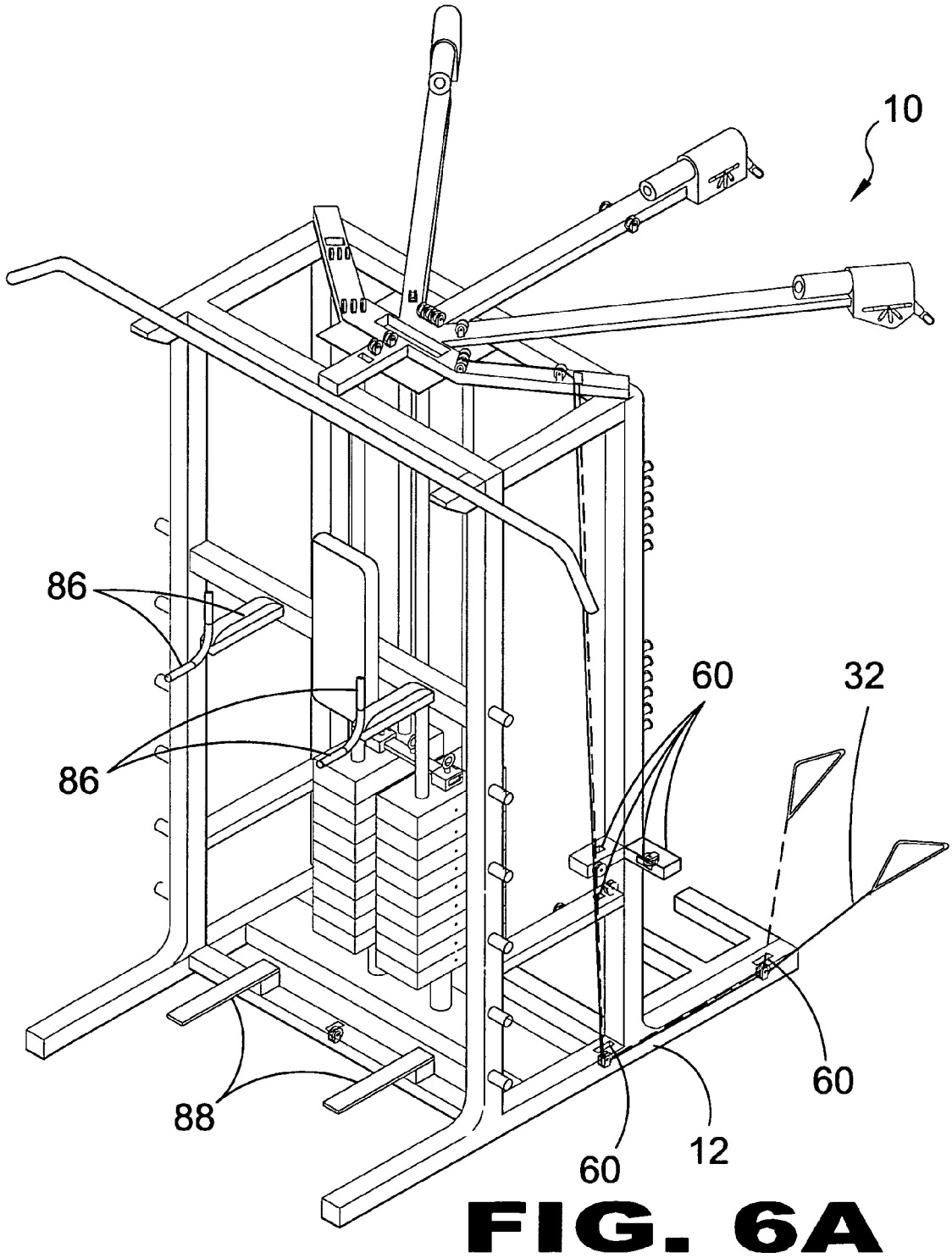
Figure 6B:
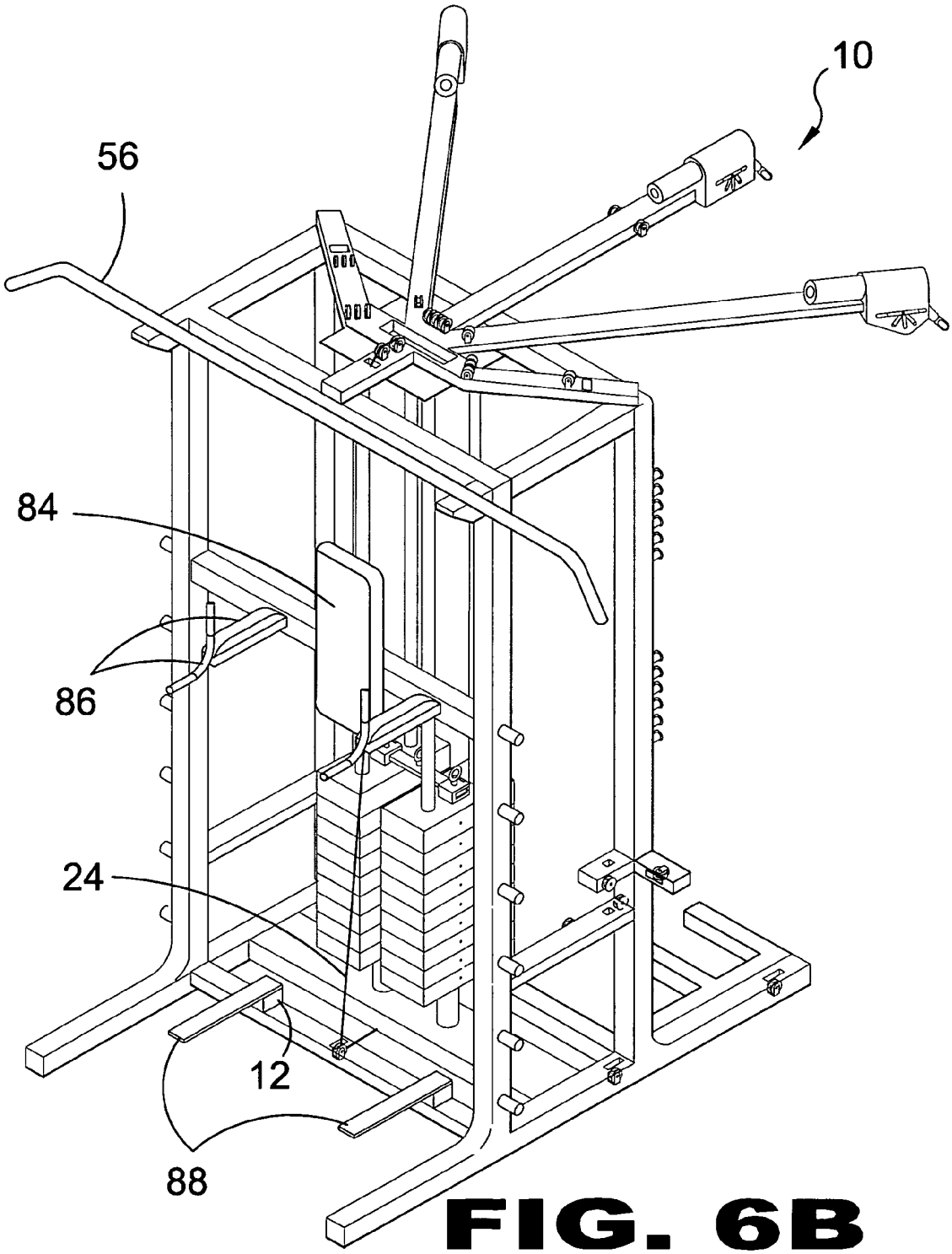
Figure 7:
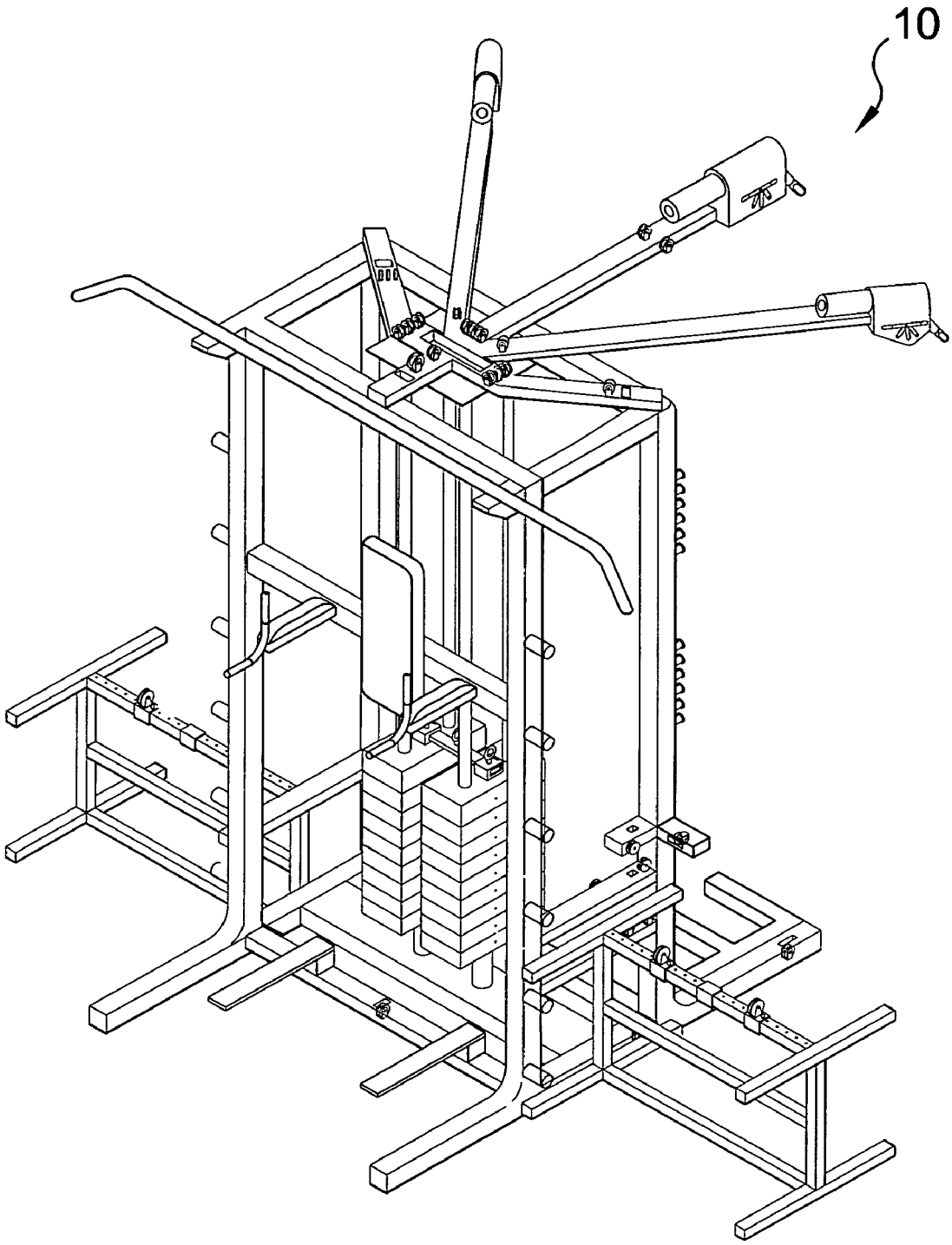
Figure 8A:
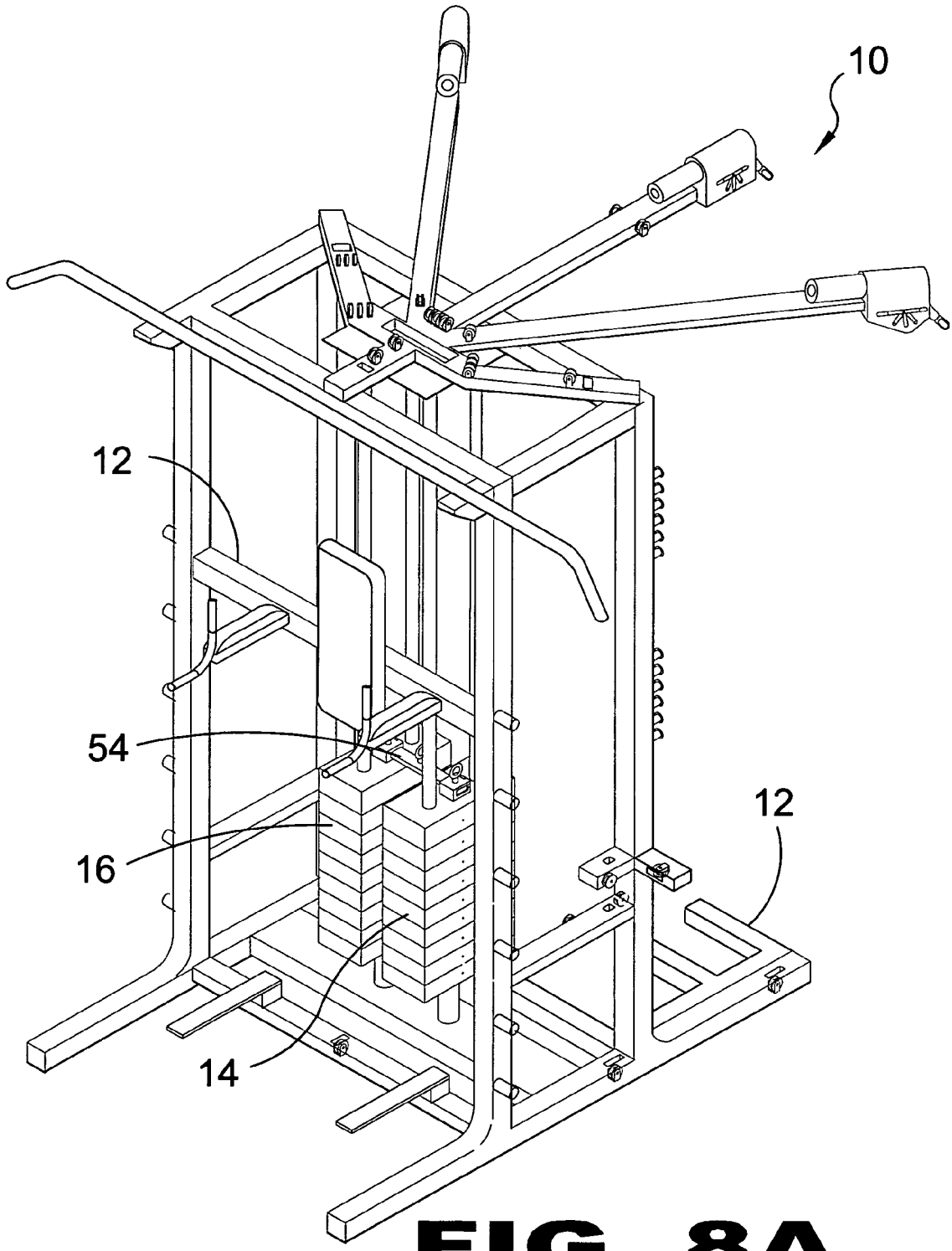
Figure 8B:
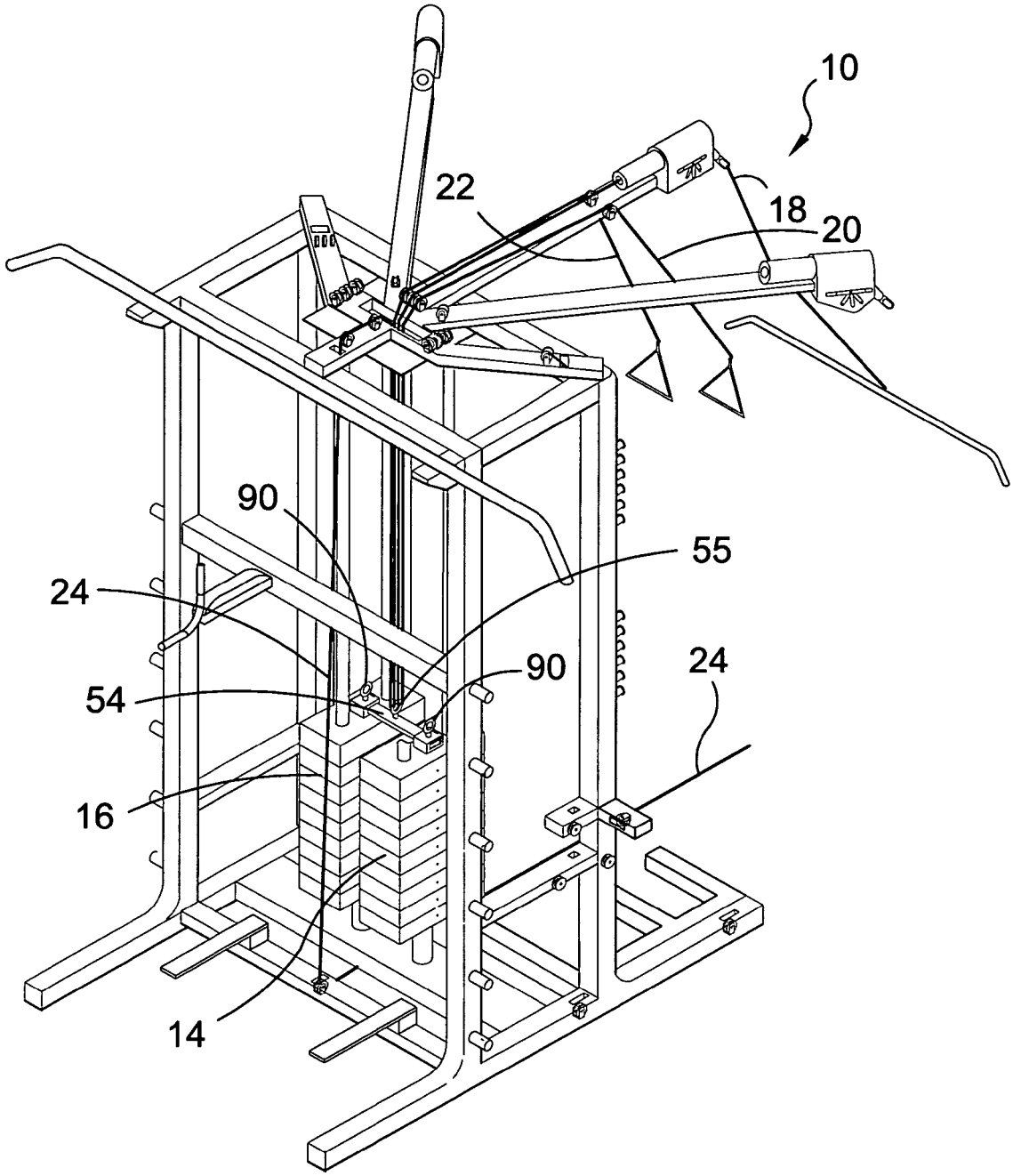
Figure 8C:
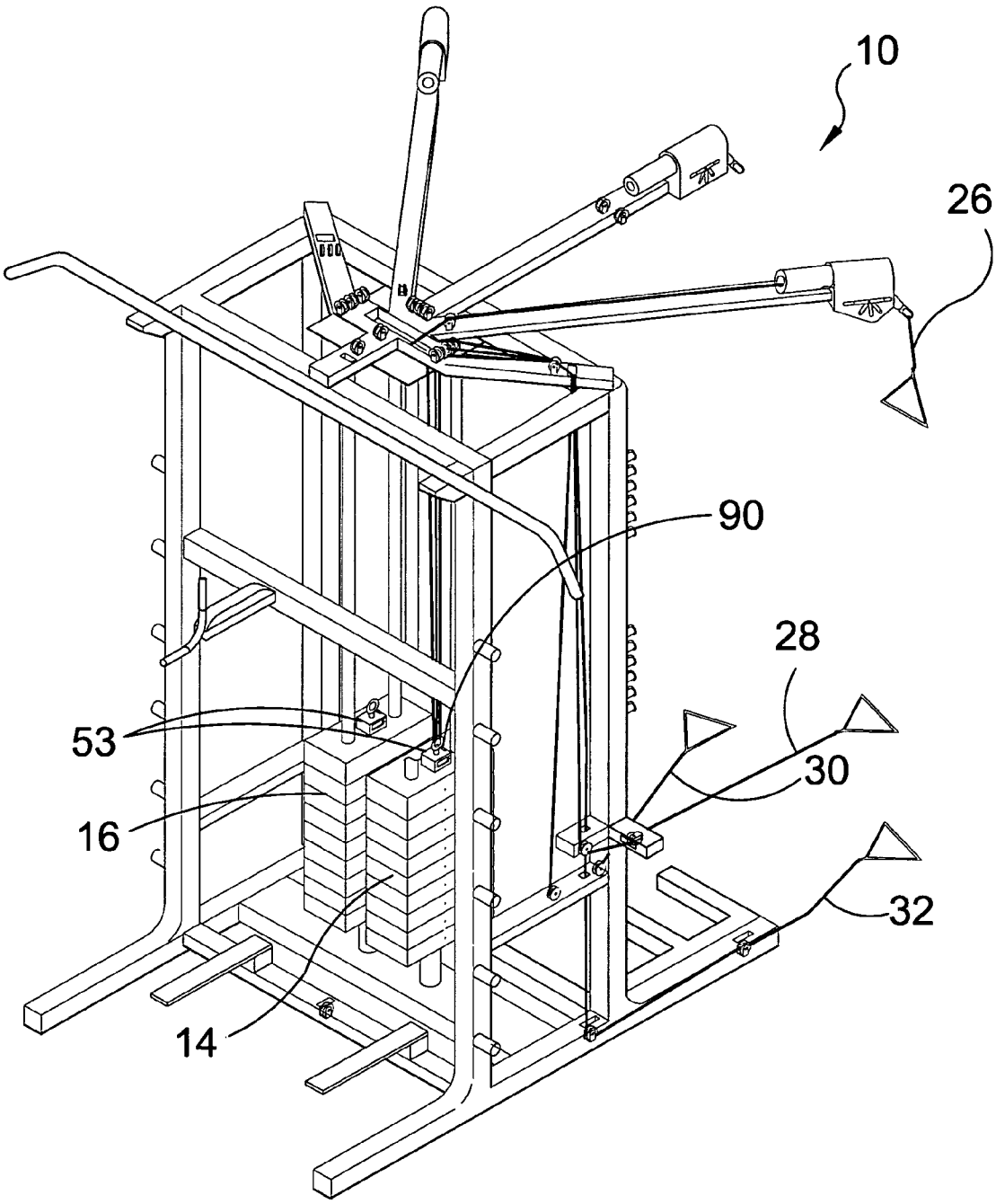
Figure 8D:
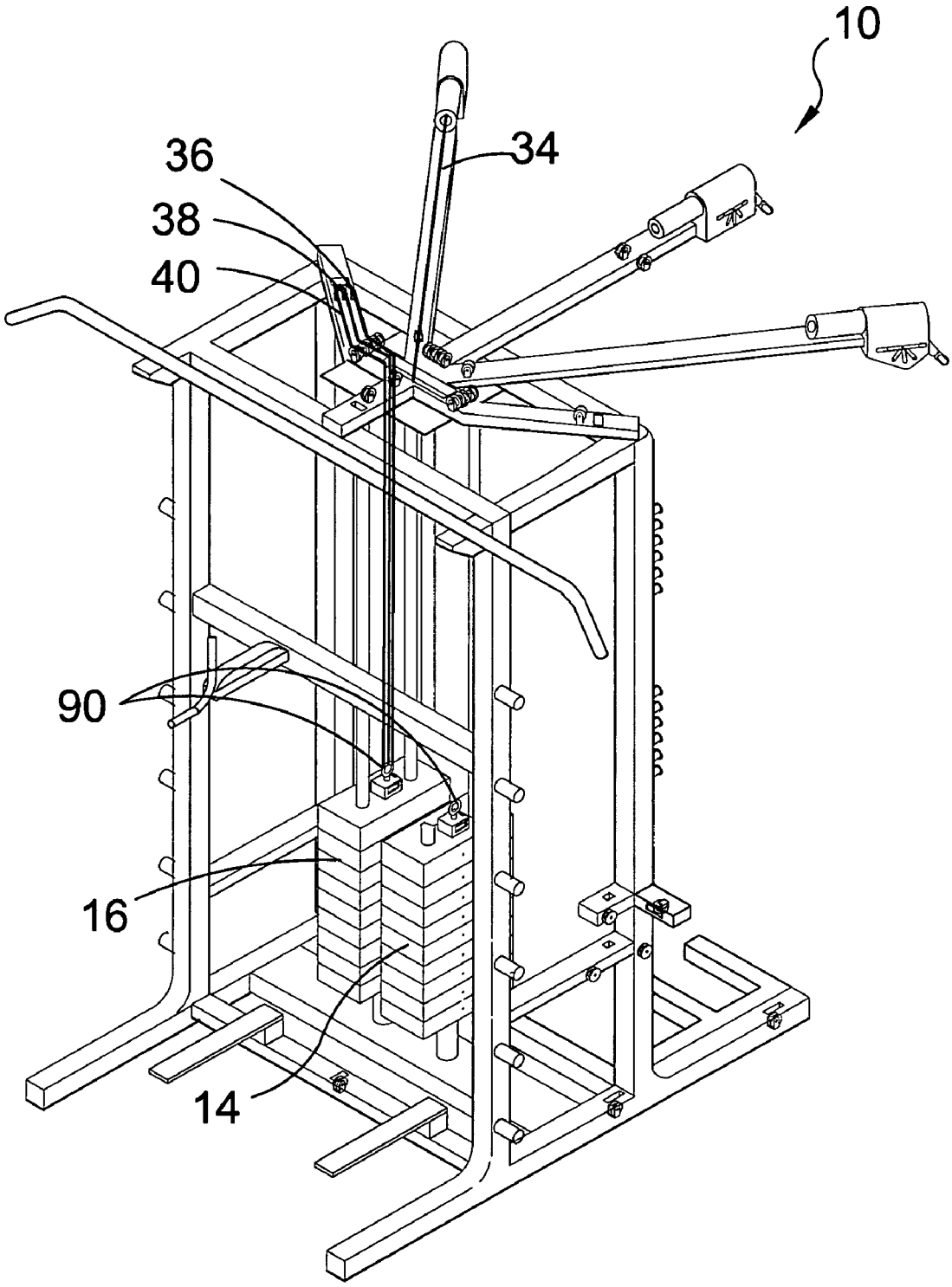
Figure 9A:
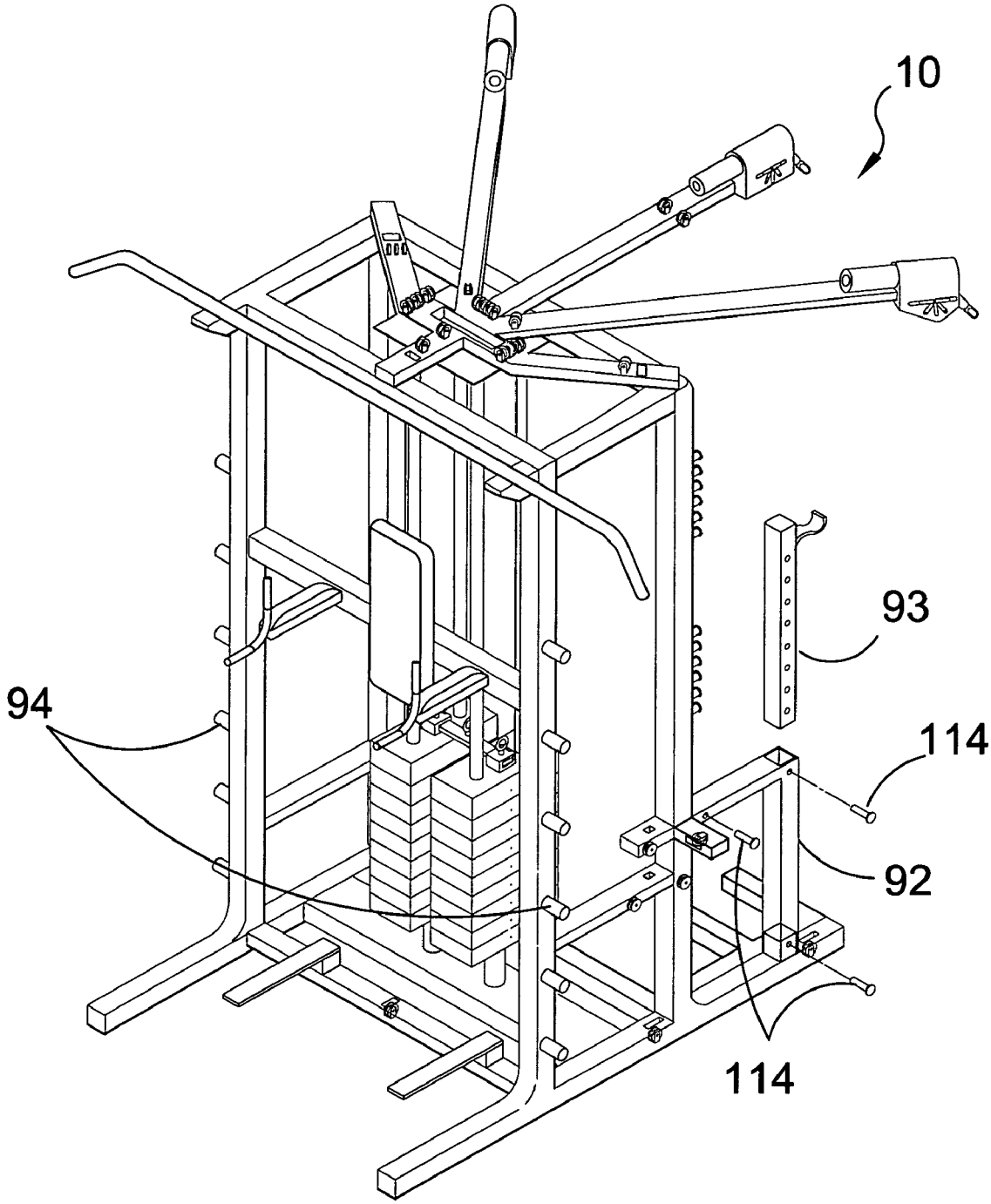
Figure 9B:
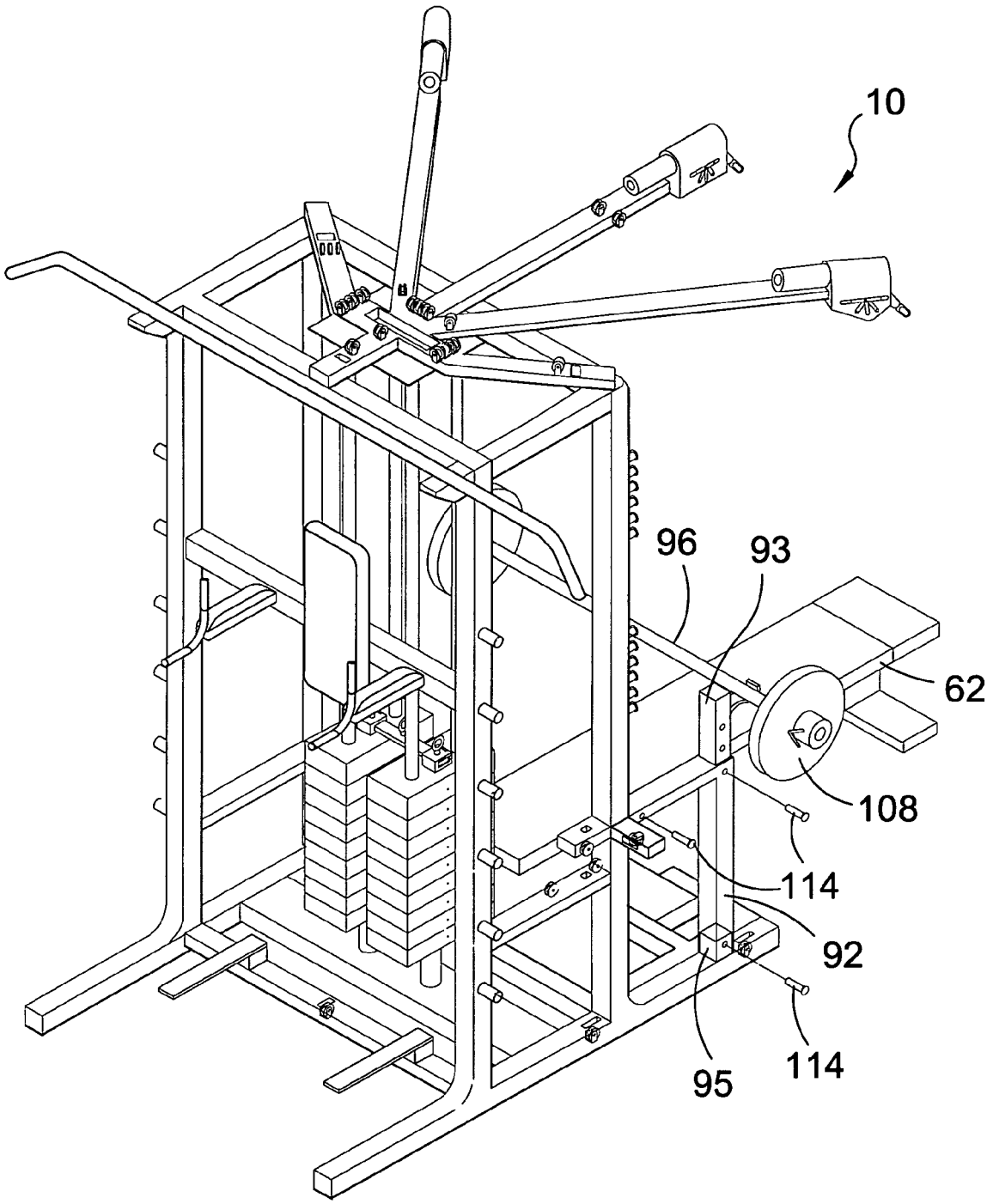
Figure 9C:
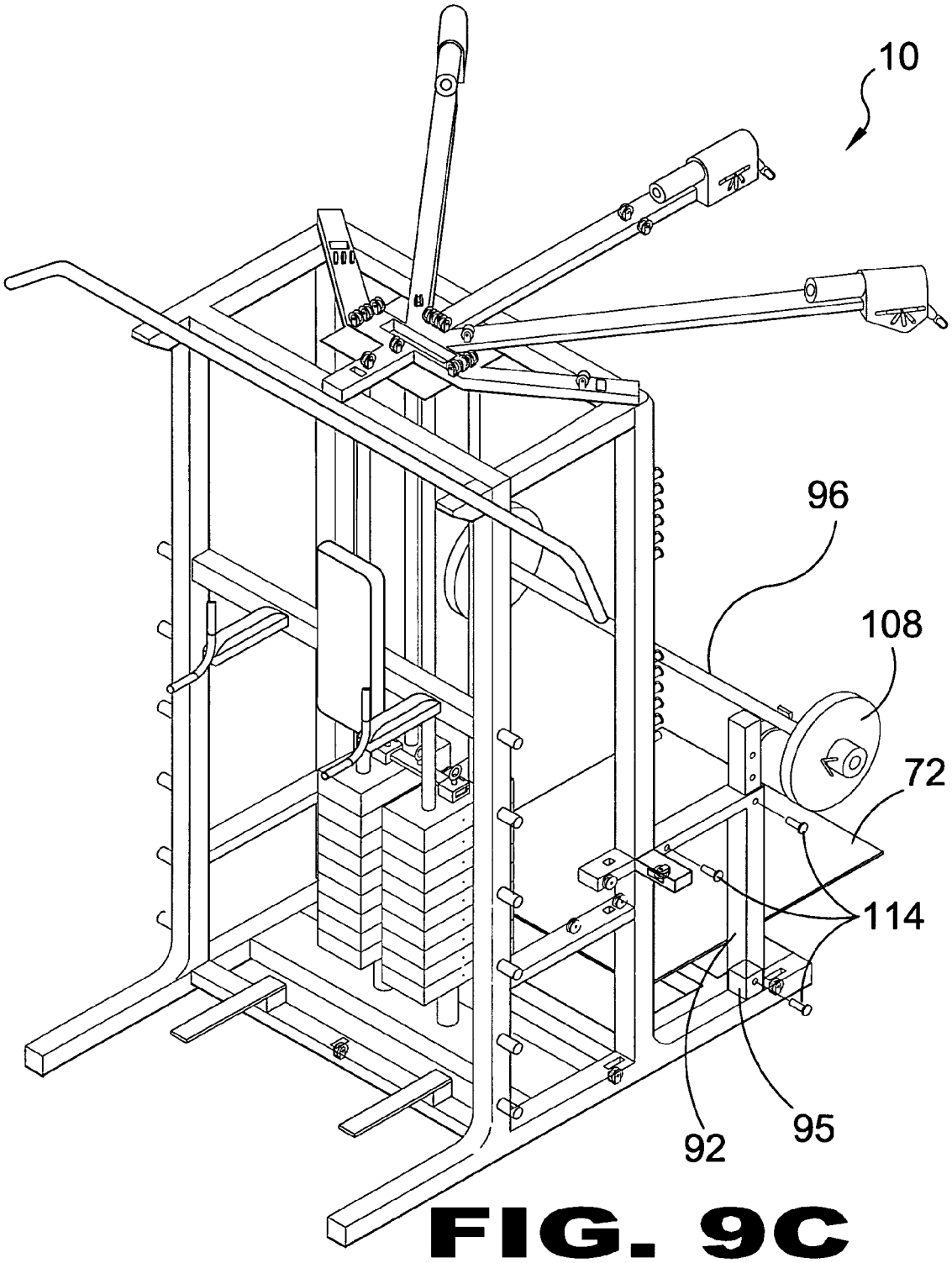
Figure 10A:
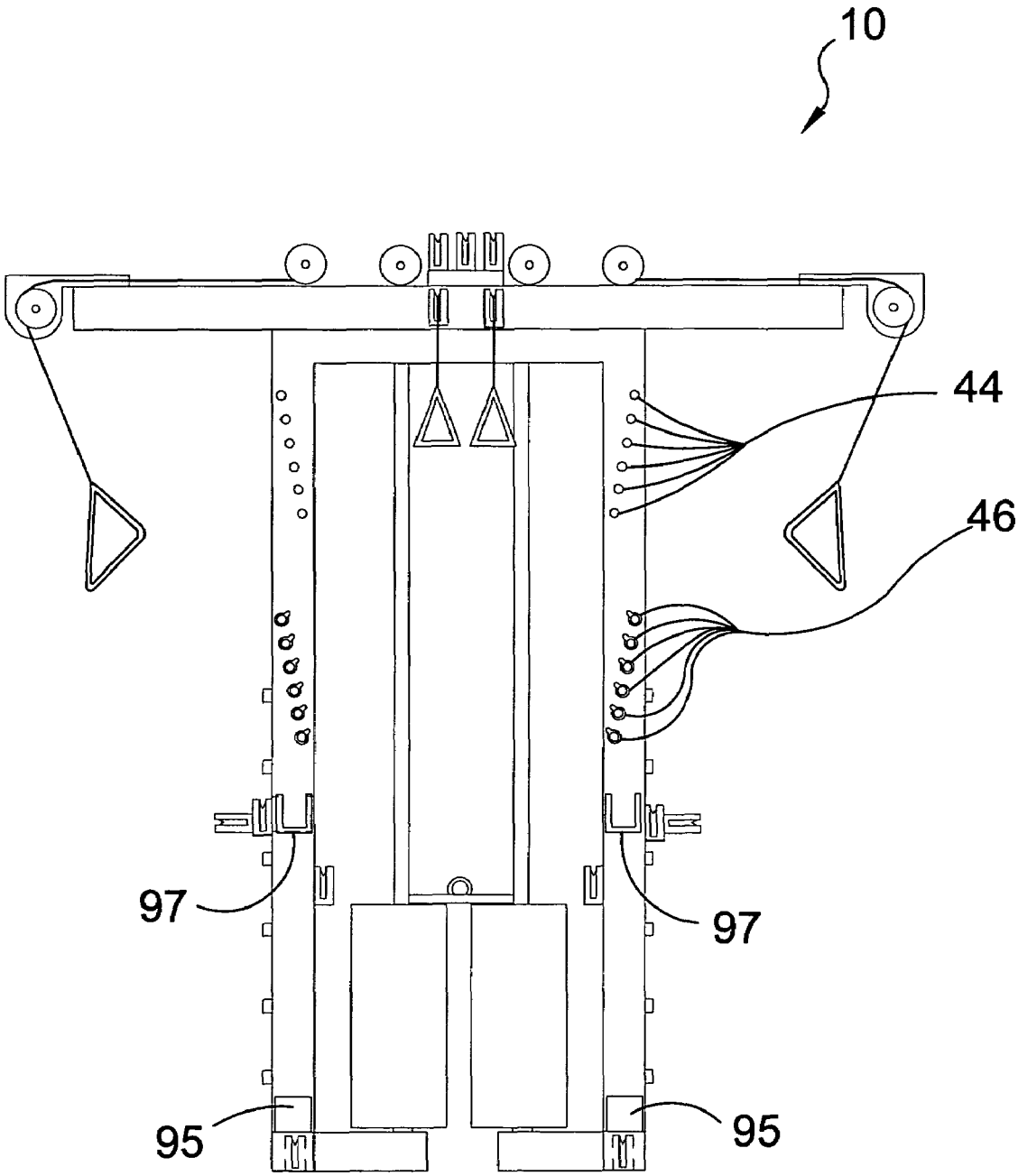
Figure 10B:
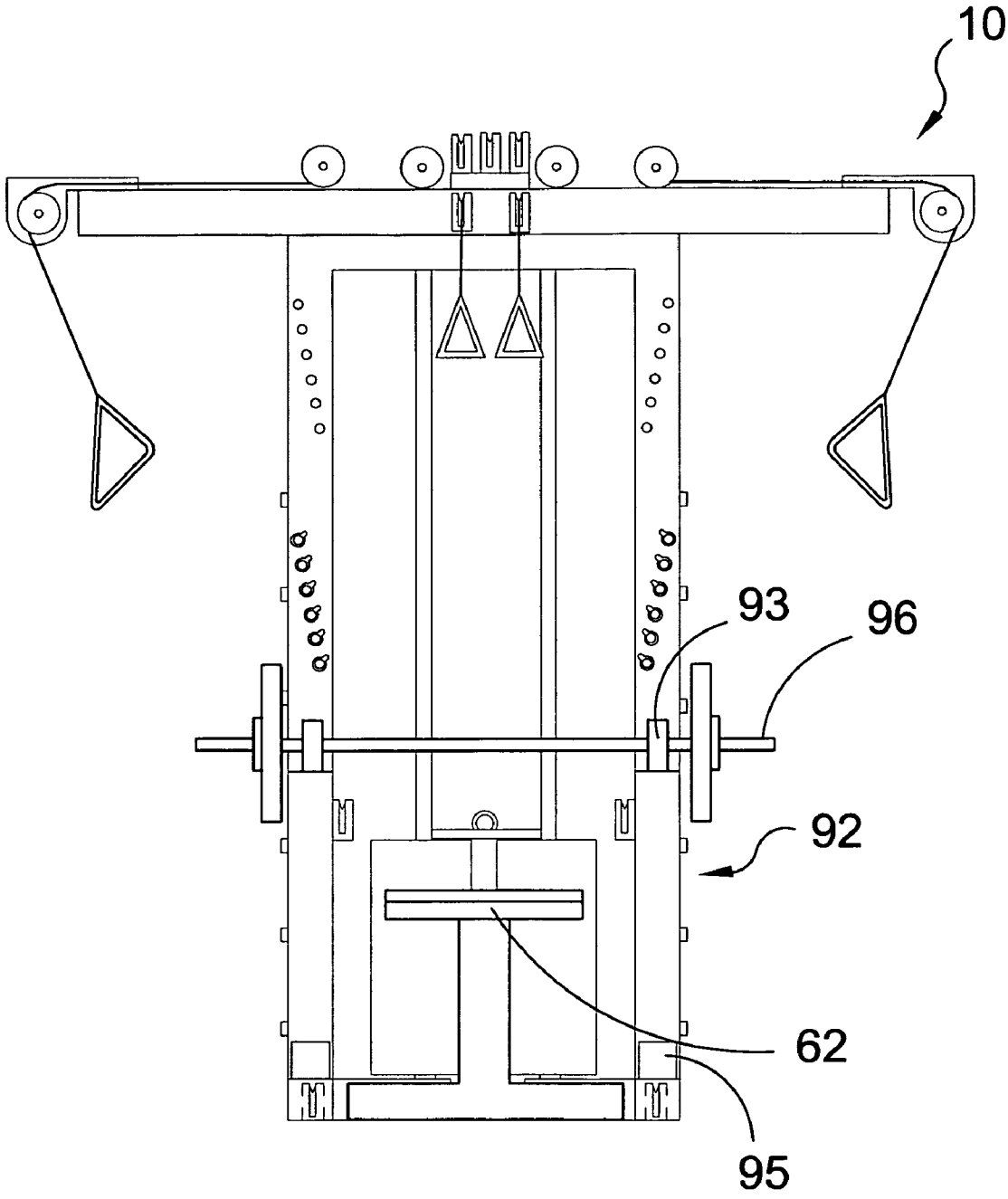
Figure 10C:
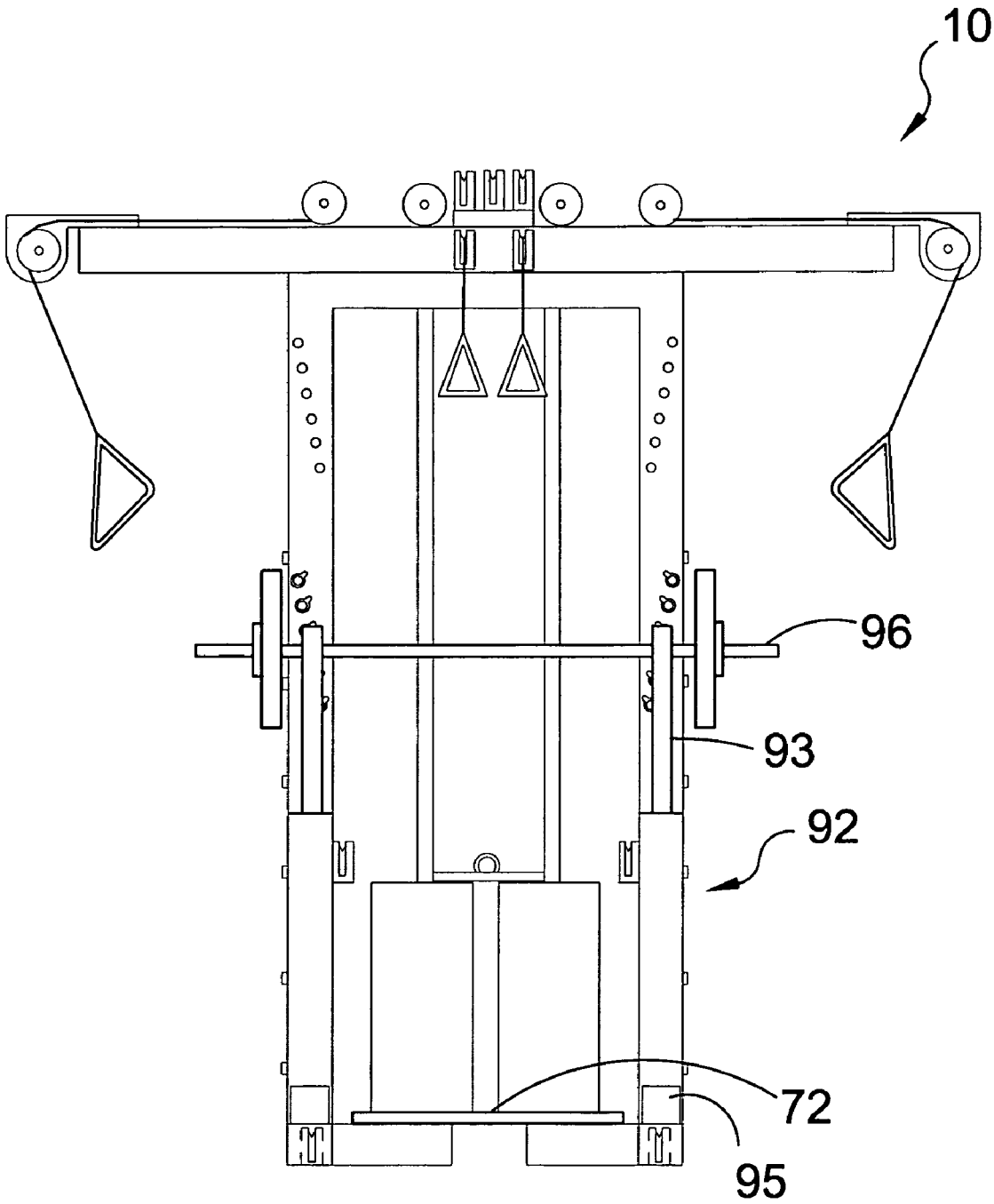
Figure 10D:
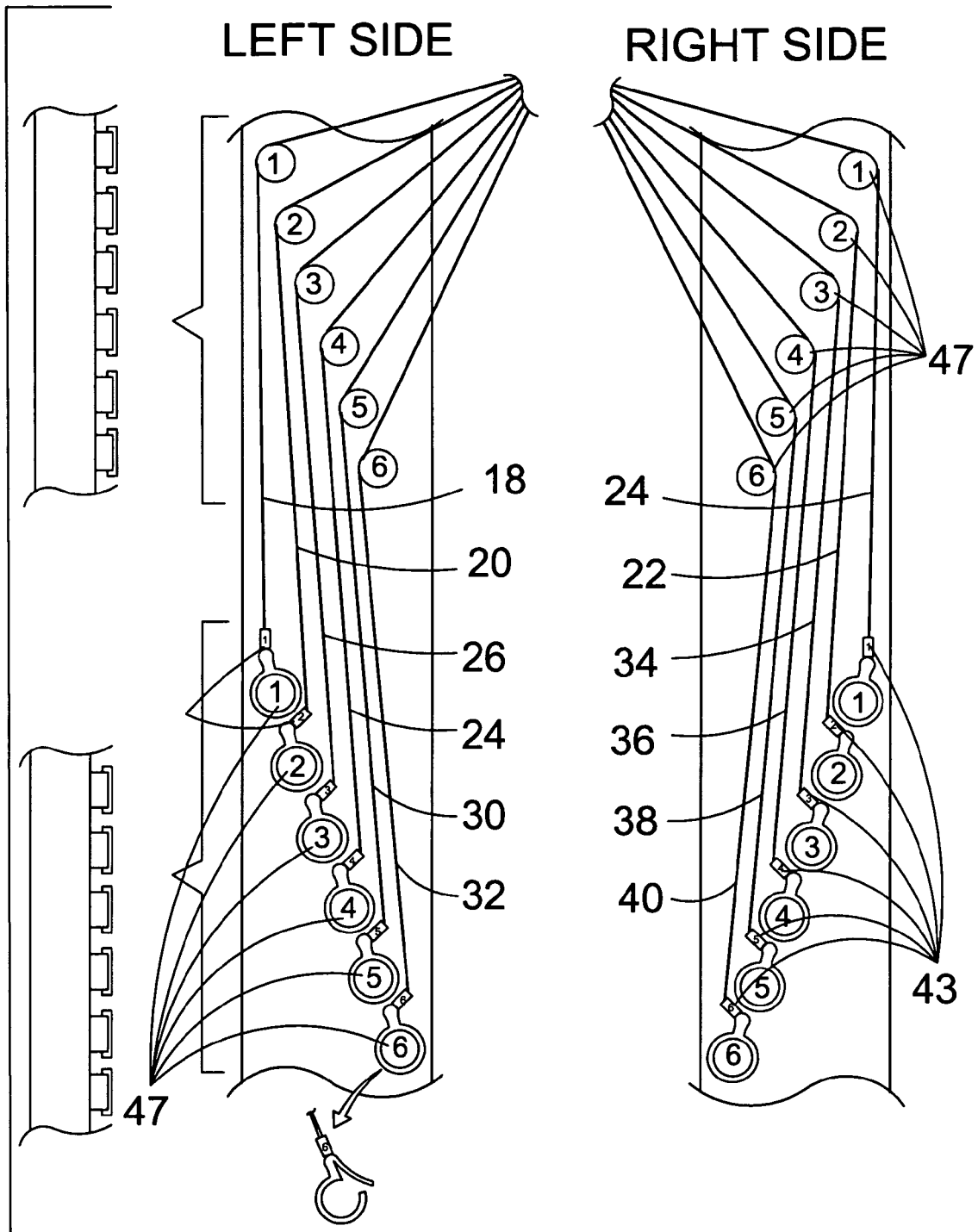
Figure 11A:
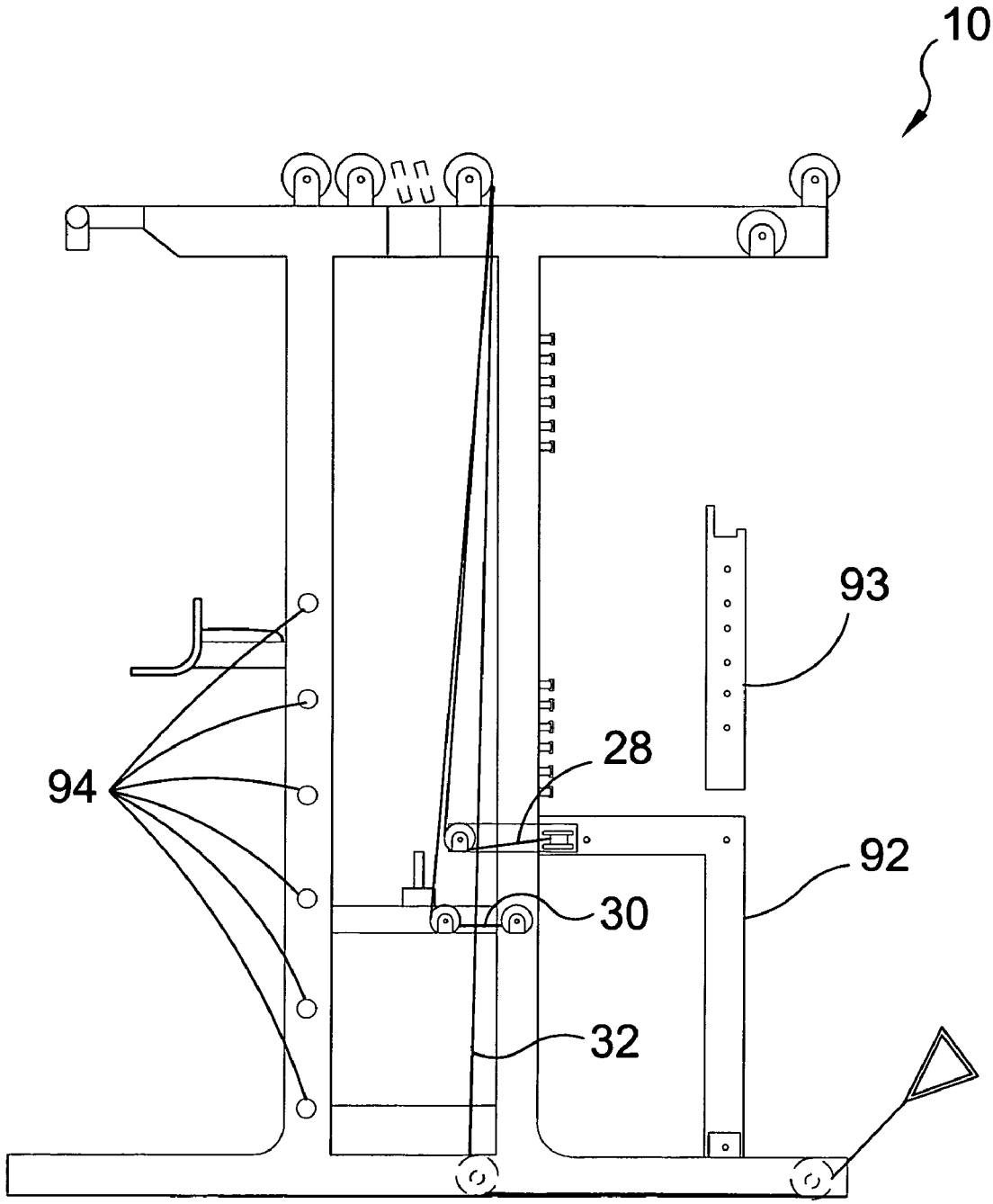
Figure 11B:
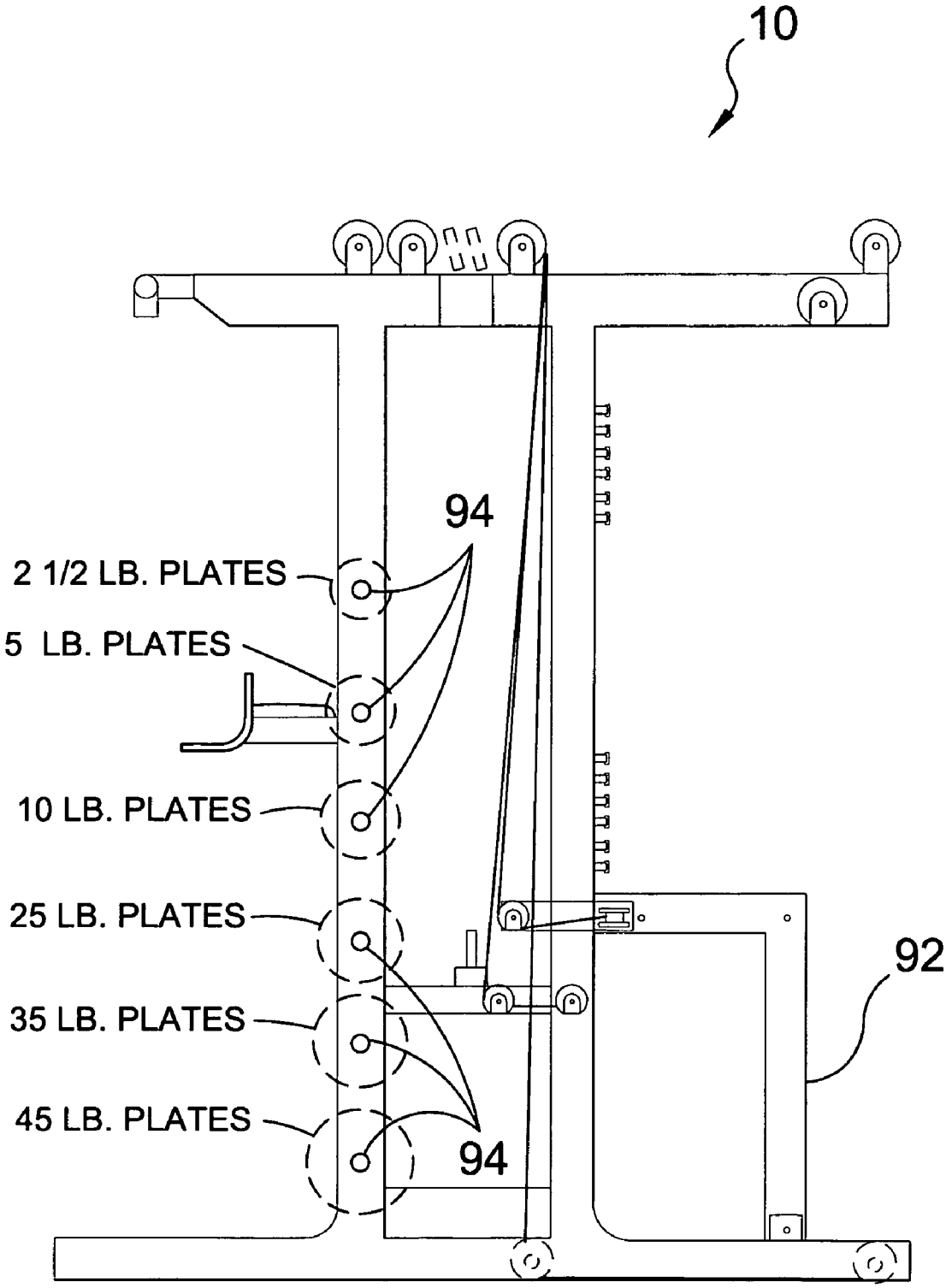
Figure 11C:
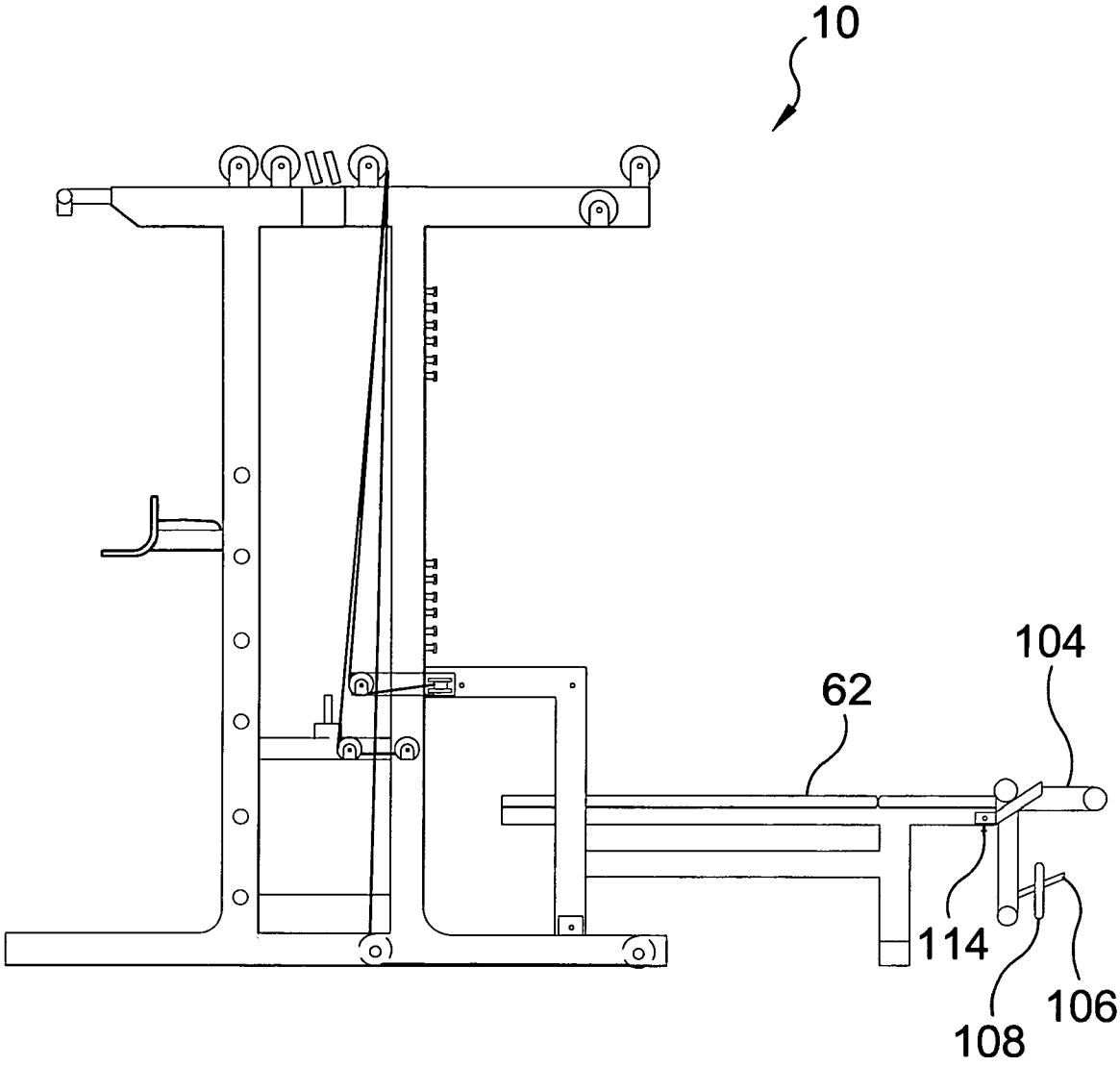
Figure 11D:
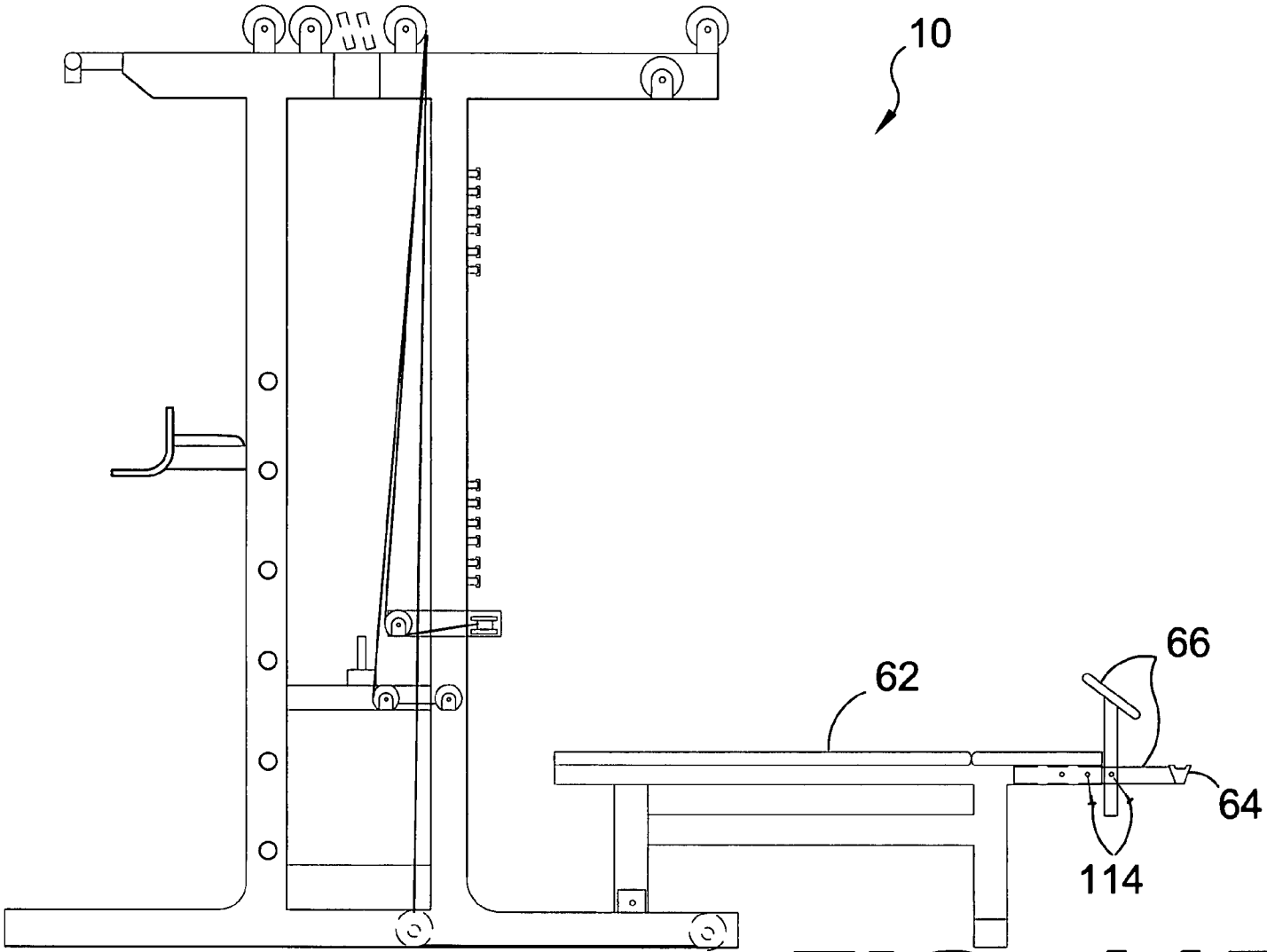
Figure 11E:
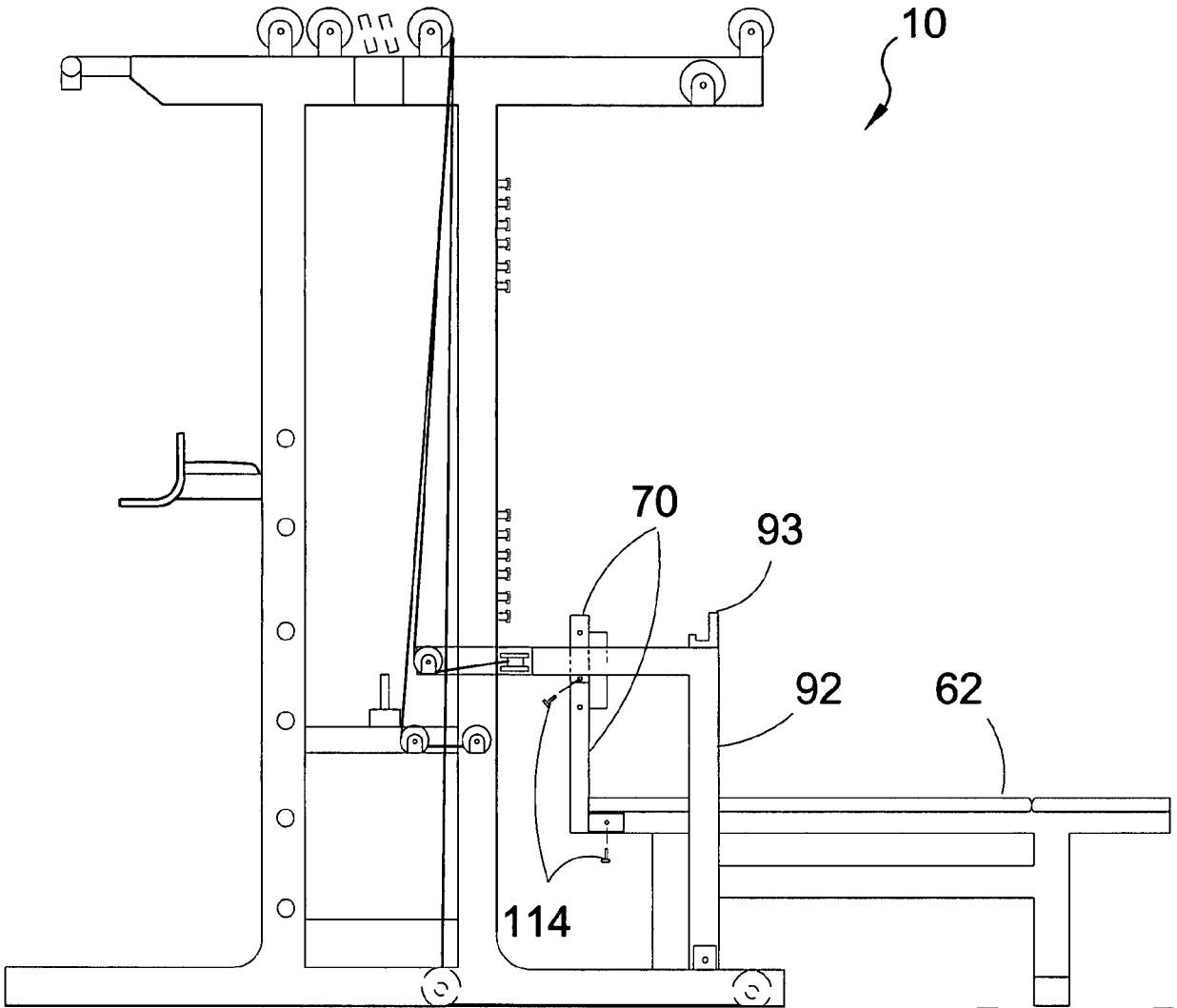
Figure 12A:
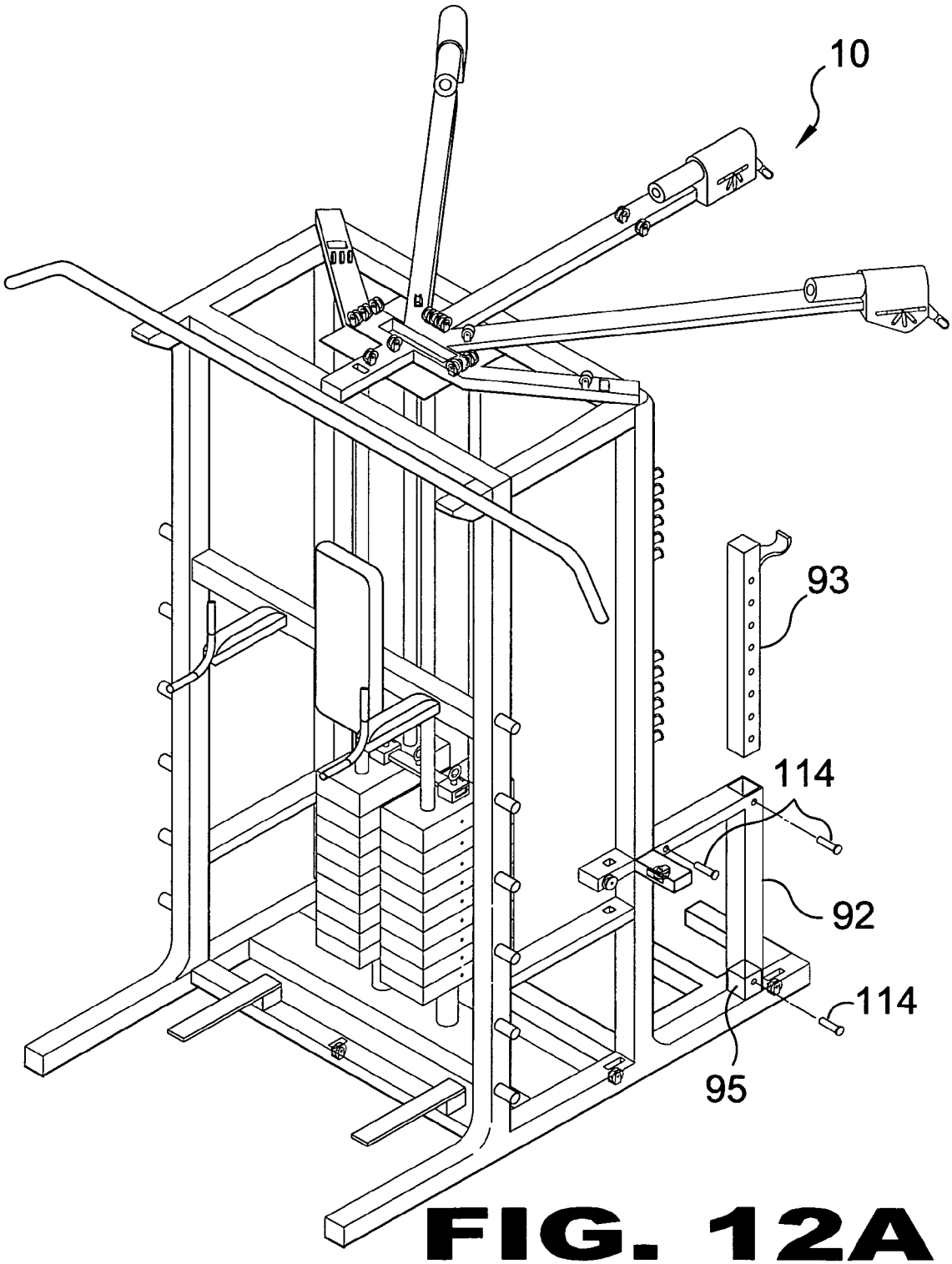
Figure 12B:
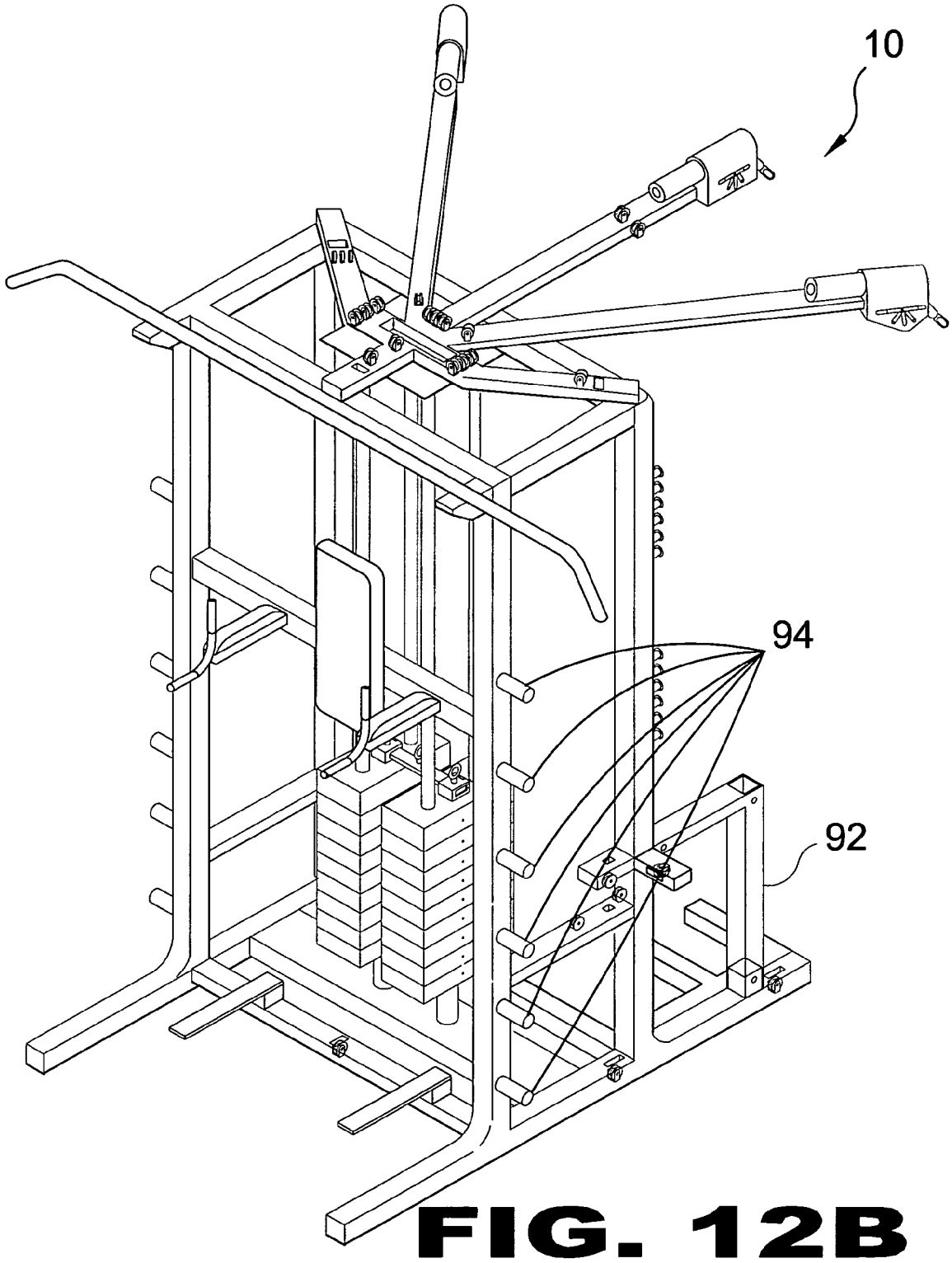
Figure 13:
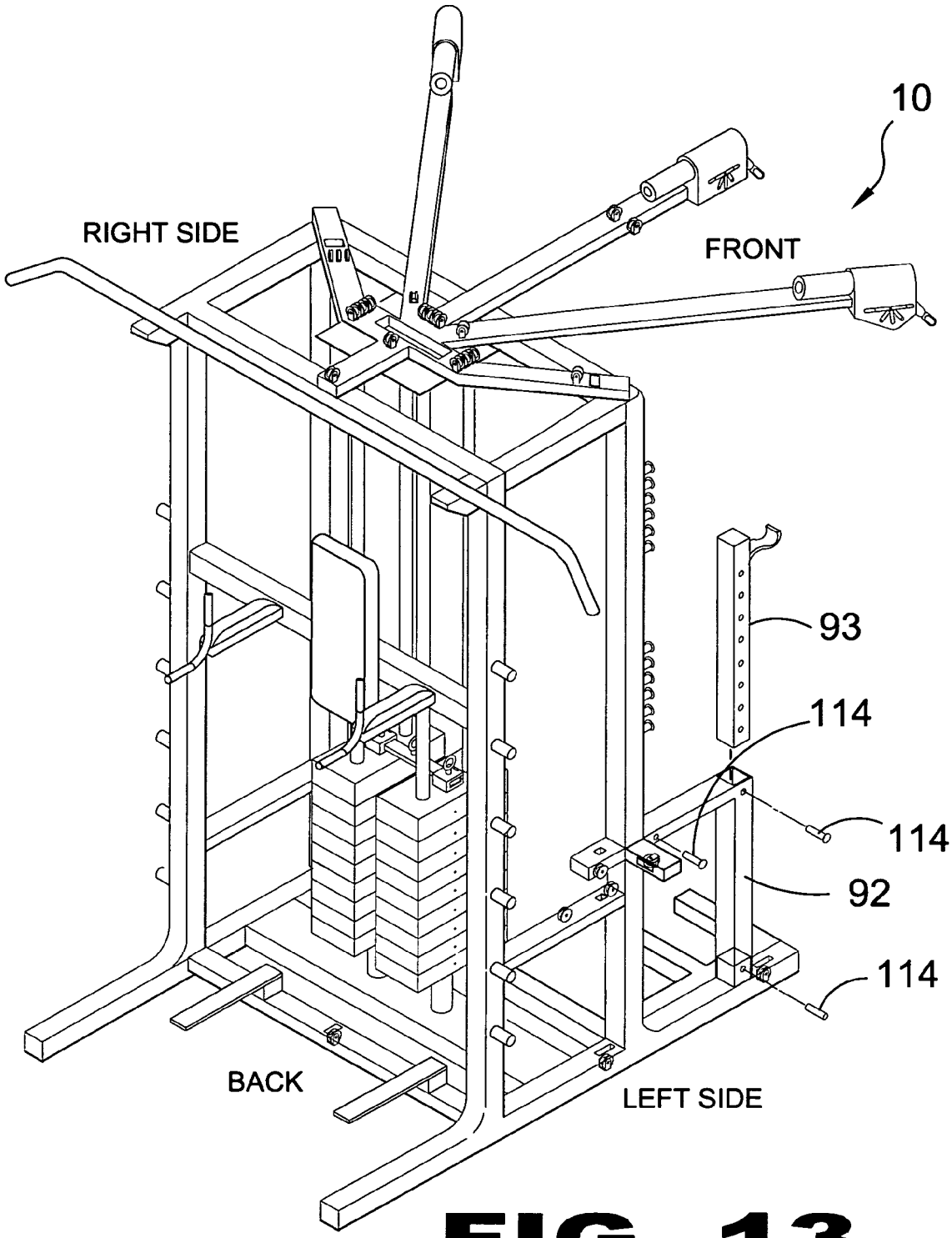
Figure 14:
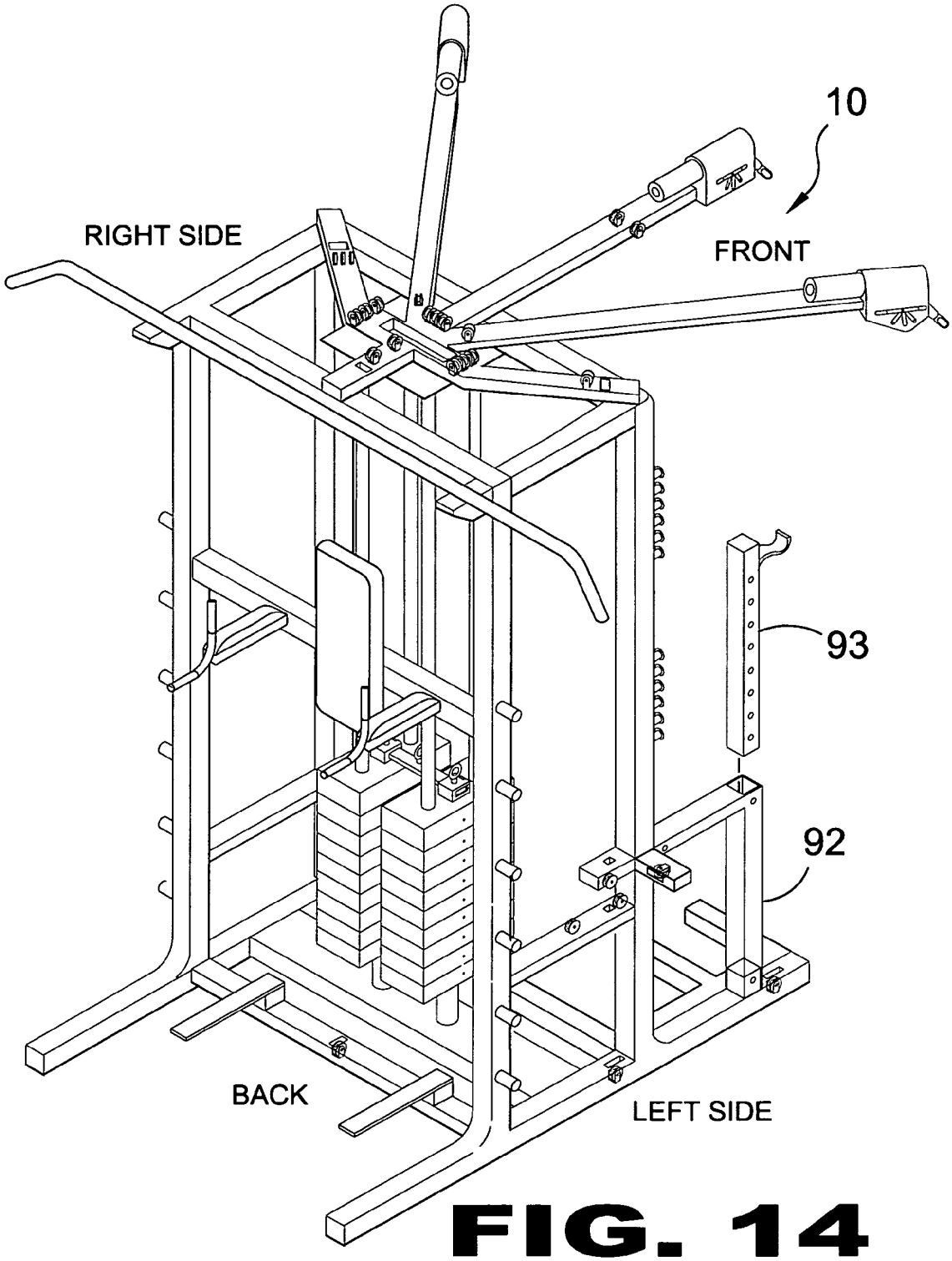

In order that the invention may be more fully understood, it will now be described, by way of example, with reference to the accompanying drawing in which:

FIG. 1 is a perspective view of the present invention in use;
FIG. 1A is a detailed view of the present invention;
FIG. 1B is a perspective view of the present invention;
FIG. 1C is a perspective view of the present invention;
FIG. 1D is a perspective view of the present invention;
FIG. 1E is a perspective view of the present invention;
FIG. 1F is a perspective view of the present invention;
FIG. 1G is a perspective view of the present invention;
FIG. 1H is a perspective view of the present invention;
FIG. 1I is a detail view of the weight stack of the present invention;
FIG. 2 is a front view of the present invention in use;
FIG. 3A is a side view of the present invention;
FIG. 3B is a side view of the present invention;
FIG. 3C is a side view of the present invention;
FIG. 3D is a side view of the present invention;
FIG. 3E is a side view of the present invention;
FIG. 3F is a side view of the present invention;
FIG. 3G is a side view of the present invention;
FIG. 3H is a side view of the present invention;
FIG. 3I is a side view of the present invention;
FIG. 4A is a perspective view of the present invention;
FIG. 4B is a perspective view of the present invention;
FIG. 5 is a perspective view of the present invention;
FIG. 6A is a perspective view of the present invention;
FIG. 6B is a perspective view of the present invention;
FIG. 7 is a perspective view of an optional addition of the present invention;
FIG. 8A is a perspective view of the present invention;
FIG. 8B is a perspective view of the present invention;
FIG. 8C is a perspective view of the present invention;
FIG. 8D is a perspective view of the present invention;
FIG. 9A is a perspective view of the present invention;
FIG. 9B is a perspective view of the present invention;
FIG. 9C is a perspective view of the present invention;
FIG. 10A is a front view of the present invention;
FIG. 10B is a front view of the present invention;
FIG. 10C is a front view of the present invention;
FIG. 10D is a front view of the present invention;
FIG. 11A is a side view of the Olympic weight system of the present invention;
FIG. 11B is a side view of the present invention;
FIG. 11C is a side view of the present invention;
FIG. 11D is a side view of the present invention;
FIG. 11E is a side view of the present invention;
FIG. 12A is perspective view of the present invention;
FIG. 12B is a perspective view of the present invention;
FIG. 13 is a perspective view of the present invention; and
FIG. 14 is a perspective view of the present invention.

DESCRIPTION OF THE REFERENCED NUMERALS

Turning now descriptively to the drawings, in which similar references characters denote similar elements throughout the several views, the figures illustrate the Cable Cross Trainer of the present invention. With regard to the reference numerals used, the following numbering is used throughout the various drawing figures.

| | |
|---|---|
| 10 | Cable Cross Trainer of the present invention |
| 12 | frame |
| 13 | vertical guide rod |
| 14 | first weight stack |
| 16 | second weight stack |
| 17 | weight member |
| 18 | cable one |
| 20 | cable two |
| 22 | cable three |
| 24 | cable four |

-continued

| | |
|---|---|
| 26 | cable five |
| 28 | cable six |
| 30 | cable seven |
| 32 | cable eight |
| 34 | cable nine |
| 36 | cable ten |
| 38 | cable eleven |
| 40 | cable twelve |
| 42 | weight pin recess |
| 43 | numbered steel band on cable |
| 44 | guide pegs |
| 46 | securing pegs |
| 48 | perpendicular pulley |
| 50 | horizontal pulley |
| 51 | steel extension tube |
| 52 | wide v-groove pulleys |
| 53 | unison bar lockdown |
| 54 | unison bar |
| 55 | lift eye of 54 |
| 56 | lat pull-up and chin-up bar |
| 58 | group of three pulleys |
| 60 | opening in 12 |
| 62 | bench press attachment |
| 63 | pulleys located in front and rear of the base of 62 |
| 64 | extension of 24 |
| 66 | adjustable preacher curl attachment |
| 67 | olympic weight bar holder for 66 |
| 68 | adjustable foot plate |
| 70 | adjustable lower back support |
| 72 | deck platform attachment |
| 73 | steel tubing on underside of 72 |
| 74 | steel bar |
| 76 | curl bar |
| 78 | adjustable length chain |
| 80 | adjustable leg hold attachment |
| 82 | cushion of 80 |
| 84 | back support pad |
| 86 | chest dip/leg raise/roman chair station |
| 88 | step plate |
| 90 | weight stack lift eye |
| 92 | barbell rack base |
| 93 | adjustable barbell rack |
| 94 | Olympic weight plate holder |
| 95 | solid steel anchoring block |
| 96 | free weight bar |
| 97 | "U"-shaped anchor for 92 |
| 98 | connection link for 24 and 64 |
| 100 | lat pull-down attachment |
| 102 | row and curl bar |
| 104 | adjustable leg extension/curl attachment |
| 106 | Olympic free weight holder for 104 |
| 108 | Olympic free weight |
| 110 | steel connection latch |
| 112 | center opening on top of 12 |
| 114 | pinandpinhole |
| 116 | top frame support |
| 118 | diagonal cable guide |
| 120 | lateral steel support tube |
| 122 | vertical steel support tube |
| 124 | base of 12 |

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is a perspective view of the present invention 10. FIG. 1: demonstrates cable cross trainer model I (CCTM-I). Model I utilizes the cables "only" as shown in FIGS. 1-8D. Whereas cable cross trainer model II (CCTM-II) is the model CCTM-I with the addition of the Olympic free weight set-up as shown in FIGS. 9A-14. FIG. 1 demonstrates the identification of cables 1 18, 2 20, 3 22, 4 24, 5 26, 6 28, 7 30, 8 32, 9 34, 10 36, 11 38 and 12 40 as they are numbered in the "drawings" (FIGS. 1-15) that are integral with the frame 12 of the cable cross trainer machine (models I & II). In all of the following figures of 1-15 the cables are labeled with the same numbers of 1-12. However, on the "finished product" of CCTM-I & II the cables will be labeled (1-6) on the "left" side of the machine and again labeled cables (1-6) on the "right" side of the machine. Also shown is how the final wide V-groove pulleys 52 for cables 1 18, 5 26 & 9 34 at the end of the extended steel tubes 51, all "swivel" to provide freedom of motion. Also shown are the holes 42 located on the side of each weight member 17 of weight stack 1 14 (shown in FIG. 1) and weight stack 2 16 (not shown) which determines the amount of weight to be used with the weight pin selection process. Both weight stacks 14,16 travel along vertical guide rods 13 when in use.

FIG. 1A is a detailed view of the present invention. FIG. 1.A: (CCTM-I) demonstrates the correct numbering sequence of (1-6) on both the "guide pegs" 44 and "securing pegs" 46 on both the left and right sides which are each numbered with a steel cap on the top of each peg. The steel caps prevent the cables from slipping off the pegs when not in use. Also shown is the correct numbering of the cables, as they will be numbered on the finished product, which are numbered (1-6) on the left and (1-6) on the right side of the machine by a numbered steel band that is wrapped around the beginning of each cable located next to the connection latch. The connection latches located at the beginning of all the cables and can connect the cables to both of the lift eyes of weight stacks or unison bar or the securing pegs. The connection latches are also at the ends of the all cables and can attach the cables to attachments. FIG. 1*a* also demonstrates how all the cables when not in use will be located in their appropriate "home" secured positions.

Note: the correct numbers that should be stamped on the steel caps of the 2 sets of (1-6) guide pegs, the steel caps on the 2 sets of (1-6) securing pegs, and the numbered steel bands that wrap around the beginning of the 2 sets of (1-6) cables. As seen in FIG. 1A:

Note: the "finished product" labeling of cables (2 sets of 1-6) is shown in FIG. 1*a* as well as each of the corresponding numbered cables labeled (1-12) for figures (1-15) are also shown and are as follows:

Left side: cable 1 is cable 1 18 from FIG. 1, cable 2 is cable 2 20 from FIG. 1, cable 3 is cable 5 26 from FIG. 1, cable 4 is cable 6 28 from FIG. 1, cable 5 is cable 7 30 from FIG. 1, cable 6 is cable 8 32 from FIG. 1.

Right side: cable 1 is cable 4 24 from FIG. 1, cable 2 is cable 3 22 from FIG. 1, cable 3 is cable 9 34 from FIG. 1, cable 4 is cable 10 36 from FIG. 1, cable 5 is cable 1138 from FIG. 1, cable 6 is cable 12 40 from FIG. 1.

FIG. 1B is a perspective view of the present invention 10, FIG. 1B: (CCTM-I) demonstrates the travel of cable 6 28. (cable 10 36 on right side operates the same way as cable 6 28.) Cables 6 & 10: these two cables will travel to each of their corresponding top forward left and right top corners of the machine hosted by the diagonal cable guides 118 of the top frame support 116. They will both then travel through each of the square openings 60 located in the top left and right corners of their respective cable guides 118. They will then travel downward on the left and right hand side of the machine to their designated final perpendicular pulley 48 and horizontal pulley 50 therebelow. Both cables 6 & 10 will operate independently of one another. Much in the same way as cables 5 & 9 do. Cable 6 will be used exclusively with weight stack 1 14. Cable 10 will be used exclusively with weight stack 2 16. Such exercises as chest press could be performed when the bench press attachment is in place. (note: the unison bar could be used in its "guide" type application with cables 6 & 10.) Please see how the final pulley for both cables 6 & 10 will need to have a "wide 'v' groove" type pulley to allow for greater range of motion for the user. Also shown is how the final pulley for cable 1, 5 & 9 at the end of the extended steel tubing all "swivel" to provide freedom of motion. Also shown are the holes on side of both weight stack 1 14 (shown in FIG. 1.*b*) and weight stack 2 16 (not shown) which determine the amount of the weight to be used with the weight pin selection process.

FIG. 1C is a perspective view of the present invention 10. FIG. 1C: (CCTM-I) demonstrates the travel of cable 7 30. (cable 11 38 on the right side operates the same way as cable 7.) Cables 7 & 11: these two cables will travel in much the same way that cables 6 & 10 do. They also both have different set of a final pair of pulleys. Both cables 7 & 11 will operate independently of one another. Much in the same way as cables 6 & 10 do. Cable 7 will be used exclusively with weight stack 1 14. Cable 11 will be used exclusively with weight stack 2 16. Such exercises are seated row and shoulder press can be performed when the bench press attachment is in place. (note: the unison bar could be used in its "guide" type application with cables 7 & 11) The final (2) pulleys for cable 7 are mounted in alignment with one another on the outside of lateral steel support tubing 120 and through a vertical steel support tube 122 of the frame. The final "wide 'v' groove" pulleys 52 for both cables 7 & 11 will allow for the greater range of motion for the user. Also shown is how the steel connection latches will connect to the lift eye of weight stack 1 14 and connect the attachment at the end of cable 7. Also shown are the holes on side of weight stack 1 14 (shown in FIG. 1.*c*) which determine the amount of the weight to be used with the weight pin selection process.

FIG. 1D is a perspective view of the present invention. FIG. 1D: (CCTM-I) demonstrates the travel of cable 8 32. (cable 12 40 on the right side operates the same way as cable 8.) Cables 8 & 12: these two cables will also travel in much the same way that cables 6 & 10 and 7 & 11 do. Cables 8 & 12 when traveling down toward the floor past through (2) holes 60 in the horizontal steel tubing framework 12 of the machine. Then after both cables 8 & 12 travel to the floor level and they run through the first pulley "within" the steel tubing. They will then travel parallel with the floor "inside" the steel tubing to meet their final respective pulleys and then exit the steel tubing to be used. Both cables 8 & 12 will operate independently of one another. Much in the same way as cables 7 & 11. Cable 8 will be used exclusively with weight stack 1 14. Cable 12 will be used exclusively with weight stack 2 16. Such exercises as dead lift, bent over rows, flat bench press can be performed. (note: the unison bar 54 could be used in its "guide" type application with cables 8 & 12). Note: the opening at which point that cable 8 and 12 exits the steel tubing the holes need to be enlarged as to create a greater range of motion for the cables to move around. The final pulleys for both cables 8 & 12 will need to have a "wide 'v' groove" type pulley 52 to allow for the greater range of motion for the user. Otherwise the cables would easily derail off the pulleys when in use. Also shown is how the steel connection latches will connect to lift eye of weight stack 1 and connect the attachment to the end of the cable 8. Also shown are the holes on the side of weight stack 1 (shown in FIG. 1.D) which determines the amount of the weight to be used with the weight pin selection process.

FIG. 1E is a perspective view of the present invention 10. FIG. 1E: (CCTM-I) demonstrates the travel of cable 1 18. It also demonstrates how the unison bar 54 is in place and the beginning of cable 1 is attached to the lift eye of the unison bar 54 by a connection latch 110. The lat pull down attachment 100 is connected to end of cable 1 with a connection latch 110. Different attachments can be put on the end of cable 1. Cable 1: will be the located directly in the center of the center located extension steel tubing bar coming from the middle top of the top of the machine. Cable 1 will be used with the unison bar 54 in almost all exercises. This allows cable 1 to attach to the lift eye of the unison bar where then both weight stacks 1 14 and 2 16 will work together. Where exercises such as front and rear lat pull downs can be performed when the bench press and lat pull-down attachments are in place.

FIG. 1F is a perspective view of the present invention. FIG. 1F (CCTM-I) demonstrates the travel of both cables 2 20 & 3 22. It also demonstrates the flexibility of the unison bar 54. The beginning of both cables 2 & 3 can be attached to the lift eye with their connection latches to the unison bar as shown in the picture. Cables 2 & 3 can also be attached where cable 2 attaches to the lift selection rod eye of weight stack 1 14 and cable 3 attaches to the lift rod eye of weight stack 2 16. The end result is that the user can have the weight stacks work independent of each other or together with the use of the unison bar. Cables 2 & 3: will be located directly to the right and left of cable 1 on center located extension bar coming from the middle top of the machine. Cables 5 26 & 9 34: will be located on their own separate steel tube extension arms. Both cables 5 26 & 9 34 will operate independently of one another if desired. As cable 5 26 will be used exclusively with weight stack 1 14, cable 9 34 will work exclusively with weight stack 2 16. However, the unison bar 54 could be placed in position to have both weight stack 1 14 and weight stack 2 16 work together as one even though the cables are still attached to their appropriate weight stacks. This demonstrates the unison bar 54 in a guide type application. Please note how the final pulleys at the end of the steel tube extension arms that handle cables 1, 5 & 9 are pulleys that swivel. This allows for plenty of flexibility and range of motion for the user.

FIG. 1G is a perspective view of the present invention 10. FIG. 1G: (CCTM-I) demonstrates the approximate positions of the 5 sets 58 of three pair of pulleys where each pair is circled. It will be important that proper alignment of the pulleys is correct and precise to prevent any type of binding due to improper alignment while the cables are in use. Improper alignment would cause further resistance not caused by the weight stacks themselves and this should not be the case. Also shown are the openings 60 in the horizontal steel tubing 12 that cables 6, 7 & 8 will travel through one opening and cables 10, 11 & 12 will travel through the other opening.

FIG. 1H is a perspective view of the present invention 10. FIG. 1H: (CCTM-I) demonstrates the unison bar 54 in position. Also shown is the area of machine where it will be essential for proper pulley alignment to also take place within the circled area. All of the pulleys shown in the circled area must have the proper position and flexibility to perform their specific functions with their designated cables, weight stacks and the unison bar. As the cables roll over their appropriate pulleys and then down through the center opening at the top of the machine 112 toward the unison bar and/or the weight stacks it will be important that no binding with cables and pulleys take place. It may also be necessary that the opening in which all the cables will travel through at the top of the machine 112 may need to be modified to accomplish the proper pulley alignment settings. It may also be necessary that the pulleys may need to have wider than normal 'v' grooves to give them the added flexibility to maneuver to slightly different points of direction to be able to attach to the weight stacks and/or the unison bar lift eye(s) below.

FIG. 1I is a detail view of the weight stack of the present invention. FIG. 1I: (CCTM-I) demonstrates the unison bar 55 in more detail. The unison bar is a separate solid piece of solid steel that can be easily installed by the user. It simply locks into place at the top of weight stack 1 and weight stack 2 lift selection weight rods and is secured in place by (2) heavy duty square shaped fittings 53 that each has one side that swivels open and then closes and can be locked and secured with a heavy duty bolt/pin on top of weight stack 1 and weight stack 2.

The unison bar will perform in at least two basic applications/functions. 1. Where the unison bar is put in place and the lift eye of the unison bar 55 is used. For example, the unison bar will be put in place and lift eye of the unison bar 55 will have cable (1) or cable (4) attached to it. Cable 1 and 4 should be attached to the lift eye of the unison bar 55 to work properly, however never at the same time. 2. Where the unison bar is put in place and the lift eye of the unison bar 55 is not used and the unison bar is used in a guide type application. For example, the unison bar is still to be put in place and serves as a guide to keep both weight stacks working in harmony together. Even though the selected cables are actually attached to the top of the lift eyes 90 of both weight stack 1 and weight stack 2 and not the lift eye of the unison bar 55. An example of this is when the unison bar may or may not be chosen in the cable combinations of 2&3, 5&9, 6&10, 7&11, 8&12. If the unison bar is not used the cables and weight stacks will work independently of each other. When the unison bar is used it can be put in place 53 while still having the cables attached to the weight stack lift eyes of the weight stacks. Where then the unison bar can serve in a guide type application to keep the weight stacks working in harmony and together with one another even though the center lift eye of unison bar 90 is not attached to any of the cables.

FIG. 2 is a front view of the present invention in use. FIG. 2: (CCTM-I) demonstrates the proper location of the pulleys for cable combinations 6 28, 7 30 & 8 32 (left side), 10, 11 & 12 (right side, not shown). Note that concerning the last (2) pulleys for cable 6 (left side) 10 (right side) that the second to the last pulley 48 feeds the last pulley 50 and they are in alignment with each other. This is again important for proper pulley alignment to be in effect. The last pulley for cables 6, 7 & 8 (left), and 10, 11 & 12 (right) need to have a wide 'v' groove 52 to give a larger range of motion to the user. Otherwise the cables will simply derail off the corresponding final pulleys that will be enduring the brunt of range of motion and angles that are conducted in the exercises.

FIG. 3A is a side view of the present invention 10. FIG. 3A: (CCTM-I) demonstrates a side view of the final pulleys for cables 6 28, 7 30 & 8 32 (left side), (10, 11 & 12 operate the same way on the right side). As emphasized in FIG. 2. The last pulley for all of these cables will all need a wide 'v' groove type pulley 52. The reason again for this being is that it will allow for a much greater range of motion for the user when performing exercises. Otherwise a standard type pulley could easily derail the cables when the cable is not in perfect alignment with the pulley.

FIG. 3B is a side view of the present invention 10. FIG. 3B: (CCTM-I) demonstrates the travel of cable 4 24, and the "cable 4 extension cable" 64 to the leg curl attachment 104. After cable 4 travels through the last pulley the end of it can be attached immediately with an attachment (or) as demonstrated in FIG. 3.*b* it can be attached to the "cable 4 extension cable". It is shown where cable 4 is traveling through the first pulley underneath of the front base leg of the bench 63. Then, after traveling just past the first pulley in the front of the bench it will be attached with 98 "cable 4 extension cable" 64. Important note: the linkage where both cables are joined (end of cable 4 and the front of cable 4 extension cable 98) will not conflict with any pulleys as cable 4 extension cable 64 is used. Note as cable 4 extension cable travels through the second pulley located in rear base leg of the bench 63 where it is then connected to the leg extension attachment 104 which utilizes the weight stacks. The leg extension attachment 104 can be used with the Olympic free weight set as well by loading weights on the Olympic free weight peg 106.

FIG. 3C is a side view of the present invention 10. FIG. 3C (CCTM-I) demonstrates the travel of cable 4 24 and the cable 4 extension cable 64. Demonstrated is how the preacher curl attachment 66 can be used with cable 4 and the cable 4—extension cable 64. Note the preacher curl attachment can adjust forward and backward as well as up and down with the desired 114 pin selection settings. Also demonstrated is the center located pulley locations of both the front and rear of bench 62 and where the pulleys are located within the front 63 and rear 63 base leg sections of the bench 62. The preacher curl attachment can be used with Olympic free weight set up as well.

FIG. 3D is a side view of the present invention 10. FIG. 3D (CCTM-I) demonstrates the adjustable foot plate attachment 68. This attachment is used with the bench 62 and possible cables cable combinations of 6&10 28, 36 or 7& 1 30, 38 to do a rowing type exercises. This attachment can be adjusted forward and back with the desired pin selection settings 114.

FIG. 3E is a side view of the present invention 10. FIG. 3E (CCTM-I) reflects the adjustable lower back support attachment 70 for the bench 62. Note this attachment can also be adjusted up and down as well as forward and backward with the desired pin 114 selection settings. The adjustable lower back support attachment can also be used with the Olympic free weight set up as well.

FIG. 3F is a side view of the present invention 10. FIG. 3F (CCTM-I) demonstrates the steel deck plate platform attachment 72 that fits directly into the footprint of the base of the machine. The top is 2" steel plate where the underside 73 is the same size steel tubing as that of the machine. The steel tubing is welded to the under side of the steel deck plate in such a way that the pattern allows it to fit precisely in place within the frame 12 of the base of the machine as shown in the picture. This allows the user to stand on a solid steel platform other than the floor while performing exercises. This also allows the user from stumbling and/or tripping over the somewhat forked-type footprint of the machine. Note that the bench also fits into the footprint/frame 12 of the base of the machine in a similar manner. This secures both the steel deck plate attachment and bench from moving around while in use. The steel deck plate attachment 72 can also be used with the Olympic free weight set up as well.

FIG. 3G is a side view of the present invention 10. FIG. 3G (CCTM-I) demonstrates the steel deck attachment 72 in place. Also, as mentioned previously as part of the attachment selections will be an approximate 6 foot long by 1 2" steel bar 74 that will be able to connect to the ends of both cables 8 & 12 with the steel latch connections 110 at the same time. The 6 foot bar will also have an "adjustable" length chain 78 that attaches to each end of cable 8 32 & 12 40. This will allow the user to adjust the height of bar before both cables 8 & 12 become taut and the weight load that is attached at the other ends of the cables is felt. The adjustable length chain 78 is an adjustment is for the different heights of users. Note that the steel deck plate 72 attachment and the bench cannot both be used at the same time.

FIG. 3H is a side view of the present invention 10. FIG. 3H (CCTM-I) demonstrates the travel of cable 4 24 with the steel deck 72 in place. Cable 4 as it travels from the top of machine down toward the floor is within the steel tubing framework of the machine. Therefore cable 4 does not interfere with the user when using the roman chair/leg pull station 86 on the back of the machine. At the end of cable 4 is a bicep curl bar attachment 76. An adjustable length chain 78 is used to attach to the end of cable 4 and then attached to the attachment. Due to the different heights of users the "adjustable" length chain could lengthen or shorten the difference between the end of cable 4 and the attachment 76. Note how the steel deck platform 72 will play a role as a solid surface for the user while doing bicep curls as shown in the picture.

FIG. 3I is a side view of the present invention 10. FIG. 3I (CCTM-I) demonstrates the adjustable leg hold attachment 80. This attachment can also be adjusted to move up or down as well as in and out by using the pin 114 selection holes. The purpose of this attachment is for the user to gain additional hold down strength when using cables 1,2 & 3. Also shown is the location of the lat pull-up and chin-up bar 56 in reference to the roman chair/chest dip 86 part of the machine. The user will be able to utilize the lat pull-up and chin bar 56 without being interfered by the roman chair/chest dip station 86 aspect of the machine.

FIG. 4A is a perspective view of the present invention. FIG. 4A: (CCTM-I) demonstrates how the bench press attachment 62 will custom fit into its proper "home" location within the frame 12 of the base of the machine. The steel tubing of the bench press is the same size steel tubing of that of the machine. As shown exactly in the picture is the front base leg of the bench fitting perfectly and securely into the framework of the base of machine. This is similar to the set up the steel deck attachment 72. The reason for both to fit this way is so that the bench press and the steel deck attachment always sit in their same and secure home position. Note: the bench press can work in both a flat position and/or an inclined position as shown in the pictures. The bench press can also be used with the Olympic free weight set as well. Shown also is how cable 4 24 traveling down the back side of the machine is within the steel tubing frame work of the machine and will not interfere with the user when using the roman chair/chest dip station 86 and support pad 84.

FIG. 4B is a perspective view of the present invention 10. FIG. 4B: (CCTM-I) demonstrates how cable 6 28 on the left side travels (cable 10 36 on the right side will travel the same way). It also reflects a good picture of how the "second to the last" pulley for cable 6 will be feeding the last pulley for cable 6 before leaving the machine. Again the importance of proper pulley alignment must be emphasized to avoid any unnecessary binding with the two pulleys working together correctly and smoothly. The final pulley for both cable 6 & 10 also needs to have the wide "v" groove pulley 52 for the flexibility and mobility of different angles and motions. Also shown are the additional openings 60 in the frame 12 of the machine for the cables to travel through.

FIG. 5 is a perspective view of the present invention 10. FIG. 5 (CCTM-I) demonstrates the correct placement of the last (2) pulleys for cable 7 30 on the left side (cable 11 38 on the right side will travel the same way). Both pulleys need to be mounted on the out side of the steel tubing and on the inner side of the frame 12 of the machine. Again proper pulley alignment will be important for the final two pulleys for cables 7&11 to work together properly without binding. A wider "v" groove type pulley 52 will also be necessary as the final pulley for both cables 7&11 to avoid derailment of the cables while in use in a variety of angles and motions conducted by user.

FIG. 6A is a perspective view of the present invention 10. FIG. 6A (CCTM-I) demonstrates how cable 8 32 on the left side travels (cable 12 40 on the right side will travel the same way). As mentioned previously, the last two pulleys for cable 8 are actually located within the steel-tubing frame 12 of the machine. This will keep the pulleys off the floor as well as the cables (8 & 12) clear from the floor and from tangling with anything else that maybe around the machine. The square openings 60 where cables 8 & 12 leave their final pulleys needs to be large for allowing a good range of motion for the cables. Again the need for a wide "v" groove pulleys 52 will also be necessary for the last pulley for both cables 8 & 12. The reason again is to avoid derailment of the cables off the pulleys while also providing a much broader and wider range of motion when cables 8 & 12 are being used.

FIG. 6B is a perspective view of the present invention 10. FIG. 6B (CCTM-I) demonstrates the lat & chin pull up 56 and chest dip and leg raise station 86 located on the back side of the machine. The user can perform wide grip pull ups, chin ups, chest dips, leg raises. Also shown are two small steps 88,84 on the base of the machine itself where the user may stand up on top of to grab the lat/chin bar 56 and/or get into position to perform chest dips and/or leg raises 86,84. Note the two steps need to be welded on to the frame 12 of the machine. Shown also is how cable 4 24 as it travels toward the floor is clear of the user using the chest dip/leg raise station.

FIG. 7 is a perspective view of an optional addition of the present invention 10. FIG. 7 (CCTM-III) demonstrates an optional add-on option for the possibilities for additional pulleys and cables.

FIG. 8A is a perspective view of the present invention 10. FIG. 8A (CCTM-I) demonstrates the location of weight stack 1 14 and weight stack 2 16 and the location of the unison bar 54.

FIG. 8B is a perspective view of the present invention 10. FIG. 8B (CCTM-I) demonstrates the location of weight stack 1 14 and weight stack 2 16, and the unison bar 54 is in place. It also demonstrates cables 1 18, 2 20, 3 22 & 4 24 are being used with the unison bar. Cables 1, 2, 3& 4 will almost always have to be used with the unison bar. Where the cables 2 &3 have the option not to use the unison bar where cable 2 can connect to weight stack 1 and cable 3 can connect to weight stack 2. Note: no more than (2) cables will ever be attached to the steel eyelet 55 of the unison bar at one time. The rest of the cables will be secured in each of their designated home positions.

FIG. 8C is a perspective view of the present invention 10. FIG. 8C: (CCTM-I) the unison bar 54 is not in place. Cables 5 26, 6 28, 7 30 & 8 32 on the left side of the machine are being shown being demonstrated and designated to using weight stack 1 14 by means of the weight stack lift eye 90. Remember, the cables could remain where they are shown to be attached to weight stack 1 and also still also have the option to put the unison bar in place. The unison bar could be put into place to serve only as a guide without utilizing its lift eye to keep both weight stacks moving together. Also, cable combinations of 2&3, 5&9, 6&10, 7&11, 8&12 could operate with just their designated weight stacks without the unison bar. This will make each cable independent of the other. Or by using the unison bar in it's guide type application then with same cable combinations both of the weight stacks would work together as one.

FIG. 8D is a perspective view of the present invention 10. FIG. 8.D (CCTM-I) the unison bar is not in place. Cables 9 34, 10 36, 11 38 and 12 40 are shown being demonstrated and designated to weight stack 2 16 (remember, the cables could remain where they are shown to be attached to weight stack 2 and also still have the option to put the unison bar in place). The unison bar could be put into place to serve only as a "guide" without utilizing its lift eye to keep both weight stacks moving together. Also, cable combinations of 2&3, 5&9, 6&10, 7&11, 8&12 "could" operate with just their designated weight stacks without the unison bar. This will make each cable independent of the other. Or by using the unison bar in its "guide" type application then with the same cable combinations both of the weight stacks would work together as one.

FIG. 9A is a perspective view of the present invention 10. FIG. 9A (CCTM-II) demonstrates the "Olympic weight set up system" with the adjustable height barbell rack 93 and base 92. The Olympic free weight set-up (CCTM-II) utilizes the addition of Olympic free weights with and without various attachments, with the machine (CCTM-I). It is important to note that the use of the Olympic free weight option (CCTM-II) cannot be used at the same time as with all different cable options. (CCTM-I) would not be safe for the user and therefore not recommended. Shown are the solid steel blocks that act as anchors for the lower portion steel tubing barbell rack base that sits directly on top of this steel block(s) 95 and is then secured with a pin 114 to hold it in place. The upper portion steel tubing barbell base 92 fits into a "u" shaped fitting 97 where it is also secured in place by a pin 114. Also shown is the actual adjustable barbell rack 93 steel tubing that slides into the barbell rack base 92. It can be adjusted to different heights using a pin 114 to secure in the desired height position. The adjustable height of the barbell rack shall at least be able to adjust up to near a five-foot height level. Also shown are the 2½ lb. To 45 lb. Olympic weight plate holders 94 located on both sides of the machine that are part of Olympic free weight set up.

FIG. 9B is a perspective view of the present invention 10. FIG. 9B (CCTM-II) demonstrates the "Olympic weight set up system" in place. The bench press 62 is shown secured in its home position. The user may perform flat bench press exercises with the Olympic free weights. The bench press may also be put into the inclined position and the adjustable height barbell rack system can be raised up so that the user can perform the incline bench press exercise. The actual Olympic bar is also shown in the rack system with Olympic weights 108 on the bar.

FIG. 9C is a perspective view of the present invention 10. FIG. 9C (CCTM-II) demonstrates the "Olympic weight set up system" in place along with the "steel deck platform attachment" 72. The steel deck plate platform attachment is secured in its "home" position. The user can simply stand on the steel deck plate and perform exercises with the Olympic barbell 96 shown in the barbell rack 93, such as curls & squats etc. Note: the user does not have to bend down to the floor to retrieve barbell. The Olympic bar 96 is shown in the barbell rack 93 loaded with weights. Also shown are the (2) pins 114 that secure the barbell rack base 92 into position as well as another pin that allows for adjusting the height of the barbell rack.

FIG. 10A is a front view of the present invention 10. FIG. 10.A: (CCTM-II) demonstrates the pattern of both the cable "guiding" pegs 44 and the cable securing home pegs 46. The guide pegs 44 start from the outside and gradually move inward in pattern as they move down. The "securing" home pegs follow the same type of pattern. This type of pattern stops the cables from tangling with each other. Each set of the (1-6) guide pegs on both the left and right side of the machine will be stamped 47 on top of their steel caps with the numbers 1-6 on the "steel cap" of the peg. Each set of the (1-6) "home" station pegs on both the left and right side of the machine will also be stamped 47 with the numbers (1-6) on their "steel cap" of each peg. Each cable will be labeled 1-6 on both the left and right side. A "numbered" steel band near the end 43 and beginning 43 of "each" cable will have the numbers stamped on it. This allows for a very orderly fashion in which each cable will have it's own guide peg and securing home peg and to "always" to be put back to their "home secured" position. Also shown are the "u" shaped brackets 97 that are welded just slightly below the final securing home peg on both the left and right side of the machine. The purpose of these brackets 97 is to secure the other end of the Olympic weight barbell rack base 92 to the steel tubing of the frame 12. The steel tubing of the frame of the Olympic weight barbell base 92 simply sits down into the "U" shaped brackets 97. It is then secured into that position with a locking pin 114.

FIG. 10B is a front view of the present invention 10. FIG. 10.B: (CCTM-II) demonstrates a front view with "Olympic weight set up system" in place. It also shows the bench press attachment 62 in its "home" secured position. The Olympic barbell 96 is then easily accessible for the user to perform exercises.

FIG. 10C is a front view of the present invention 10. FIG. 10C (CCTM-II) demonstrates a front view of the "Olympic weight set up system" in place. It also shows the steel deck platform attachment 72 in its secured home position. The adjustable height barbell rack 93 is raised to a taller height. The user could perform such exercises as squats. The user can also get underneath the barbell 96 and pick-it up with the barbell behind their neck and resting on their shoulders and simply raise it off the barbell rack 93 and begin performing squats while standing on the very stable steel deck plate platform 72.

FIG. 10D is a front view of the present invention 10. FIG. 10D: (CCTM-II) demonstrates a close up view of the correct numbering of the cable "guide pegs" and cable "securing home pegs" 47 and steel band labeled cables 43 in numbers of 1-6 as they should be on the finished product. This is the correct numbers that should be stamped on top of the 2 sets of (1-6) cable "steel capped" guide pegs 47, on the top of the 2 sets of (1-6) cable "steel capped" securing home pegs 47 and the numbered two sets of (1-6) steel bands 43 that wrap around the beginnings of the 2 sets of (1-6) cables. Also shown is the staggered "outside to inside" pattern moving downward used for the guide pegs and securing home pegs to keep cables from tangling. Also shown are the solid steel anchoring blocks 95.

FIG. 11A is a side view of the Olympic weight system of the present invention 10. FIG. 11.A: (CCTM-II) demonstrates a side view of the Olympic weight set-up system.

FIG. 11B is a side view of the present invention 10. FIG. 11B: (CCTM-II) demonstrates the "Olympic weight plate storage system" for the cable cross trainer model II. These are heavy solid steel pegs 94 that are welded on to the side of both the left and right side of the machine. This allows the user to have easy access to the Olympic weights as needed when using the Olympic weight set up system. There will be a total of (6) solid steel pegs 94 on each side. Starting with the first peg and moving down: will handle 2 2 lb. Olympic weight plates. The second peg will handle 51 lb Olympic weight plates. The third peg down will handle 10 lb. Olympic weight plates. The fourth peg will handle 25 lb. Olympic weight plates. The fifth peg down will handle 35 lb. Olympic weight plates. The sixth peg down will handle 45 lb Olympic weight plates.

FIG. 11C is a side view of the present invention 10. FIG. 11.C: (CCTM-II) demonstrates the Olympic weight set-up system in place. The bench is its home position. The main purpose of the drawing is to demonstrate the Olympic weight system with the "Olympic leg curl extension attachment" 104. This is "different" from that using the cable system and utilizing the weight stacks. There is an Olympic free weight bar 106 welded on to the leg extension attachment 104 as shown in the drawing. The user can simply load Olympic weights 108 on to the Olympic "free weight" bar 106 on the leg extension and perform such exercises as leg curls and leg extensions without the need of using cable 4 of the machine.

FIG. 11D is a side view of the present invention 10. FIG. 11D: (CCTM-II) demonstrates the Olympic weight set up-system in place. The bench press attachment 62 is in its home position. The main purpose of this drawing is to demonstrate the adjustable "Olympic preacher curl attachment" 66 with the Olympic weight set up system. The preacher curl attachment can be adjusted forward and backward as well as up and down. The adjustments are made with the two pins 114 that are necessary to secure the attachment into position. The user can also put the barbell/curl bar in the "v" groove slot 67. Where the bar can sit until the user bends over the top of the preacher curl bench and grabs the barbell/curl bar and begins the exercise.

FIG. 11E is a side view of the present invention 10. FIG. 11E: (CCTM-II) demonstrates the Olympic weight set-up system in place. The bench is its home position. The main purpose of this drawing is to demonstrate the "adjustable lower back support" 70 as it can be used with the Olympic weight system. The adjustable lower back support can be adjusted up and down as well forward and backward. The adjustments are made with the two pins 114 necessary to secure the attachment in place. Where it is also shown with the adjustable height barbell rack is set into a "lowered" position. The user can simply pick the barbell off of the barbell rack and begin to perform such exercises as seated military shoulder presses, while at the same time gaining the benefits of having the adjustable height lower back support available while performing the exercise.

FIG. 12A is perspective view of the present invention 10. FIG. 12.A: (CCTM-II) demonstrates the left side of the Olympic weight set up system as it installs into place.

FIG. 12B is a perspective view of the present invention 10. FIG. 12B: (CCTM-II) demonstrates the left side of the Olympic weight set up system installed with barbell base 92 and without the adjustable height barbell rack 93. This also demonstrates the "Olympic weight plate storage system" 94. The ease of use with the Olympic weight plate storage system will greatly benefit the user by allowing him/her easy access to the weights. It will also be ideal for storing the plates when the cable system is being used.

FIG. 13 is a perspective view of the present invention 10. FIG. 13: (CCTM-II) demonstrates the cable cross trainer machine model II with the left side of the Olympic weight set-up system being installed. The adjustable barbell rack 93 is to be inserted into the barbell base 92 and is fixed therein at a user selected height by a pin 114.

FIG. 14 is a perspective view of the present invention 10. FIG. 14: (CCTM-II) demonstrates the cable cross trainer machine with the left side of the Olympic weight set-up system being installed. The adjustable barbell rack 93 is to be inserted into the barbell base 92 and is fixed therein at a user selected height by a pin 114.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A cable and pulley weight-training apparatus comprising:

a) a frame assembly;

b) a first weight stack integral with said frame assembly;

c) a second weight stack adjacent to said first weight stack;

d) a plurality of symmetrical opposing cables extendable to said first and second weight stacks from a plurality of workout stations via a plurality of pulleys wherein the user selectively attaches the weight-bearing ends of said cables to the weight stacks as needed for the various exercise stations thereby enabling each cable of a workout station to be used independent of the other or together;

e) removable handle members disposed on the workout station ends of said cables;

f) a unison bar for conjoining said first weight stack with said second weight stack thereby enabling said weight stacks to work in unison as a single weight stack;

g) wherein said frame comprises a base, a plurality of vertical posts, a plurality of lateral supports in communication with said vertical posts and at least one vertical guide rod for each said weight stack;

h) wherein said handle members have swivel connections to said cables to provide freedom of motion;

i) including 6 pairs of symmetrically opposing cables;

j) wherein each said cable has a steel connection latch disposed at each end thereof with a steel band wrapped around the beginning of each cable located next to said connection latch, one connection latch attachable to said handle member and the other connection latch attachable to a corresponding weight stack; and k) wherein each said cable has a corresponding guide peg with a cap to prevent the cable from slipping off and a corresponding securing peg with a steel cap, said weight-bearing ends of said cables are engaged with said corresponding securing pegs when not in use.

2. A cable and pulley weight-training apparatus as recited in claim 1, wherein each said steel band, guide peg cap and securing peg cap includes indicia to identify said cable and its respective peg caps.

3. A cable and pulley weight-training apparatus as recited in claim 2, wherein each said weight stack comprises a plurality of weight members that travel along a pair of stationary vertical guide rods, each weight member having a weight pin recess located on the side thereof for the insertion of a weight pin therein to determine the amount of weight to be used with the weight pin selection process.

4. A cable and pulley weight-training apparatus as recited in claim 3, wherein a top weight member of each said weight stack has a lift eye forming an attachment mechanism for engaging said connection latches on the weight-bearing ends of said cables.

5. A cable and pulley weight-training apparatus as recited in claim 4, wherein each said lift eye is mounted atop a substantially C-shaped unison bar lockdown integral with the respective top weight member.

6. A cable and pulley weight-training apparatus as recited in claim 5, wherein said unison bar lockdowns are open in front and are positioned to accept said unison bar therein that extends through both thereby enabling the user to lift weight members of both stacks with a single cable as selected by the weight pin selection process when said cable is connected to a lift eye centrally disposed atop said unison bar.

7. A cable and pulley weight-training apparatus as recited in claim 1, wherein said frame assembly includes a top frame support with diagonal cable guides extending from the center portion thereof to opposing corners of the frame and three steel extension tubes projecting beyond said frame with a central tube extending perpendicularly with reference to the front of the frame and the other two projecting diagonally therefrom.

8. A cable and pulley weight-training apparatus as recited in claim 7, wherein said top frame support further includes a plurality of pulleys and recesses to provide for non-abrasive movement of the cable when in use.

9. A cable and pulley weight-training apparatus as recited in claim 8, wherein said cables are symmetrically arranged in pairs throughout the frame and are designated as cables 1-12 with cables 1,2,5,6,7 & 8 located on a left side of said frame and cables 3,4,9,10,11 & 12 on a right, said cables are paired as follows:

a) cable 1 with cable 4;
b) cable 2 with cable 3;
c) cable 5 with cable 9;
d) cable 6 with cable 10;
e) cable 7 with cable 11; and
f. cable 8 with cable 12.

10. A cable and pulley weight-training apparatus as recited in claim 9, wherein cables 6 and 10 extend upward from said weight stacks when in use and from said securing pegs when they are not, up through said top frame support and extend lifted over their respective diagonal cable guides due to pulleys prior to their descent through square openings down to horizontal and vertical pulleys disposed on the exterior sides of the frame wherein the ends terminate at the work station thereof.

11. A cable and pulley weight-training apparatus as recited in claim 10, wherein cables 7 and 11 extend upward from said weight stacks when in use and from said securing pegs when they are not, up through said top frame support and extend lifted over their respective diagonal cable guides due to pulleys prior to their descent through square openings down to horizontal and vertical pulleys disposed on the interior sides of the lateral supports and within the vertical supports wherein the ends terminate at the work station thereof.

12. A cable and pulley weight-training apparatus as recited in claim 11, wherein cables 8 and 12 extend upward from said weight stacks when in use and from said securing pegs when they are not, up through said top frame support and extend lifted over their respective diagonal cable guides due to pulleys prior to their descent through square openings down to floor level where they enter a base tubing of the frame and pulleys reorient them to a horizontal position to travel parallel to the floor within said base tubing, the points of egress where said cables 8 and 12 exit the frame have enlarged recesses and wide V-groove type pulleys to provide optimal range of motion for both the cables and the user.

13. A cable and pulley weight-training apparatus as recited in claim 12, wherein cable 1 is secured to the securing pegs when not in use and to said lift eye of said unison bar which is inserted within said unison bar lockdowns when in use, cable 1 extends upward through said top frame support and directly through the center of the center steel extension tube to the work station.

14. A cable and pulley weight-training apparatus as recited in claim 13, wherein cable 2 and cable 3 extend upward from said weight stacks when in use and from said securing pegs when they are not, up through said top frame support and along opposing sides of said center extension tube, said cables 2 and 3 could be used independently with their respective weight stacks or in cooperation with each other when said unison bar is utilized therewith.

15. A cable and pulley weight-training apparatus as recited in claim 14, wherein said top frame support includes five sets of three pulleys with the three pulleys arranged side-by-side with each said diagonal support having a three-pulley set disposed adjacent to their entrance and exit recesses and another disposed at the proximal end of said center extension tube to provide the critical alignment of said cables during the travel thereof.

16. A cable and pulley weight-training apparatus as recited in claim 15, further including a bench assembly comprising:

a) a detachable padded bench;
b) a leg extension attachment; and
c) a cable 4 extension cable that engages said cable 4 to provide additional length thereto in order to fasten to said leg extension attachment to provide a selected resistance thereto.

17. A cable and pulley weight-training apparatus as recited in claim 16, wherein said bench assembly further includes a detachable preacher curl attachment that can be used in place of said leg extension attachment and is held in place with mating pins and pin recesses.

18. A cable and pulley weight-training apparatus as recited in claim 17, wherein a row and curl bar handle is provided for engaging the distal end of said cable 4 extension cable when said preacher curl attachment is in use.

19. A cable and pulley weight-training apparatus as recited in claim 18, wherein said bench assembly further includes an adjustable foot plate attachment that is attachable to the end of said bench proximal said frame and is utilized with said row and curl bar secured to a cable pair.

20. A cable and pulley weight-training apparatus as recited in claim 19, wherein said row and curl bar is secured to cables 6 and 10.

21. A cable and pulley weight-training apparatus as recited in claim 19, wherein said row and curl bar is secured to cables 7 and 11.

22. A cable and pulley weight-training apparatus as recited in claim 19, wherein said bench assembly further includes an adjustable lower back support attachment that can be adjusted back and forward and up and down.

23. A cable and pulley weight-training apparatus as recited in claim 22, wherein the front of said frame base includes a plurality of interiorly disposed steel tubing protrusions welded thereto.

24. A cable and pulley weight-training apparatus as recited in claim 23, further including a steel deck platform attachment having an underside with steel tubing that fits directly into the footprint of the frame base which fits flush and securely to prevent shifting when placed therein.

25. A cable and pulley weight-training apparatus as recited in claim 24, including an elongate six foot long steel bar having a connection mechanism disposed on the ends thereof for receiving the steel latch connections to fasten to cables 8 and 12.

26. A cable and pulley weight-training apparatus as recited in claim 25, wherein said steel bar further includes a pair of adjustable length chains that attach to the ends of cables 8 and 12 to enable the user to adjust the height of said steel bar before said cables become taut and the weight load at the other ends are felt.

27. A cable and pulley weight-training apparatus as recited in claim 26, further comprising a bicep curl bar attachment having an adjustable length chain used to attach to cable 4.

28. A cable and pulley weight-training apparatus as recited in claim 27, wherein said bench assembly further includes an adjustable leg hold attachment that can be adjusted to move up and down and in and out by using said pin selection recesses in order to gain additional hold down strength when using cables 1, 2 and 3.

29. A cable and pulley weight-training apparatus as recited in claim 28, wherein the rear portion of said frame has a roman chair/chest dip station mounted centrally thereupon.

30. A cable and pulley weight-training apparatus as recited in claim 29, wherein a lat pull-up and chin-up bar is disposed on the portion of said frame above said roman chair/chest dip station in an arrangement that will prevent said roman chair/chest dip station from interfering with the user when said lat pull-up and chin-up bar is in use.

31. A cable and pulley weight-training apparatus as recited in 30, wherein a pair of step plates project from said frame base beneath said roman chair/chest dip station.

32. A cable and pulley weight-training apparatus as recited in claim 18, wherein provisions can be provided to facilitate the use of Olympic weights therewith.

33. A cable and pulley weight-training apparatus as recited in claim 32, further including an adjustable height barbell racks and base wherein said base comprises a pair of substantially L-shaped members that are selectively attachable to said frame base and vertical supports in spaced-apart relation.

34. A cable and pulley weight-training apparatus as recited in claim 33, wherein said base members are substantially hollow and have an access recess in the horizontal portion superior the vertical portion with said recess sized to accept entry of said barbell racks therein.

35. A cable and pulley weight-training apparatus as recited in claim 34, wherein said barbell racks selectively telescope to various heights and are maintained there by a pin and the selected pinhole.

36. A cable and pulley weight-training apparatus as recited in claim 35, wherein the Olympic weight set-up includes a plurality of pegs exteriorly disposed on the side of the vertical supports at the rear of said frame to act as weight plate holders, said pegs are spaced apart accordingly to the sizes of said weights.

37. A cable and pulley weight-training apparatus as recited in claim 36, wherein said bench assembly can be installed and used in conjunction with said barbell rack to perform a plurality of exercises.

38. A cable and pulley weight-training apparatus as recited in claim 36, wherein said steel deck platform attachment can be installed and used in conjunction with said barbell rack to perform a plurality of exercises.

39. A cable and pulley weight-training apparatus as recited in claim 38, wherein said leg curl extension attachment further includes a peg for accepting a free weight thereby eliminating the need of a cable attachment.

* * * * *